US008777369B2

(12) United States Patent
Aruga et al.

(10) Patent No.: US 8,777,369 B2
(45) Date of Patent: Jul. 15, 2014

(54) INKJET TEXTILE PRINTING METHOD AND INKJET TEXTILE PRINTING APPARATUS

(75) Inventors: Yoshiharu Aruga, Nagano (JP); Shuhei Mori, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 73 days.

(21) Appl. No.: 13/494,269

(22) Filed: Jun. 12, 2012

(65) Prior Publication Data

US 2012/0327156 A1 Dec. 27, 2012

(30) Foreign Application Priority Data

Jun. 23, 2011 (JP) ..... 2011-139399

(51) Int. Cl.
*B41J 2/015* (2006.01)

(52) U.S. Cl.
USPC ..... 347/21

(58) Field of Classification Search
USPC ..... 347/21
See application file for complete search history.

(56) References Cited

U.S. PATENT DOCUMENTS

| | | | | |
|---|---|---|---|---|
| 5,867,197 | A * | 2/1999 | Aoki | 347/106 |
| 6,142,619 | A * | 11/2000 | Miura et al. | 347/101 |
| 6,200,667 | B1 * | 3/2001 | Haruta et al. | 428/32.32 |
| 6,939,583 | B2 * | 9/2005 | Katsuki et al. | 427/389.9 |
| 2002/0022120 | A1 * | 2/2002 | Katsuki et al. | 428/195 |
| 2008/0016630 | A1 | 1/2008 | Grasselli | |
| 2011/0032304 | A1 * | 2/2011 | Mozel et al. | 347/21 |

FOREIGN PATENT DOCUMENTS

| | | | |
|---|---|---|---|
| EP | 0600578 | B1 | 8/2002 |
| JP | 06-010278 | A | 1/1994 |
| JP | 06-320743 | A | 11/1994 |
| JP | 2006-181804 | A | 7/2006 |
| JP | 2010-065209 | A | 3/2010 |
| JP | 2011-179129 | A | 9/2011 |
| JP | 2011-179130 | A | 9/2011 |

OTHER PUBLICATIONS

Extended European Search Report dated Oct. 22, 2012 for the counterpart European Patent Application No. 12173276.2.

* cited by examiner

*Primary Examiner* — Justin Seo
(74) *Attorney, Agent, or Firm* — Global IP Counselors, LLP

(57) ABSTRACT

The inkjet textile printing method includes: printing onto a first fabric with a first textile printing colored liquid using a step for ejecting a first penetrant liquid from a first nozzle onto a first surface of the first fabric and a step for ejecting the first textile printing colored liquid from a second nozzle onto the first surface; printing onto a second fabric with a second textile printing colored liquid using a step for ejecting a second penetrant liquid from the first nozzle onto a first surface of the second fabric and a step for ejecting the second textile printing colored liquid from the second nozzle onto the first surface; and discharging at least one of the first penetrant liquid and the second penetrant liquid from the second nozzle between printing with the first textile printing colored liquid and printing with the second textile printing colored liquid.

12 Claims, 38 Drawing Sheets

ACIDIC INK COMPOSITION

| | Bk | Y | M | C |
|---|---|---|---|---|
| C.I. ACID BLACK 7 | 7.00 | | | |
| C.I. ACID YELLOW 42 | | 8.00 | | |
| C.I. ACID RED 52 | | | 5.00 | |
| C.I. ACID BLUE 22 | | | | 6.00 |
| GLYCERIN | 10.00 | 10.00 | 15.00 | 13.00 |
| DIETHYLENE GLYCOL | 7.00 | 8.00 | 8.00 | 10.00 |
| TRIETHYLENE GLYCOL MONOBUTYL ETHER | 5.00 | 7.50 | 7.00 | 7.00 |
| 2-PYRROLIDONE | 7.00 | 5.00 | 5.00 | 6.00 |
| OLFINE E1010 | 0.50 | 1.00 | 0.90 | 1.00 |
| TRIETHANOLAMINE | 0.30 | 0.50 | 0.50 | 0.40 |
| PROXEL XL-2 | 0.30 | 0.30 | 0.30 | 0.30 |
| ULTRAPURE WATER | REMAINDER | REMAINDER | REMAINDER | REMAINDER |

Fig. 12

REACTIVE INK COMPOSITION

| | Bk | Y | M | C |
|---|---|---|---|---|
| C.I. REACTIVE BLACK 1 | 10.00 | | | |
| C.I. REACTIVE YELLOW 12 | | 7.00 | | |
| C.I. REACTIVE RED 4 | | | 7.00 | |
| C.I. REACTIVE BLUE 15 | | | | 8.00 |
| PROPYLENE GRYCOL | 6.00 | 8.00 | 10.00 | 11.00 |
| 1,2-HEXANEDIOL | 4.00 | 5.00 | 6.00 | 5.00 |
| UREA | 5.00 | 3.00 | 2.00 | 3.00 |
| 2–PYRROLIDONE | 10.00 | 9.00 | 9.00 | 10.00 |
| OLFINE E1010 | 0.50 | 0.90 | 1.00 | 1.00 |
| TRIETHANOLAMINE | 0.10 | 0.50 | 0.40 | 0.40 |
| PROXEL XL-2 | 0.30 | 0.30 | 0.30 | 0.30 |
| ULTRAPURE WATER | REMAINDER | REMAINDER | REMAINDER | REMAINDER |

Fig. 13

DISPERSE INK COMPOSITION

| | Bk | Y | M | C |
|---|---|---|---|---|
| C.I. DISPERSE BLACK 10 | 11.00 | | | |
| C.I. DISPERSE YELLOW 90 | | 6.00 | | |
| C.I. DISPERSE RED 86 | | | 9.00 | |
| C.I. DISPERSE BLUE 171 | | | | 5.00 |
| GLYCERIN | 20.00 | 27.00 | 25.00 | 26.00 |
| TRIETHYLENE GLYCOL | 5.00 | 3.00 | 3.00 | 3.00 |
| TRIETHYLENE GLYCOL MONOMETHYL ETHER | 3.00 | 5.00 | 5.00 | 2.00 |
| OLFINE E1010 | 0.60 | 0.90 | 1.00 | 1.00 |
| TRIETHANOLAMINE | 0.50 | 0.20 | 0.50 | 0.30 |
| PROXEL XL-2 | 0.30 | 0.30 | 0.30 | 0.30 |
| ULTRAPURE WATER | REMAINDER | REMAINDER | REMAINDER | REMAINDER |

Fig. 14

PIGMENT INK COMPOSITION

| | Bk | Y | M | C |
|---|---|---|---|---|
| C.I. PIGMENT BLACK 7 | 4.00 | | | |
| C.I. PIGMENT YELLOW 110 | | 6.00 | | |
| C.I. PIGMENT RED 22 | | | 3.00 | |
| C.I. PIGMENT BLUE 56 | | | | 3.00 |
| GLYCERIN | 8.00 | 14.00 | 12.00 | 10.00 |
| TRIETHYLENE GLYCOL | 3.00 | 5.00 | 5.00 | 3.00 |
| TRIETHYLENE GLYCOL MONOBUTYL ETHER | 1.00 | 2.00 | 2.00 | 2.00 |
| OLFINE E1010 | 0.50 | 0.80 | 1.00 | 0.90 |
| TRIETHANOLAMINE | 0.50 | 0.80 | 0.80 | 0.50 |
| PROXEL XL-2 | 0.30 | 0.30 | 0.30 | 0.30 |
| ULTRAPURE WATER | REMAINDER | REMAINDER | REMAINDER | REMAINDER |

Fig. 15

PENETRANT LIQUID COMPOSITION

| | P1 | P2 | P3 | P4 | P5 | P6 | P7 | P8 |
|---|---|---|---|---|---|---|---|---|
| GLYCERIN | 15.00 | 15.00 | -- | -- | 25.00 | 25.00 | 15.00 | 15.00 |
| DIETHYLENE GLYCOL | 10.00 | 10.00 | -- | -- | -- | -- | -- | -- |
| PROPYLENE GLYCOL | -- | -- | 15.00 | 15.00 | -- | -- | -- | -- |
| TRIETHYLENE GLYCOL | -- | -- | -- | -- | 5.00 | 10.00 | 5.00 | 10.00 |
| TRIETHYLENE GLYCOL MONOBUTYL ETHER | 5.00 | 5.00 | -- | -- | -- | -- | 1.00 | 1.00 |
| TRIETHYLENE GRYCOL MONOMETHYL ETHER | -- | -- | -- | -- | 5.00 | 5.00 | -- | -- |
| 1,2-HEXANEDIOL | -- | -- | 5.00 | 5.00 | -- | -- | -- | -- |
| 2–PYRROLIDONE | 5.00 | 10.00 | 5.00 | 1000 | -- | -- | -- | -- |
| UREA | -- | -- | 5.00 | 5.00 | -- | -- | -- | -- |
| OLFINE E1010 | 1.00 | 1.00 | 1.00 | 1.00 | 1.00 | 1.00 | 1.00 | 1.00 |
| ULTRAPURE WATER | REMAINDER | REMAINDER | REMAINDER | REMAINDER | REMAINDER | REMAINDER | REMAINDER | REMAINDER |

Fig. 16

| | | Penetrant Liquid | | | | | | | |
|---|---|---|---|---|---|---|---|---|---|
| Ink Type | Evaluation Category | P1 | P2 | P3 | P4 | P5 | P6 | P7 | P8 |
| Acidic Ink Set | Density Difference | ○ | ○ | △ | △ | × | × | × | × |
| | Bleeding | ◎ | ○ | ○ | ○ | ○ | ○ | ○ | ○ |
| | Cleaning Performance | ○ | ◎ | ○ | ◎ | △ | △ | △ | △ |
| Reactive Ink Set | Density Difference | △ | △ | ○ | ○ | × | × | × | × |
| | Bleeding | ○ | ○ | ◎ | ○ | ○ | ○ | ○ | ○ |
| | Cleaning Performance | ○ | ◎ | ○ | ◎ | △ | △ | △ | △ |
| Disperse Ink Set | Density Difference | × | × | × | × | ○ | ○ | △ | △ |
| | Bleeding | ○ | ○ | ○ | ○ | ◎ | ○ | ○ | ○ |
| | Cleaning Performance | △ | △ | △ | △ | ○ | ◎ | ○ | ◎ |
| Pigment Ink Set | Density Difference | × | × | × | × | × | × | △ | △ |
| | Bleeding | ○ | ○ | ○ | ○ | ○ | ○ | ◎ | ○ |
| | Cleaning Performance | △ | △ | △ | △ | ○ | ◎ | ○ | ◎ |

Fig. 17

PRINT WITH ACIDIC INK → EJECT PENETRANT LIQUID FROM SECOND NOZZLE → PRINT WITH ACIDIC INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 1 | P1 | ACIDIC INK | P1 | FABRIC 1 | P1 | ACIDIC INK | NONE | ○ | ◎ | ○ | NONE | ○ | ◎ | NONE |
| FABRIC 1 | P1 | ACIDIC INK | P1 | FABRIC 1 | P2 | ACIDIC INK | NONE | ○ | ◎ | ○ | NONE | ○ | ○ | NONE |
| FABRIC 1 | P1 | ACIDIC INK | P2 | FABRIC 1 | P2 | ACIDIC INK | NONE | ○ | ◎ | ○ | NONE | ○ | ○ | NONE |
| FABRIC 1 | P1 | ACIDIC INK | P1 | FABRIC 1 | P3 | ACIDIC INK | NONE | ○ | ◎ | ○ | NONE | △ | ○ | NONE |
| FABRIC 1 | P1 | ACIDIC INK | P3 | FABRIC 1 | P3 | ACIDIC INK | NONE | ○ | ◎ | ○ | NONE | △ | ○ | NONE |
| FABRIC 1 | P1 | ACIDIC INK | P1 | FABRIC 1 | P4 | ACIDIC INK | NONE | ○ | ◎ | ○ | NONE | △ | ○ | NONE |
| FABRIC 1 | P1 | ACIDIC INK | P4 | FABRIC 1 | P4 | ACIDIC INK | NONE | ○ | ◎ | ○ | NONE | △ | ○ | NONE |
| FABRIC 1 | P2 | ACIDIC INK | P2 | FABRIC 1 | P2 | ACIDIC INK | NONE | ○ | ○ | ◎ | NONE | ○ | ○ | NONE |
| FABRIC 1 | P2 | ACIDIC INK | P2 | FABRIC 1 | P1 | ACIDIC INK | NONE | ○ | ○ | ◎ | NONE | ○ | ◎ | NONE |
| FABRIC 1 | P2 | ACIDIC INK | P1 | FABRIC 1 | P1 | ACIDIC INK | NONE | ○ | ○ | ○ | NONE | ○ | ◎ | NONE |
| FABRIC 1 | P2 | ACIDIC INK | P2 | FABRIC 1 | P3 | ACIDIC INK | NONE | ○ | ○ | ◎ | NONE | △ | ○ | NONE |
| FABRIC 1 | P2 | ACIDIC INK | P3 | FABRIC 1 | P3 | ACIDIC INK | NONE | ○ | ○ | ○ | NONE | △ | ○ | NONE |
| FABRIC 1 | P2 | ACIDIC INK | P2 | FABRIC 1 | P4 | ACIDIC INK | NONE | ○ | ○ | ◎ | NONE | △ | ○ | NONE |
| FABRIC 1 | P2 | ACIDIC INK | P4 | FABRIC 1 | P4 | ACIDIC INK | NONE | ○ | ○ | ○ | NONE | △ | ○ | NONE |
| FABRIC 1 | P3 | ACIDIC INK | P3 | FABRIC 1 | P3 | ACIDIC INK | NONE | △ | ○ | ○ | NONE | △ | ○ | NONE |
| FABRIC 1 | P3 | ACIDIC INK | P3 | FABRIC 1 | P1 | ACIDIC INK | NONE | △ | ○ | ○ | NONE | ○ | ◎ | NONE |
| FABRIC 1 | P3 | ACIDIC INK | P1 | FABRIC 1 | P1 | ACIDIC INK | NONE | △ | ○ | ○ | NONE | ○ | ◎ | NONE |
| FABRIC 1 | P3 | ACIDIC INK | P3 | FABRIC 1 | P2 | ACIDIC INK | NONE | △ | ○ | ○ | NONE | ○ | ○ | NONE |
| FABRIC 1 | P3 | ACIDIC INK | P2 | FABRIC 1 | P2 | ACIDIC INK | NONE | △ | ○ | ○ | NONE | ○ | ○ | NONE |
| FABRIC 1 | P3 | ACIDIC INK | P3 | FABRIC 1 | P4 | ACIDIC INK | NONE | △ | ○ | ○ | NONE | △ | ○ | NONE |
| FABRIC 1 | P3 | ACIDIC INK | P4 | FABRIC 1 | P4 | ACIDIC INK | NONE | △ | ○ | ○ | NONE | △ | ○ | NONE |
| FABRIC 1 | P4 | ACIDIC INK | P4 | FABRIC 1 | P4 | ACIDIC INK | NONE | △ | ○ | ◎ | NONE | △ | ○ | NONE |
| FABRIC 1 | P4 | ACIDIC INK | P4 | FABRIC 1 | P1 | ACIDIC INK | NONE | △ | ○ | ◎ | NONE | ○ | ◎ | NONE |
| FABRIC 1 | P4 | ACIDIC INK | P1 | FABRIC 1 | P1 | ACIDIC INK | NONE | △ | ○ | ○ | NONE | ○ | ◎ | NONE |
| FABRIC 1 | P4 | ACIDIC INK | P4 | FABRIC 1 | P2 | ACIDIC INK | NONE | △ | ○ | ◎ | NONE | ○ | ○ | NONE |
| FABRIC 1 | P4 | ACIDIC INK | P2 | FABRIC 1 | P2 | ACIDIC INK | NONE | △ | ○ | ○ | NONE | ○ | ○ | NONE |
| FABRIC 1 | P4 | ACIDIC INK | P4 | FABRIC 1 | P3 | ACIDIC INK | NONE | △ | ○ | ◎ | NONE | △ | ○ | NONE |
| FABRIC 1 | P4 | ACIDIC INK | P3 | FABRIC 1 | P3 | ACIDIC INK | NONE | △ | ○ | ○ | NONE | △ | ○ | NONE |

Fig. 23

PRINT WITH REACTIVE INK → EJECT PENETRANT LIQUID FROM SECOND NOZZLE → PRINT WITH REACTIVE INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 2 | P1 | REACTIVE INK | P1 | FABRIC 2 | P1 | REACTIVE INK | NONE | △ | ○ | ○ | NONE | △ | ○ | NONE |
| FABRIC 2 | P1 | REACTIVE INK | P1 | FABRIC 2 | P2 | REACTIVE INK | NONE | △ | ○ | ○ | NONE | △ | ○ | NONE |
| FABRIC 2 | P1 | REACTIVE INK | P2 | FABRIC 2 | P2 | REACTIVE INK | NONE | △ | ○ | ○ | NONE | △ | ○ | NONE |
| FABRIC 2 | P1 | REACTIVE INK | P1 | FABRIC 2 | P3 | REACTIVE INK | NONE | △ | ○ | ○ | NONE | ○ | ◎ | NONE |
| FABRIC 2 | P1 | REACTIVE INK | P3 | FABRIC 2 | P3 | REACTIVE INK | NONE | △ | ○ | ○ | NONE | ○ | ◎ | NONE |
| FABRIC 2 | P1 | REACTIVE INK | P1 | FABRIC 2 | P4 | REACTIVE INK | NONE | △ | ○ | ○ | NONE | ○ | ○ | NONE |
| FABRIC 2 | P1 | REACTIVE INK | P4 | FABRIC 2 | P4 | REACTIVE INK | NONE | △ | ○ | ○ | NONE | ○ | ○ | NONE |
| FABRIC 2 | P2 | REACTIVE INK | P2 | FABRIC 2 | P2 | REACTIVE INK | NONE | △ | ○ | ◎ | NONE | △ | ○ | NONE |
| FABRIC 2 | P2 | REACTIVE INK | P2 | FABRIC 2 | P1 | REACTIVE INK | NONE | △ | ○ | ◎ | NONE | △ | ○ | NONE |
| FABRIC 2 | P2 | REACTIVE INK | P1 | FABRIC 2 | P1 | REACTIVE INK | NONE | △ | ○ | ○ | NONE | △ | ○ | NONE |
| FABRIC 2 | P2 | REACTIVE INK | P2 | FABRIC 2 | P3 | REACTIVE INK | NONE | △ | ○ | ◎ | NONE | ○ | ◎ | NONE |
| FABRIC 2 | P2 | REACTIVE INK | P3 | FABRIC 2 | P3 | REACTIVE INK | NONE | △ | ○ | ○ | NONE | ○ | ◎ | NONE |
| FABRIC 2 | P2 | REACTIVE INK | P2 | FABRIC 2 | P4 | REACTIVE INK | NONE | △ | ○ | ◎ | NONE | ○ | ○ | NONE |
| FABRIC 2 | P2 | REACTIVE INK | P4 | FABRIC 2 | P4 | REACTIVE INK | NONE | △ | ○ | ○ | NONE | ○ | ○ | NONE |
| FABRIC 2 | P3 | REACTIVE INK | P3 | FABRIC 2 | P3 | REACTIVE INK | NONE | ○ | ◎ | ○ | NONE | ○ | ◎ | NONE |
| FABRIC 2 | P3 | REACTIVE INK | P3 | FABRIC 2 | P1 | REACTIVE INK | NONE | ○ | ◎ | ○ | NONE | △ | ○ | NONE |
| FABRIC 2 | P3 | REACTIVE INK | P1 | FABRIC 2 | P1 | REACTIVE INK | NONE | ○ | ◎ | ○ | NONE | △ | ○ | NONE |
| FABRIC 2 | P3 | REACTIVE INK | P3 | FABRIC 2 | P2 | REACTIVE INK | NONE | ○ | ◎ | ○ | NONE | △ | ○ | NONE |
| FABRIC 2 | P3 | REACTIVE INK | P2 | FABRIC 2 | P2 | REACTIVE INK | NONE | ○ | ◎ | ○ | NONE | △ | ○ | NONE |
| FABRIC 2 | P3 | REACTIVE INK | P3 | FABRIC 2 | P4 | REACTIVE INK | NONE | ○ | ◎ | ○ | NONE | ○ | ○ | NONE |
| FABRIC 2 | P3 | REACTIVE INK | P4 | FABRIC 2 | P4 | REACTIVE INK | NONE | ○ | ◎ | ○ | NONE | ○ | ○ | NONE |
| FABRIC 2 | P4 | REACTIVE INK | P4 | FABRIC 2 | P4 | REACTIVE INK | NONE | ○ | ○ | ◎ | NONE | ○ | ○ | NONE |
| FABRIC 2 | P4 | REACTIVE INK | P4 | FABRIC 2 | P1 | REACTIVE INK | NONE | ○ | ○ | ◎ | NONE | △ | ○ | NONE |
| FABRIC 2 | P4 | REACTIVE INK | P1 | FABRIC 2 | P1 | REACTIVE INK | NONE | ○ | ○ | ○ | NONE | △ | ○ | NONE |
| FABRIC 2 | P4 | REACTIVE INK | P4 | FABRIC 2 | P2 | REACTIVE INK | NONE | ○ | ○ | ◎ | NONE | △ | ○ | NONE |
| FABRIC 2 | P4 | REACTIVE INK | P2 | FABRIC 2 | P2 | REACTIVE INK | NONE | ○ | ○ | ○ | NONE | △ | ○ | NONE |
| FABRIC 2 | P4 | REACTIVE INK | P4 | FABRIC 2 | P3 | REACTIVE INK | NONE | ○ | ○ | ◎ | NONE | ○ | ◎ | NONE |
| FABRIC 2 | P4 | REACTIVE INK | P3 | FABRIC 2 | P3 | REACTIVE INK | NONE | ○ | ○ | ○ | NONE | ○ | ◎ | NONE |

Fig. 24

PRINT WITH DISPERSE INK → EJECT PENETRANT LIQUID FROM SECOND NOZZLE → PRINT WITH DISPERSE INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 3 | P5 | DISPERSE INK | P5 | FABRIC 3 | P5 | DISPERSE INK | NONE | ○ | ◎ | ○ | NONE | ○ | ◎ | NONE |
| FABRIC 3 | P5 | DISPERSE INK | P5 | FABRIC 3 | P6 | DISPERSE INK | NONE | ○ | ◎ | ○ | NONE | ○ | ○ | NONE |
| FABRIC 3 | P5 | DISPERSE INK | P6 | FABRIC 3 | P6 | DISPERSE INK | NONE | ○ | ◎ | ○ | NONE | ○ | ○ | NONE |
| FABRIC 3 | P5 | DISPERSE INK | P5 | FABRIC 3 | P7 | DISPERSE INK | NONE | ○ | ◎ | ○ | NONE | △ | ◎ | NONE |
| FABRIC 3 | P5 | DISPERSE INK | P7 | FABRIC 3 | P7 | DISPERSE INK | NONE | ○ | ◎ | ○ | NONE | △ | ◎ | NONE |
| FABRIC 3 | P5 | DISPERSE INK | P5 | FABRIC 3 | P8 | DISPERSE INK | NONE | ○ | ◎ | ○ | NONE | △ | ○ | NONE |
| FABRIC 3 | P5 | DISPERSE INK | P8 | FABRIC 3 | P8 | DISPERSE INK | NONE | ○ | ◎ | ○ | NONE | △ | ○ | NONE |
| FABRIC 3 | P6 | DISPERSE INK | P6 | FABRIC 3 | P6 | DISPERSE INK | NONE | ○ | ○ | ◎ | NONE | ○ | ○ | NONE |
| FABRIC 3 | P6 | DISPERSE INK | P6 | FABRIC 3 | P5 | DISPERSE INK | NONE | ○ | ○ | ◎ | NONE | ○ | ◎ | NONE |
| FABRIC 3 | P6 | DISPERSE INK | P5 | FABRIC 3 | P5 | DISPERSE INK | NONE | ○ | ○ | ○ | NONE | ○ | ◎ | NONE |
| FABRIC 3 | P6 | DISPERSE INK | P6 | FABRIC 3 | P7 | DISPERSE INK | NONE | ○ | ○ | ◎ | NONE | △ | ◎ | NONE |
| FABRIC 3 | P6 | DISPERSE INK | P7 | FABRIC 3 | P7 | DISPERSE INK | NONE | ○ | ○ | ○ | NONE | △ | ◎ | NONE |
| FABRIC 3 | P6 | DISPERSE INK | P6 | FABRIC 3 | P8 | DISPERSE INK | NONE | ○ | ○ | ◎ | NONE | △ | ○ | NONE |
| FABRIC 3 | P6 | DISPERSE INK | P8 | FABRIC 3 | P8 | DISPERSE INK | NONE | ○ | ○ | ○ | NONE | △ | ○ | NONE |
| FABRIC 3 | P7 | DISPERSE INK | P7 | FABRIC 3 | P7 | DISPERSE INK | NONE | △ | ◎ | ○ | NONE | △ | ◎ | NONE |
| FABRIC 3 | P7 | DISPERSE INK | P7 | FABRIC 3 | P5 | DISPERSE INK | NONE | △ | ◎ | ○ | NONE | ○ | ◎ | NONE |
| FABRIC 3 | P7 | DISPERSE INK | P5 | FABRIC 3 | P5 | DISPERSE INK | NONE | △ | ◎ | ○ | NONE | ○ | ◎ | NONE |
| FABRIC 3 | P7 | DISPERSE INK | P7 | FABRIC 3 | P6 | DISPERSE INK | NONE | △ | ◎ | ○ | NONE | ○ | ○ | NONE |
| FABRIC 3 | P7 | DISPERSE INK | P6 | FABRIC 3 | P6 | DISPERSE INK | NONE | △ | ◎ | ○ | NONE | ○ | ○ | NONE |
| FABRIC 3 | P7 | DISPERSE INK | P7 | FABRIC 3 | P8 | DISPERSE INK | NONE | △ | ◎ | ○ | NONE | △ | ○ | NONE |
| FABRIC 3 | P7 | DISPERSE INK | P8 | FABRIC 3 | P8 | DISPERSE INK | NONE | △ | ◎ | ○ | NONE | △ | ○ | NONE |
| FABRIC 3 | P8 | DISPERSE INK | P8 | FABRIC 3 | P8 | DISPERSE INK | NONE | △ | ○ | ◎ | NONE | △ | ○ | NONE |
| FABRIC 3 | P8 | DISPERSE INK | P8 | FABRIC 3 | P5 | DISPERSE INK | NONE | △ | ○ | ◎ | NONE | ○ | ◎ | NONE |
| FABRIC 3 | P8 | DISPERSE INK | P5 | FABRIC 3 | P5 | DISPERSE INK | NONE | △ | ○ | ○ | NONE | ○ | ◎ | NONE |
| FABRIC 3 | P8 | DISPERSE INK | P8 | FABRIC 3 | P6 | DISPERSE INK | NONE | △ | ○ | ◎ | NONE | ○ | ○ | NONE |
| FABRIC 3 | P8 | DISPERSE INK | P6 | FABRIC 3 | P6 | DISPERSE INK | NONE | △ | ○ | ○ | NONE | ○ | ○ | NONE |
| FABRIC 3 | P8 | DISPERSE INK | P8 | FABRIC 3 | P7 | DISPERSE INK | NONE | △ | ○ | ◎ | NONE | △ | ◎ | NONE |
| FABRIC 3 | P8 | DISPERSE INK | P7 | FABRIC 3 | P7 | DISPERSE INK | NONE | △ | ○ | ○ | NONE | △ | ◎ | NONE |

Fig. 25

PRINT WITH PIGMENT INK → EJECT PENETRANT LIQUID FROM SECOND NOZZLE → PRINT WITH PIGMENT INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 4 | P7 | PIGMENT INK | P7 | FABRIC 4 | P7 | PIGMENT INK | NONE | △ | ◎ | ○ | NONE | △ | ◎ | NONE |
| FABRIC 4 | P7 | PIGMENT INK | P7 | FABRIC 4 | P8 | PIGMENT INK | NONE | △ | ◎ | ○ | NONE | △ | ○ | NONE |
| FABRIC 4 | P7 | PIGMENT INK | P8 | FABRIC 4 | P8 | PIGMENT INK | NONE | △ | ◎ | ○ | NONE | △ | ○ | NONE |
| FABRIC 4 | P8 | PIGMENT INK | P8 | FABRIC 4 | P8 | PIGMENT INK | NONE | △ | ○ | ◎ | NONE | △ | ○ | NONE |
| FABRIC 4 | P8 | PIGMENT INK | P8 | FABRIC 4 | P7 | PIGMENT INK | NONE | △ | ○ | ◎ | NONE | △ | ◎ | NONE |
| FABRIC 4 | P8 | PIGMENT INK | P7 | FABRIC 4 | P7 | PIGMENT INK | NONE | △ | ○ | ○ | NONE | △ | ◎ | NONE |

Fig. 26

PRINT WITH ACIDIC INK → EJECT PENETRANT LIQUID FROM SECOND NOZZLE → PRINT WITH REACTIVE INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 1 | P1 | ACIDIC INK | P1 | FABRIC 2 | P1 | REACTIVE INK | NONE | ○ | ◎ | ○ | NONE | △ | ○ | NONE |
| FABRIC 1 | P1 | ACIDIC INK | P1 | FABRIC 2 | P2 | REACTIVE INK | NONE | ○ | ◎ | ○ | NONE | △ | ○ | NONE |
| FABRIC 1 | P1 | ACIDIC INK | P2 | FABRIC 2 | P2 | REACTIVE INK | NONE | ○ | ◎ | ○ | NONE | △ | ○ | NONE |
| FABRIC 1 | P1 | ACIDIC INK | P1 | FABRIC 2 | P3 | REACTIVE INK | NONE | ○ | ◎ | ○ | NONE | ○ | ◎ | NONE |
| FABRIC 1 | P1 | ACIDIC INK | P3 | FABRIC 2 | P3 | REACTIVE INK | NONE | ○ | ◎ | ○ | NONE | ○ | ◎ | NONE |
| FABRIC 1 | P1 | ACIDIC INK | P1 | FABRIC 2 | P4 | REACTIVE INK | NONE | ○ | ◎ | ○ | NONE | ○ | ○ | NONE |
| FABRIC 1 | P1 | ACIDIC INK | P4 | FABRIC 2 | P4 | REACTIVE INK | NONE | ○ | ◎ | ○ | NONE | ○ | ○ | NONE |
| FABRIC 1 | P2 | ACIDIC INK | P2 | FABRIC 2 | P1 | REACTIVE INK | NONE | ○ | ○ | ◎ | NONE | △ | ○ | NONE |
| FABRIC 1 | P2 | ACIDIC INK | P1 | FABRIC 2 | P1 | REACTIVE INK | NONE | ○ | ○ | ○ | NONE | △ | ○ | NONE |
| FABRIC 1 | P2 | ACIDIC INK | P2 | FABRIC 2 | P2 | REACTIVE INK | NONE | ○ | ○ | ◎ | NONE | △ | ○ | NONE |
| FABRIC 1 | P2 | ACIDIC INK | P2 | FABRIC 2 | P3 | REACTIVE INK | NONE | ○ | ○ | ○ | NONE | ○ | ◎ | NONE |
| FABRIC 1 | P2 | ACIDIC INK | P3 | FABRIC 2 | P3 | REACTIVE INK | NONE | ○ | ○ | ○ | NONE | ○ | ◎ | NONE |
| FABRIC 1 | P2 | ACIDIC INK | P2 | FABRIC 2 | P4 | REACTIVE INK | NONE | ○ | ○ | ◎ | NONE | ○ | ○ | NONE |
| FABRIC 1 | P2 | ACIDIC INK | P4 | FABRIC 2 | P4 | REACTIVE INK | NONE | ○ | ○ | ○ | NONE | ○ | ○ | NONE |
| FABRIC 1 | P3 | ACIDIC INK | P3 | FABRIC 2 | P1 | REACTIVE INK | NONE | △ | ○ | ○ | NONE | △ | ○ | NONE |
| FABRIC 1 | P3 | ACIDIC INK | P1 | FABRIC 2 | P1 | REACTIVE INK | NONE | △ | ○ | ○ | NONE | △ | ○ | NONE |
| FABRIC 1 | P3 | ACIDIC INK | P3 | FABRIC 2 | P2 | REACTIVE INK | NONE | △ | ○ | ○ | NONE | △ | ○ | NONE |
| FABRIC 1 | P3 | ACIDIC INK | P2 | FABRIC 2 | P2 | REACTIVE INK | NONE | △ | ○ | ○ | NONE | △ | ○ | NONE |
| FABRIC 1 | P3 | ACIDIC INK | P3 | FABRIC 2 | P3 | REACTIVE INK | NONE | △ | ○ | ○ | NONE | ○ | ◎ | NONE |
| FABRIC 1 | P3 | ACIDIC INK | P3 | FABRIC 2 | P4 | REACTIVE INK | NONE | △ | ○ | ○ | NONE | ○ | ○ | NONE |
| FABRIC 1 | P3 | ACIDIC INK | P4 | FABRIC 2 | P4 | REACTIVE INK | NONE | △ | ○ | ○ | NONE | ○ | ○ | NONE |
| FABRIC 1 | P4 | ACIDIC INK | P4 | FABRIC 2 | P1 | REACTIVE INK | NONE | △ | ○ | ◎ | NONE | △ | ○ | NONE |
| FABRIC 1 | P4 | ACIDIC INK | P1 | FABRIC 2 | P1 | REACTIVE INK | NONE | △ | ○ | ○ | NONE | △ | ○ | NONE |
| FABRIC 1 | P4 | ACIDIC INK | P4 | FABRIC 2 | P2 | REACTIVE INK | NONE | △ | ○ | ◎ | NONE | △ | ○ | NONE |
| FABRIC 1 | P4 | ACIDIC INK | P2 | FABRIC 2 | P2 | REACTIVE INK | NONE | △ | ○ | ○ | NONE | △ | ○ | NONE |
| FABRIC 1 | P4 | ACIDIC INK | P4 | FABRIC 2 | P3 | REACTIVE INK | NONE | △ | ○ | ◎ | NONE | ○ | ◎ | NONE |
| FABRIC 1 | P4 | ACIDIC INK | P3 | FABRIC 2 | P3 | REACTIVE INK | NONE | △ | ○ | ○ | NONE | ○ | ◎ | NONE |
| FABRIC 1 | P4 | ACIDIC INK | P4 | FABRIC 2 | P4 | REACTIVE INK | NONE | △ | ○ | ◎ | NONE | ○ | ○ | NONE |

Fig. 27

PRINT WITH REACTIVE INK → EJECT PENETRANT LIQUID FROM SECOND NOZZLE → PRINT WITH ACIDIC INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 2 | P1 | REACTIVE INK | P1 | FABRIC 1 | P1 | ACIDIC INK | NONE | △ | ○ | ○ | NONE | ○ | ◎ | NONE |
| FABRIC 2 | P2 | REACTIVE INK | P1 | FABRIC 1 | P1 | ACIDIC INK | NONE | △ | ○ | ○ | NONE | ○ | ◎ | NONE |
| FABRIC 2 | P2 | REACTIVE INK | P1 | FABRIC 1 | P2 | ACIDIC INK | NONE | △ | ○ | ○ | NONE | ○ | ○ | NONE |
| FABRIC 2 | P3 | REACTIVE INK | P1 | FABRIC 1 | P1 | ACIDIC INK | NONE | ○ | ◎ | ○ | NONE | ○ | ◎ | NONE |
| FABRIC 2 | P3 | REACTIVE INK | P1 | FABRIC 1 | P3 | ACIDIC INK | NONE | ○ | ◎ | ○ | NONE | △ | ○ | NONE |
| FABRIC 2 | P4 | REACTIVE INK | P1 | FABRIC 1 | P1 | ACIDIC INK | NONE | ○ | ○ | ○ | NONE | ○ | ◎ | NONE |
| FABRIC 2 | P4 | REACTIVE INK | P1 | FABRIC 1 | P4 | ACIDIC INK | NONE | ○ | ○ | ○ | NONE | △ | ○ | NONE |
| FABRIC 2 | P1 | REACTIVE INK | P2 | FABRIC 1 | P2 | ACIDIC INK | NONE | △ | ○ | ○ | NONE | ○ | ○ | NONE |
| FABRIC 2 | P1 | REACTIVE INK | P2 | FABRIC 1 | P1 | ACIDIC INK | NONE | △ | ○ | ○ | NONE | ○ | ◎ | NONE |
| FABRIC 2 | P2 | REACTIVE INK | P2 | FABRIC 1 | P2 | ACIDIC INK | NONE | △ | ○ | ◎ | NONE | ○ | ○ | NONE |
| FABRIC 2 | P3 | REACTIVE INK | P2 | FABRIC 1 | P2 | ACIDIC INK | NONE | ○ | ◎ | ○ | NONE | ○ | ○ | NONE |
| FABRIC 2 | P3 | REACTIVE INK | P2 | FABRIC 1 | P3 | ACIDIC INK | NONE | ○ | ◎ | ○ | NONE | △ | ○ | NONE |
| FABRIC 2 | P4 | REACTIVE INK | P2 | FABRIC 1 | P2 | ACIDIC INK | NONE | ○ | ○ | ○ | NONE | ○ | ○ | NONE |
| FABRIC 2 | P4 | REACTIVE INK | P2 | FABRIC 1 | P4 | ACIDIC INK | NONE | ○ | ○ | ○ | NONE | △ | ○ | NONE |
| FABRIC 2 | P1 | REACTIVE INK | P3 | FABRIC 1 | P3 | ACIDIC INK | NONE | △ | ○ | ○ | NONE | △ | ○ | NONE |
| FABRIC 2 | P1 | REACTIVE INK | P3 | FABRIC 1 | P1 | ACIDIC INK | NONE | △ | ○ | ○ | NONE | ○ | ◎ | NONE |
| FABRIC 2 | P2 | REACTIVE INK | P3 | FABRIC 1 | P3 | ACIDIC INK | NONE | △ | ○ | ○ | NONE | △ | ○ | NONE |
| FABRIC 2 | P2 | REACTIVE INK | P3 | FABRIC 1 | P2 | ACIDIC INK | NONE | △ | ○ | ○ | NONE | ○ | ○ | NONE |
| FABRIC 2 | P3 | REACTIVE INK | P3 | FABRIC 1 | P3 | ACIDIC INK | NONE | ○ | ◎ | ○ | NONE | △ | ○ | NONE |
| FABRIC 2 | P4 | REACTIVE INK | P3 | FABRIC 1 | P3 | ACIDIC INK | NONE | ○ | ○ | ○ | NONE | △ | ○ | NONE |
| FABRIC 2 | P4 | REACTIVE INK | P3 | FABRIC 1 | P4 | ACIDIC INK | NONE | ○ | ○ | ○ | NONE | △ | ○ | NONE |
| FABRIC 2 | P1 | REACTIVE INK | P4 | FABRIC 1 | P4 | ACIDIC INK | NONE | △ | ○ | ○ | NONE | △ | ○ | NONE |
| FABRIC 2 | P1 | REACTIVE INK | P4 | FABRIC 1 | P1 | ACIDIC INK | NONE | △ | ○ | ○ | NONE | ○ | ◎ | NONE |
| FABRIC 2 | P2 | REACTIVE INK | P4 | FABRIC 1 | P4 | ACIDIC INK | NONE | △ | ○ | ○ | NONE | △ | ○ | NONE |
| FABRIC 2 | P2 | REACTIVE INK | P4 | FABRIC 1 | P2 | ACIDIC INK | NONE | △ | ○ | ○ | NONE | ○ | ○ | NONE |
| FABRIC 2 | P3 | REACTIVE INK | P4 | FABRIC 1 | P4 | ACIDIC INK | NONE | ○ | ◎ | ○ | NONE | △ | ○ | NONE |
| FABRIC 2 | P3 | REACTIVE INK | P4 | FABRIC 1 | P3 | ACIDIC INK | NONE | ○ | ◎ | ○ | NONE | △ | ○ | NONE |
| FABRIC 2 | P4 | REACTIVE INK | P4 | FABRIC 1 | P4 | ACIDIC INK | NONE | ○ | ○ | ◎ | NONE | △ | ○ | NONE |

Fig. 28

PRINT WITH ACIDIC INK → EJECT PENETRANT LIQUID FROM SECOND NOZZLE → PRINT WITH DISPERSE INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 1 | P1 | ACIDIC INK | P1 | FABRIC 3 | P5 | DISPERSE INK | NONE | ○ | ◎ | ○ | NONE | ○ | ◎ | NONE |
| FABRIC 1 | P1 | ACIDIC INK | P5 | FABRIC 3 | P5 | DISPERSE INK | NONE | ○ | ◎ | △ | NONE | ○ | ◎ | NONE |
| FABRIC 1 | P1 | ACIDIC INK | P1 | FABRIC 3 | P6 | DISPERSE INK | NONE | ○ | ◎ | ○ | NONE | ○ | ○ | NONE |
| FABRIC 1 | P1 | ACIDIC INK | P6 | FABRIC 3 | P6 | DISPERSE INK | NONE | ○ | ◎ | △ | NONE | ○ | ○ | NONE |
| FABRIC 1 | P1 | ACIDIC INK | P1 | FABRIC 3 | P7 | DISPERSE INK | NONE | ○ | ◎ | ○ | NONE | △ | ○ | NONE |
| FABRIC 1 | P1 | ACIDIC INK | P7 | FABRIC 3 | P7 | DISPERSE INK | NONE | ○ | ◎ | △ | NONE | △ | ○ | NONE |
| FABRIC 1 | P1 | ACIDIC INK | P1 | FABRIC 3 | P8 | DISPERSE INK | NONE | ○ | ◎ | ○ | NONE | △ | ○ | NONE |
| FABRIC 1 | P1 | ACIDIC INK | P8 | FABRIC 3 | P8 | DISPERSE INK | NONE | ○ | ◎ | △ | NONE | △ | ○ | NONE |
| FABRIC 1 | P2 | ACIDIC INK | P2 | FABRIC 3 | P5 | DISPERSE INK | NONE | ○ | ○ | ◎ | NONE | ○ | ◎ | NONE |
| FABRIC 1 | P2 | ACIDIC INK | P5 | FABRIC 3 | P5 | DISPERSE INK | NONE | ○ | ○ | △ | NONE | ○ | ◎ | NONE |
| FABRIC 1 | P2 | ACIDIC INK | P2 | FABRIC 3 | P6 | DISPERSE INK | NONE | ○ | ○ | ◎ | NONE | ○ | ○ | NONE |
| FABRIC 1 | P2 | ACIDIC INK | P6 | FABRIC 3 | P6 | DISPERSE INK | NONE | ○ | ○ | △ | NONE | ○ | ○ | NONE |
| FABRIC 1 | P2 | ACIDIC INK | P2 | FABRIC 3 | P7 | DISPERSE INK | NONE | ○ | ○ | ◎ | NONE | △ | ○ | NONE |
| FABRIC 1 | P2 | ACIDIC INK | P7 | FABRIC 3 | P7 | DISPERSE INK | NONE | ○ | ○ | △ | NONE | △ | ○ | NONE |
| FABRIC 1 | P2 | ACIDIC INK | P2 | FABRIC 3 | P8 | DISPERSE INK | NONE | ○ | ○ | ◎ | NONE | △ | ○ | NONE |
| FABRIC 1 | P2 | ACIDIC INK | P8 | FABRIC 3 | P8 | DISPERSE INK | NONE | ○ | ○ | △ | NONE | △ | ○ | NONE |
| FABRIC 1 | P3 | ACIDIC INK | P3 | FABRIC 3 | P5 | DISPERSE INK | NONE | △ | ○ | ○ | NONE | ○ | ◎ | NONE |
| FABRIC 1 | P3 | ACIDIC INK | P1 | FABRIC 3 | P5 | DISPERSE INK | NONE | △ | ○ | △ | NONE | ○ | ◎ | NONE |
| FABRIC 1 | P3 | ACIDIC INK | P3 | FABRIC 3 | P6 | DISPERSE INK | NONE | △ | ○ | ○ | NONE | ○ | ○ | NONE |
| FABRIC 1 | P3 | ACIDIC INK | P2 | FABRIC 3 | P6 | DISPERSE INK | NONE | △ | ○ | △ | NONE | ○ | ○ | NONE |
| FABRIC 1 | P3 | ACIDIC INK | P3 | FABRIC 3 | P7 | DISPERSE INK | NONE | △ | ○ | ○ | NONE | △ | ○ | NONE |
| FABRIC 1 | P3 | ACIDIC INK | P3 | FABRIC 3 | P7 | DISPERSE INK | NONE | △ | ○ | △ | NONE | △ | ○ | NONE |
| FABRIC 1 | P3 | ACIDIC INK | P3 | FABRIC 3 | P8 | DISPERSE INK | NONE | △ | ○ | ○ | NONE | △ | ○ | NONE |
| FABRIC 1 | P3 | ACIDIC INK | P4 | FABRIC 3 | P8 | DISPERSE INK | NONE | △ | ○ | △ | NONE | △ | ○ | NONE |
| FABRIC 1 | P4 | ACIDIC INK | P4 | FABRIC 3 | P5 | DISPERSE INK | NONE | △ | ○ | ◎ | NONE | ○ | ◎ | NONE |
| FABRIC 1 | P4 | ACIDIC INK | P1 | FABRIC 3 | P5 | DISPERSE INK | NONE | △ | ○ | △ | NONE | ○ | ◎ | NONE |
| FABRIC 1 | P4 | ACIDIC INK | P4 | FABRIC 3 | P6 | DISPERSE INK | NONE | △ | ○ | ◎ | NONE | ○ | ○ | NONE |
| FABRIC 1 | P4 | ACIDIC INK | P2 | FABRIC 3 | P6 | DISPERSE INK | NONE | △ | ○ | △ | NONE | ○ | ○ | NONE |
| FABRIC 1 | P4 | ACIDIC INK | P4 | FABRIC 3 | P7 | DISPERSE INK | NONE | △ | ○ | ◎ | NONE | △ | ○ | NONE |
| FABRIC 1 | P4 | ACIDIC INK | P3 | FABRIC 3 | P7 | DISPERSE INK | NONE | △ | ○ | △ | NONE | △ | ○ | NONE |
| FABRIC 1 | P4 | ACIDIC INK | P4 | FABRIC 3 | P8 | DISPERSE INK | NONE | △ | ○ | ◎ | NONE | △ | ○ | NONE |
| FABRIC 1 | P4 | ACIDIC INK | P4 | FABRIC 3 | P8 | DISPERSE INK | NONE | △ | ○ | △ | NONE | △ | ○ | NONE |

Fig. 29

PRINT WITH DISPERSE INK → EJECT PENETRANT LIQUID FROM SECOND NOZZLE → PRINT WITH ACID INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 3 | P5 | DISPERSE INK | P1 | FABRIC 1 | P1 | ACIDIC INK | NONE | ○ | ◎ | △ | NONE | ○ | ◎ | NONE |
| FABRIC 3 | P5 | DISPERSE INK | P5 | FABRIC 1 | P1 | ACIDIC INK | NONE | ○ | ◎ | ○ | NONE | ○ | ◎ | NONE |
| FABRIC 3 | P6 | DISPERSE INK | P1 | FABRIC 1 | P1 | ACIDIC INK | NONE | ○ | ○ | △ | NONE | ○ | ◎ | NONE |
| FABRIC 3 | P6 | DISPERSE INK | P6 | FABRIC 1 | P1 | ACIDIC INK | NONE | ○ | ○ | ◎ | NONE | ○ | ◎ | NONE |
| FABRIC 3 | P7 | DISPERSE INK | P1 | FABRIC 1 | P1 | ACIDIC INK | NONE | △ | ○ | △ | NONE | ○ | ◎ | NONE |
| FABRIC 3 | P7 | DISPERSE INK | P7 | FABRIC 1 | P1 | ACIDIC INK | NONE | △ | ○ | ○ | NONE | ○ | ◎ | NONE |
| FABRIC 3 | P8 | DISPERSE INK | P1 | FABRIC 1 | P1 | ACIDIC INK | NONE | △ | ○ | △ | NONE | ○ | ◎ | NONE |
| FABRIC 3 | P8 | DISPERSE INK | P8 | FABRIC 1 | P1 | ACIDIC INK | NONE | △ | ○ | ◎ | NONE | ○ | ◎ | NONE |
| FABRIC 3 | P5 | DISPERSE INK | P2 | FABRIC 1 | P2 | ACIDIC INK | NONE | ○ | ◎ | △ | NONE | ○ | ○ | NONE |
| FABRIC 3 | P5 | DISPERSE INK | P5 | FABRIC 1 | P2 | ACIDIC INK | NONE | ○ | ◎ | ○ | NONE | ○ | ○ | NONE |
| FABRIC 3 | P6 | DISPERSE INK | P2 | FABRIC 1 | P2 | ACIDIC INK | NONE | ○ | ○ | △ | NONE | ○ | ○ | NONE |
| FABRIC 3 | P6 | DISPERSE INK | P6 | FABRIC 1 | P2 | ACIDIC INK | NONE | ○ | ○ | ◎ | NONE | ○ | ○ | NONE |
| FABRIC 3 | P7 | DISPERSE INK | P2 | FABRIC 1 | P2 | ACIDIC INK | NONE | △ | ○ | △ | NONE | ○ | ○ | NONE |
| FABRIC 3 | P7 | DISPERSE INK | P7 | FABRIC 1 | P2 | ACIDIC INK | NONE | △ | ○ | ○ | NONE | ○ | ○ | NONE |
| FABRIC 3 | P8 | DISPERSE INK | P2 | FABRIC 1 | P2 | ACIDIC INK | NONE | △ | ○ | △ | NONE | ○ | ○ | NONE |
| FABRIC 3 | P8 | DISPERSE INK | P8 | FABRIC 1 | P2 | ACIDIC INK | NONE | △ | ○ | ◎ | NONE | ○ | ○ | NONE |
| FABRIC 3 | P5 | DISPERSE INK | P3 | FABRIC 1 | P3 | ACIDIC INK | NONE | ○ | ◎ | △ | NONE | △ | ○ | NONE |
| FABRIC 3 | P5 | DISPERSE INK | P1 | FABRIC 1 | P3 | ACIDIC INK | NONE | ○ | ◎ | ○ | NONE | △ | ○ | NONE |
| FABRIC 3 | P6 | DISPERSE INK | P3 | FABRIC 1 | P3 | ACIDIC INK | NONE | ○ | ○ | △ | NONE | △ | ○ | NONE |
| FABRIC 3 | P6 | DISPERSE INK | P2 | FABRIC 1 | P3 | ACIDIC INK | NONE | ○ | ○ | ◎ | NONE | △ | ○ | NONE |
| FABRIC 3 | P7 | DISPERSE INK | P3 | FABRIC 1 | P3 | ACIDIC INK | NONE | △ | ○ | △ | NONE | △ | ○ | NONE |
| FABRIC 3 | P7 | DISPERSE INK | P3 | FABRIC 1 | P3 | ACIDIC INK | NONE | △ | ○ | ○ | NONE | △ | ○ | NONE |
| FABRIC 3 | P8 | DISPERSE INK | P3 | FABRIC 1 | P3 | ACIDIC INK | NONE | △ | ○ | △ | NONE | △ | ○ | NONE |
| FABRIC 3 | P8 | DISPERSE INK | P4 | FABRIC 1 | P3 | ACIDIC INK | NONE | △ | ○ | ◎ | NONE | △ | ○ | NONE |
| FABRIC 3 | P5 | DISPERSE INK | P4 | FABRIC 1 | P4 | ACIDIC INK | NONE | ○ | ◎ | △ | NONE | △ | ○ | NONE |
| FABRIC 3 | P5 | DISPERSE INK | P1 | FABRIC 1 | P4 | ACIDIC INK | NONE | ○ | ◎ | ○ | NONE | △ | ○ | NONE |
| FABRIC 3 | P6 | DISPERSE INK | P4 | FABRIC 1 | P4 | ACIDIC INK | NONE | ○ | ○ | △ | NONE | △ | ○ | NONE |
| FABRIC 3 | P6 | DISPERSE INK | P2 | FABRIC 1 | P4 | ACIDIC INK | NONE | ○ | ○ | ◎ | NONE | △ | ○ | NONE |
| FABRIC 3 | P7 | DISPERSE INK | P4 | FABRIC 1 | P4 | ACIDIC INK | NONE | △ | ○ | △ | NONE | △ | ○ | NONE |
| FABRIC 3 | P7 | DISPERSE INK | P3 | FABRIC 1 | P4 | ACIDIC INK | NONE | △ | ○ | ○ | NONE | △ | ○ | NONE |
| FABRIC 3 | P8 | DISPERSE INK | P4 | FABRIC 1 | P4 | ACIDIC INK | NONE | △ | ○ | △ | NONE | △ | ○ | NONE |
| FABRIC 3 | P8 | DISPERSE INK | P4 | FABRIC 1 | P4 | ACIDIC INK | NONE | △ | ○ | ◎ | NONE | △ | ○ | NONE |

Fig. 30

PRINT WITH ACIDIC INK → EJECT PENETRANT LIQUID FROM SECOND NOZZLE → PRINT WITH PIGMENT INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 1 | P1 | ACIDIC INK | P1 | FABRIC 4 | P7 | PIGMENT INK | NONE | ○ | ◎ | ○ | NONE | △ | ◎ | NONE |
| FABRIC 1 | P1 | ACIDIC INK | P7 | FABRIC 4 | P7 | PIGMENT INK | NONE | ○ | ◎ | △ | NONE | △ | ◎ | NONE |
| FABRIC 1 | P1 | ACIDIC INK | P1 | FABRIC 4 | P8 | PIGMENT INK | NONE | ○ | ◎ | ○ | NONE | △ | ○ | NONE |
| FABRIC 1 | P1 | ACIDIC INK | P8 | FABRIC 4 | P8 | PIGMENT INK | NONE | ○ | ◎ | △ | NONE | △ | ○ | NONE |
| FABRIC 1 | P2 | ACIDIC INK | P2 | FABRIC 4 | P7 | PIGMENT INK | NONE | ○ | ○ | ◎ | NONE | △ | ◎ | NONE |
| FABRIC 1 | P2 | ACIDIC INK | P7 | FABRIC 4 | P7 | PIGMENT INK | NONE | ○ | ○ | △ | NONE | △ | ◎ | NONE |
| FABRIC 1 | P2 | ACIDIC INK | P2 | FABRIC 4 | P8 | PIGMENT INK | NONE | ○ | ○ | ◎ | NONE | △ | ○ | NONE |
| FABRIC 1 | P2 | ACIDIC INK | P8 | FABRIC 4 | P8 | PIGMENT INK | NONE | ○ | ○ | △ | NONE | △ | ○ | NONE |
| FABRIC 1 | P3 | ACIDIC INK | P3 | FABRIC 4 | P7 | PIGMENT INK | NONE | △ | ○ | ○ | NONE | △ | ◎ | NONE |
| FABRIC 1 | P3 | ACIDIC INK | P7 | FABRIC 4 | P7 | PIGMENT INK | NONE | △ | ○ | △ | NONE | △ | ◎ | NONE |
| FABRIC 1 | P3 | ACIDIC INK | P3 | FABRIC 4 | P8 | PIGMENT INK | NONE | △ | ○ | ○ | NONE | △ | ○ | NONE |
| FABRIC 1 | P3 | ACIDIC INK | P8 | FABRIC 4 | P8 | PIGMENT INK | NONE | △ | ○ | △ | NONE | △ | ○ | NONE |
| FABRIC 1 | P4 | ACIDIC INK | P4 | FABRIC 4 | P7 | PIGMENT INK | NONE | △ | ○ | ◎ | NONE | △ | ◎ | NONE |
| FABRIC 1 | P4 | ACIDIC INK | P7 | FABRIC 4 | P7 | PIGMENT INK | NONE | △ | ○ | △ | NONE | △ | ◎ | NONE |
| FABRIC 1 | P4 | ACIDIC INK | P4 | FABRIC 4 | P8 | PIGMENT INK | NONE | △ | ○ | ◎ | NONE | △ | ○ | NONE |
| FABRIC 1 | P4 | ACIDIC INK | P8 | FABRIC 4 | P8 | PIGMENT INK | NONE | △ | ○ | △ | NONE | △ | ○ | NONE |

Fig. 31

PRINT WITH PIGMENT INK → EJECT PENETRANT LIQUID FROM SECOND NOZZLE → PRINT WITH ACID INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 4 | P7 | PIGMENT INK | P1 | FABRIC 1 | P1 | ACIDIC INK | NONE | △ | ◎ | △ | NONE | ○ | ◎ | NONE |
| FABRIC 4 | P7 | PIGMENT INK | P7 | FABRIC 1 | P1 | ACIDIC INK | NONE | △ | ◎ | ○ | NONE | ○ | ◎ | NONE |
| FABRIC 4 | P8 | PIGMENT INK | P1 | FABRIC 1 | P1 | ACIDIC INK | NONE | △ | ○ | △ | NONE | ○ | ◎ | NONE |
| FABRIC 4 | P8 | PIGMENT INK | P8 | FABRIC 1 | P1 | ACIDIC INK | NONE | △ | ○ | ◎ | NONE | ○ | ◎ | NONE |
| FABRIC 4 | P7 | PIGMENT INK | P2 | FABRIC 1 | P2 | ACIDIC INK | NONE | △ | ◎ | △ | NONE | ○ | ○ | NONE |
| FABRIC 4 | P7 | PIGMENT INK | P7 | FABRIC 1 | P2 | ACIDIC INK | NONE | △ | ◎ | △ | NONE | ○ | ○ | NONE |
| FABRIC 4 | P8 | PIGMENT INK | P2 | FABRIC 1 | P2 | ACIDIC INK | NONE | △ | ○ | △ | NONE | ○ | ○ | NONE |
| FABRIC 4 | P8 | PIGMENT INK | P8 | FABRIC 1 | P2 | ACIDIC INK | NONE | △ | ○ | △ | NONE | ○ | ○ | NONE |
| FABRIC 4 | P7 | PIGMENT INK | P3 | FABRIC 1 | P3 | ACIDIC INK | NONE | △ | ◎ | △ | NONE | △ | ○ | NONE |
| FABRIC 4 | P7 | PIGMENT INK | P7 | FABRIC 1 | P3 | ACIDIC INK | NONE | △ | ◎ | ○ | NONE | △ | ○ | NONE |
| FABRIC 4 | P8 | PIGMENT INK | P3 | FABRIC 1 | P3 | ACIDIC INK | NONE | △ | ○ | △ | NONE | △ | ○ | NONE |
| FABRIC 4 | P8 | PIGMENT INK | P8 | FABRIC 1 | P3 | ACIDIC INK | NONE | △ | ○ | ◎ | NONE | △ | ○ | NONE |
| FABRIC 4 | P7 | PIGMENT INK | P4 | FABRIC 1 | P4 | ACIDIC INK | NONE | △ | ◎ | △ | NONE | △ | ○ | NONE |
| FABRIC 4 | P7 | PIGMENT INK | P7 | FABRIC 1 | P4 | ACIDIC INK | NONE | △ | ◎ | ○ | NONE | △ | ○ | NONE |
| FABRIC 4 | P8 | PIGMENT INK | P4 | FABRIC 1 | P4 | ACIDIC INK | NONE | △ | ○ | △ | NONE | △ | ○ | NONE |
| FABRIC 4 | P8 | PIGMENT INK | P8 | FABRIC 1 | P4 | ACIDIC INK | NONE | △ | ○ | ◎ | NONE | △ | ○ | NONE |

Fig. 32

PRINT WITH REACTIVE INK → EJECT PENETRANT LIQUID FROM SECOND NOZZLE → PRINT WITH DISPERSE INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 2 | P1 | REACTIVE INK | P1 | FABRIC 3 | P5 | DISPERSE INK | NONE | △ | ○ | ○ | NONE | ○ | ◎ | NONE |
| FABRIC 2 | P1 | REACTIVE INK | P5 | FABRIC 3 | P5 | DISPERSE INK | NONE | △ | ○ | △ | NONE | ○ | ◎ | NONE |
| FABRIC 2 | P1 | REACTIVE INK | P1 | FABRIC 3 | P6 | DISPERSE INK | NONE | △ | ○ | ○ | NONE | ○ | ○ | NONE |
| FABRIC 2 | P1 | REACTIVE INK | P6 | FABRIC 3 | P6 | DISPERSE INK | NONE | △ | ○ | △ | NONE | ○ | ○ | NONE |
| FABRIC 2 | P1 | REACTIVE INK | P1 | FABRIC 3 | P7 | DISPERSE INK | NONE | △ | ○ | ○ | NONE | △ | ○ | NONE |
| FABRIC 2 | P1 | REACTIVE INK | P7 | FABRIC 3 | P7 | DISPERSE INK | NONE | △ | ○ | △ | NONE | △ | ○ | NONE |
| FABRIC 2 | P1 | REACTIVE INK | P1 | FABRIC 3 | P8 | DISPERSE INK | NONE | △ | ○ | ○ | NONE | △ | ○ | NONE |
| FABRIC 2 | P1 | REACTIVE INK | P8 | FABRIC 3 | P8 | DISPERSE INK | NONE | △ | ○ | △ | NONE | △ | ○ | NONE |
| FABRIC 2 | P2 | REACTIVE INK | P2 | FABRIC 3 | P5 | DISPERSE INK | NONE | △ | ○ | ◎ | NONE | ○ | ◎ | NONE |
| FABRIC 2 | P2 | REACTIVE INK | P5 | FABRIC 3 | P5 | DISPERSE INK | NONE | △ | ○ | △ | NONE | ○ | ◎ | NONE |
| FABRIC 2 | P2 | REACTIVE INK | P2 | FABRIC 3 | P6 | DISPERSE INK | NONE | △ | ○ | ◎ | NONE | ○ | ○ | NONE |
| FABRIC 2 | P2 | REACTIVE INK | P6 | FABRIC 3 | P6 | DISPERSE INK | NONE | △ | ○ | △ | NONE | ○ | ○ | NONE |
| FABRIC 2 | P2 | REACTIVE INK | P2 | FABRIC 3 | P7 | DISPERSE INK | NONE | △ | ○ | ◎ | NONE | △ | ○ | NONE |
| FABRIC 2 | P2 | REACTIVE INK | P7 | FABRIC 3 | P7 | DISPERSE INK | NONE | △ | ○ | △ | NONE | △ | ○ | NONE |
| FABRIC 2 | P2 | REACTIVE INK | P2 | FABRIC 3 | P8 | DISPERSE INK | NONE | △ | ○ | ◎ | NONE | △ | ○ | NONE |
| FABRIC 2 | P2 | REACTIVE INK | P8 | FABRIC 3 | P8 | DISPERSE INK | NONE | △ | ○ | △ | NONE | △ | ○ | NONE |
| FABRIC 2 | P3 | REACTIVE INK | P3 | FABRIC 3 | P5 | DISPERSE INK | NONE | ○ | ◎ | ○ | NONE | ○ | ◎ | NONE |
| FABRIC 2 | P3 | REACTIVE INK | P1 | FABRIC 3 | P5 | DISPERSE INK | NONE | ○ | ◎ | △ | NONE | ○ | ◎ | NONE |
| FABRIC 2 | P3 | REACTIVE INK | P3 | FABRIC 3 | P6 | DISPERSE INK | NONE | ○ | ◎ | ○ | NONE | ○ | ○ | NONE |
| FABRIC 2 | P3 | REACTIVE INK | P2 | FABRIC 3 | P6 | DISPERSE INK | NONE | ○ | ◎ | △ | NONE | ○ | ○ | NONE |
| FABRIC 2 | P3 | REACTIVE INK | P3 | FABRIC 3 | P7 | DISPERSE INK | NONE | ○ | ◎ | ○ | NONE | △ | ○ | NONE |
| FABRIC 2 | P3 | REACTIVE INK | P3 | FABRIC 3 | P7 | DISPERSE INK | NONE | ○ | ◎ | △ | NONE | △ | ○ | NONE |
| FABRIC 2 | P3 | REACTIVE INK | P3 | FABRIC 3 | P8 | DISPERSE INK | NONE | ○ | ◎ | ○ | NONE | △ | ○ | NONE |
| FABRIC 2 | P3 | REACTIVE INK | P4 | FABRIC 3 | P8 | DISPERSE INK | NONE | ○ | ◎ | △ | NONE | △ | ○ | NONE |
| FABRIC 2 | P4 | REACTIVE INK | P4 | FABRIC 3 | P5 | DISPERSE INK | NONE | ○ | ○ | ◎ | NONE | ○ | ◎ | NONE |
| FABRIC 2 | P4 | REACTIVE INK | P1 | FABRIC 3 | P5 | DISPERSE INK | NONE | ○ | ○ | △ | NONE | ○ | ◎ | NONE |
| FABRIC 2 | P4 | REACTIVE INK | P4 | FABRIC 3 | P6 | DISPERSE INK | NONE | ○ | ○ | ◎ | NONE | ○ | ○ | NONE |
| FABRIC 2 | P4 | REACTIVE INK | P2 | FABRIC 3 | P6 | DISPERSE INK | NONE | ○ | ○ | △ | NONE | ○ | ○ | NONE |
| FABRIC 2 | P4 | REACTIVE INK | P4 | FABRIC 3 | P7 | DISPERSE INK | NONE | ○ | ○ | ◎ | NONE | △ | ○ | NONE |
| FABRIC 2 | P4 | REACTIVE INK | P3 | FABRIC 3 | P7 | DISPERSE INK | NONE | ○ | ○ | △ | NONE | △ | ○ | NONE |
| FABRIC 2 | P4 | REACTIVE INK | P4 | FABRIC 3 | P8 | DISPERSE INK | NONE | ○ | ○ | ◎ | NONE | △ | ○ | NONE |
| FABRIC 2 | P4 | REACTIVE INK | P4 | FABRIC 3 | P8 | DISPERSE INK | NONE | ○ | ○ | △ | NONE | △ | ○ | NONE |

Fig. 33

PRINT WITH DISPERSE INK → EJECT PENETRANT LIQUID FROM SECOND NOZZLE → PRINT WITH REACTIVE INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 3 | P5 | DISPERSE INK | P1 | FABRIC 2 | P1 | REACTIVE INK | NONE | ○ | ◎ | △ | NONE | △ | ○ | NONE |
| FABRIC 3 | P5 | DISPERSE INK | P5 | FABRIC 2 | P1 | REACTIVE INK | NONE | ○ | ◎ | ○ | NONE | △ | ○ | NONE |
| FABRIC 3 | P6 | DISPERSE INK | P1 | FABRIC 2 | P1 | REACTIVE INK | NONE | ○ | ○ | △ | NONE | △ | ○ | NONE |
| FABRIC 3 | P6 | DISPERSE INK | P6 | FABRIC 2 | P1 | REACTIVE INK | NONE | ○ | ○ | ◎ | NONE | △ | ○ | NONE |
| FABRIC 3 | P7 | DISPERSE INK | P1 | FABRIC 2 | P1 | REACTIVE INK | NONE | △ | ○ | △ | NONE | △ | ○ | NONE |
| FABRIC 3 | P7 | DISPERSE INK | P7 | FABRIC 2 | P1 | REACTIVE INK | NONE | △ | ○ | ○ | NONE | △ | ○ | NONE |
| FABRIC 3 | P8 | DISPERSE INK | P1 | FABRIC 2 | P1 | REACTIVE INK | NONE | △ | ○ | △ | NONE | △ | ○ | NONE |
| FABRIC 3 | P8 | DISPERSE INK | P8 | FABRIC 2 | P1 | REACTIVE INK | NONE | △ | ○ | ◎ | NONE | △ | ○ | NONE |
| FABRIC 3 | P5 | DISPERSE INK | P2 | FABRIC 2 | P2 | REACTIVE INK | NONE | ○ | ◎ | △ | NONE | △ | ○ | NONE |
| FABRIC 3 | P5 | DISPERSE INK | P5 | FABRIC 2 | P2 | REACTIVE INK | NONE | ○ | ◎ | ○ | NONE | △ | ○ | NONE |
| FABRIC 3 | P6 | DISPERSE INK | P2 | FABRIC 2 | P2 | REACTIVE INK | NONE | ○ | ○ | △ | NONE | △ | ○ | NONE |
| FABRIC 3 | P6 | DISPERSE INK | P6 | FABRIC 2 | P2 | REACTIVE INK | NONE | ○ | ○ | ◎ | NONE | △ | ○ | NONE |
| FABRIC 3 | P7 | DISPERSE INK | P2 | FABRIC 2 | P2 | REACTIVE INK | NONE | △ | ○ | △ | NONE | △ | ○ | NONE |
| FABRIC 3 | P7 | DISPERSE INK | P7 | FABRIC 2 | P2 | REACTIVE INK | NONE | △ | ○ | ○ | NONE | △ | ○ | NONE |
| FABRIC 3 | P8 | DISPERSE INK | P2 | FABRIC 2 | P2 | REACTIVE INK | NONE | △ | ○ | △ | NONE | △ | ○ | NONE |
| FABRIC 3 | P8 | DISPERSE INK | P8 | FABRIC 2 | P2 | REACTIVE INK | NONE | △ | ○ | ◎ | NONE | △ | ○ | NONE |
| FABRIC 3 | P5 | DISPERSE INK | P3 | FABRIC 2 | P3 | REACTIVE INK | NONE | ○ | ◎ | △ | NONE | ○ | ◎ | NONE |
| FABRIC 3 | P5 | DISPERSE INK | P1 | FABRIC 2 | P3 | REACTIVE INK | NONE | ○ | ◎ | ○ | NONE | ○ | ◎ | NONE |
| FABRIC 3 | P6 | DISPERSE INK | P3 | FABRIC 2 | P3 | REACTIVE INK | NONE | ○ | ○ | △ | NONE | ○ | ◎ | NONE |
| FABRIC 3 | P6 | DISPERSE INK | P2 | FABRIC 2 | P3 | REACTIVE INK | NONE | ○ | ○ | ◎ | NONE | ○ | ◎ | NONE |
| FABRIC 3 | P7 | DISPERSE INK | P3 | FABRIC 2 | P3 | REACTIVE INK | NONE | △ | ○ | △ | NONE | ○ | ◎ | NONE |
| FABRIC 3 | P7 | DISPERSE INK | P3 | FABRIC 2 | P3 | REACTIVE INK | NONE | △ | ○ | ○ | NONE | ○ | ◎ | NONE |
| FABRIC 3 | P8 | DISPERSE INK | P3 | FABRIC 2 | P3 | REACTIVE INK | NONE | △ | ○ | △ | NONE | ○ | ◎ | NONE |
| FABRIC 3 | P8 | DISPERSE INK | P4 | FABRIC 2 | P3 | REACTIVE INK | NONE | △ | ○ | ◎ | NONE | ○ | ◎ | NONE |
| FABRIC 3 | P5 | DISPERSE INK | P4 | FABRIC 2 | P4 | REACTIVE INK | NONE | ○ | ◎ | △ | NONE | ○ | ○ | NONE |
| FABRIC 3 | P5 | DISPERSE INK | P1 | FABRIC 2 | P4 | REACTIVE INK | NONE | ○ | ◎ | ○ | NONE | ○ | ○ | NONE |
| FABRIC 3 | P6 | DISPERSE INK | P4 | FABRIC 2 | P4 | REACTIVE INK | NONE | ○ | ○ | △ | NONE | ○ | ○ | NONE |
| FABRIC 3 | P6 | DISPERSE INK | P2 | FABRIC 2 | P4 | REACTIVE INK | NONE | ○ | ○ | ◎ | NONE | ○ | ○ | NONE |
| FABRIC 3 | P7 | DISPERSE INK | P4 | FABRIC 2 | P4 | REACTIVE INK | NONE | △ | ○ | △ | NONE | ○ | ○ | NONE |
| FABRIC 3 | P7 | DISPERSE INK | P3 | FABRIC 2 | P4 | REACTIVE INK | NONE | △ | ○ | ○ | NONE | ○ | ○ | NONE |
| FABRIC 3 | P8 | DISPERSE INK | P4 | FABRIC 2 | P4 | REACTIVE INK | NONE | △ | ○ | △ | NONE | ○ | ○ | NONE |
| FABRIC 3 | P8 | DISPERSE INK | P4 | FABRIC 2 | P4 | REACTIVE INK | NONE | △ | ○ | ◎ | NONE | ○ | ○ | NONE |

Fig. 34

PRINT WITH REACTIVE INK → EJECT PENETRANT LIQUID FROM SECOND NOZZLE → PRINT WITH PIGMENT INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 2 | P1 | REACTIVE INK | P1 | FABRIC 4 | P7 | PIGMENT INK | NONE | △ | ○ | ○ | NONE | △ | ◎ | NONE |
| FABRIC 2 | P1 | REACTIVE INK | P7 | FABRIC 4 | P7 | PIGMENT INK | NONE | △ | ○ | △ | NONE | △ | ◎ | NONE |
| FABRIC 2 | P1 | REACTIVE INK | P1 | FABRIC 4 | P8 | PIGMENT INK | NONE | △ | ○ | ○ | NONE | △ | ○ | NONE |
| FABRIC 2 | P1 | REACTIVE INK | P8 | FABRIC 4 | P8 | PIGMENT INK | NONE | △ | ○ | △ | NONE | △ | ○ | NONE |
| FABRIC 2 | P2 | REACTIVE INK | P2 | FABRIC 4 | P7 | PIGMENT INK | NONE | △ | ○ | ◎ | NONE | △ | ◎ | NONE |
| FABRIC 2 | P2 | REACTIVE INK | P7 | FABRIC 4 | P7 | PIGMENT INK | NONE | △ | ○ | △ | NONE | △ | ◎ | NONE |
| FABRIC 2 | P2 | REACTIVE INK | P2 | FABRIC 4 | P8 | PIGMENT INK | NONE | △ | ○ | ◎ | NONE | △ | ○ | NONE |
| FABRIC 2 | P2 | REACTIVE INK | P8 | FABRIC 4 | P8 | PIGMENT INK | NONE | △ | ○ | △ | NONE | △ | ○ | NONE |
| FABRIC 2 | P3 | REACTIVE INK | P3 | FABRIC 4 | P7 | PIGMENT INK | NONE | ○ | ◎ | ○ | NONE | △ | ◎ | NONE |
| FABRIC 2 | P3 | REACTIVE INK | P7 | FABRIC 4 | P7 | PIGMENT INK | NONE | ○ | ◎ | △ | NONE | △ | ◎ | NONE |
| FABRIC 2 | P3 | REACTIVE INK | P3 | FABRIC 4 | P8 | PIGMENT INK | NONE | ○ | ◎ | ○ | NONE | △ | ○ | NONE |
| FABRIC 2 | P3 | REACTIVE INK | P8 | FABRIC 4 | P8 | PIGMENT INK | NONE | ○ | ◎ | △ | NONE | △ | ○ | NONE |
| FABRIC 2 | P4 | REACTIVE INK | P4 | FABRIC 4 | P7 | PIGMENT INK | NONE | ○ | ○ | ◎ | NONE | △ | ◎ | NONE |
| FABRIC 2 | P4 | REACTIVE INK | P7 | FABRIC 4 | P7 | PIGMENT INK | NONE | ○ | ○ | △ | NONE | △ | ◎ | NONE |
| FABRIC 2 | P4 | REACTIVE INK | P4 | FABRIC 4 | P8 | PIGMENT INK | NONE | ○ | ○ | ◎ | NONE | △ | ○ | NONE |
| FABRIC 2 | P4 | REACTIVE INK | P8 | FABRIC 4 | P8 | PIGMENT INK | NONE | ○ | ○ | △ | NONE | △ | ○ | NONE |

Fig. 35

PRINT WITH PIGMENT INK → EJECT PENETRANT LIQUID FROM SECOND NOZZLE → PRINT WITH REACTIVE INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 4 | P7 | PIGMENT INK | P1 | FABRIC 2 | P1 | REACTIVE INK | NONE | △ | ◎ | △ | NONE | △ | ○ | NONE |
| FABRIC 4 | P7 | PIGMENT INK | P7 | FABRIC 2 | P1 | REACTIVE INK | NONE | △ | ◎ | ○ | NONE | △ | ○ | NONE |
| FABRIC 4 | P8 | PIGMENT INK | P1 | FABRIC 2 | P1 | REACTIVE INK | NONE | △ | ○ | △ | NONE | △ | ○ | NONE |
| FABRIC 4 | P8 | PIGMENT INK | P8 | FABRIC 2 | P1 | REACTIVE INK | NONE | △ | ○ | ◎ | NONE | △ | ○ | NONE |
| FABRIC 4 | P7 | PIGMENT INK | P2 | FABRIC 2 | P2 | REACTIVE INK | NONE | △ | ◎ | △ | NONE | △ | ○ | NONE |
| FABRIC 4 | P7 | PIGMENT INK | P7 | FABRIC 2 | P2 | REACTIVE INK | NONE | △ | ◎ | ○ | NONE | △ | ○ | NONE |
| FABRIC 4 | P8 | PIGMENT INK | P2 | FABRIC 2 | P2 | REACTIVE INK | NONE | △ | ○ | △ | NONE | △ | ○ | NONE |
| FABRIC 4 | P8 | PIGMENT INK | P8 | FABRIC 2 | P2 | REACTIVE INK | NONE | △ | ○ | ◎ | NONE | △ | ○ | NONE |
| FABRIC 4 | P7 | PIGMENT INK | P3 | FABRIC 2 | P3 | REACTIVE INK | NONE | △ | ◎ | △ | NONE | ○ | ◎ | NONE |
| FABRIC 4 | P7 | PIGMENT INK | P7 | FABRIC 2 | P3 | REACTIVE INK | NONE | △ | ◎ | ○ | NONE | ○ | ◎ | NONE |
| FABRIC 4 | P8 | PIGMENT INK | P3 | FABRIC 2 | P3 | REACTIVE INK | NONE | △ | ○ | △ | NONE | ○ | ◎ | NONE |
| FABRIC 4 | P8 | PIGMENT INK | P8 | FABRIC 2 | P3 | REACTIVE INK | NONE | △ | ○ | ◎ | NONE | ○ | ◎ | NONE |
| FABRIC 4 | P7 | PIGMENT INK | P4 | FABRIC 2 | P4 | REACTIVE INK | NONE | △ | ◎ | △ | NONE | ○ | ○ | NONE |
| FABRIC 4 | P7 | PIGMENT INK | P7 | FABRIC 2 | P4 | REACTIVE INK | NONE | △ | ◎ | ○ | NONE | ○ | ○ | NONE |
| FABRIC 4 | P8 | PIGMENT INK | P4 | FABRIC 2 | P4 | REACTIVE INK | NONE | △ | ○ | △ | NONE | ○ | ○ | NONE |
| FABRIC 4 | P8 | PIGMENT INK | P8 | FABRIC 2 | P4 | REACTIVE INK | NONE | △ | ○ | ◎ | NONE | ○ | ○ | NONE |

Fig. 36

PRINT WITH DISPERSE INK → EJECT PENETRANT LIQUID FROM SECOND NOZZLE → PRINT WITH PIGMENT INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 3 | P5 | DISPERSE INK | P1 | FABRIC 4 | P7 | PIGMENT INK | NONE | ○ | ◎ | △ | NONE | △ | ◎ | NONE |
| FABRIC 3 | P5 | DISPERSE INK | P7 | FABRIC 4 | P7 | PIGMENT INK | NONE | ○ | ◎ | △ | NONE | △ | ◎ | NONE |
| FABRIC 3 | P5 | DISPERSE INK | P1 | FABRIC 4 | P8 | PIGMENT INK | NONE | ○ | ◎ | △ | NONE | △ | ○ | NONE |
| FABRIC 3 | P5 | DISPERSE INK | P8 | FABRIC 4 | P8 | PIGMENT INK | NONE | ○ | ◎ | △ | NONE | △ | ○ | NONE |
| FABRIC 3 | P6 | DISPERSE INK | P2 | FABRIC 4 | P7 | PIGMENT INK | NONE | ○ | ○ | △ | NONE | △ | ◎ | NONE |
| FABRIC 3 | P6 | DISPERSE INK | P7 | FABRIC 4 | P7 | PIGMENT INK | NONE | ○ | ○ | △ | NONE | △ | ◎ | NONE |
| FABRIC 3 | P6 | DISPERSE INK | P2 | FABRIC 4 | P8 | PIGMENT INK | NONE | ○ | ○ | △ | NONE | △ | ○ | NONE |
| FABRIC 3 | P6 | DISPERSE INK | P8 | FABRIC 4 | P8 | PIGMENT INK | NONE | ○ | ○ | △ | NONE | △ | ○ | NONE |
| FABRIC 3 | P7 | DISPERSE INK | P3 | FABRIC 4 | P7 | PIGMENT INK | NONE | △ | ○ | △ | NONE | △ | ◎ | NONE |
| FABRIC 3 | P7 | DISPERSE INK | P7 | FABRIC 4 | P7 | PIGMENT INK | NONE | △ | ○ | ○ | NONE | △ | ◎ | NONE |
| FABRIC 3 | P7 | DISPERSE INK | P3 | FABRIC 4 | P8 | PIGMENT INK | NONE | △ | ○ | △ | NONE | △ | ○ | NONE |
| FABRIC 3 | P7 | DISPERSE INK | P8 | FABRIC 4 | P8 | PIGMENT INK | NONE | △ | ○ | ◎ | NONE | △ | ○ | NONE |
| FABRIC 3 | P8 | DISPERSE INK | P4 | FABRIC 4 | P7 | PIGMENT INK | NONE | △ | ○ | △ | NONE | △ | ◎ | NONE |
| FABRIC 3 | P8 | DISPERSE INK | P7 | FABRIC 4 | P7 | PIGMENT INK | NONE | △ | ○ | ○ | NONE | △ | ◎ | NONE |
| FABRIC 3 | P8 | DISPERSE INK | P4 | FABRIC 4 | P8 | PIGMENT INK | NONE | △ | ○ | △ | NONE | △ | ○ | NONE |
| FABRIC 3 | P8 | DISPERSE INK | P8 | FABRIC 4 | P8 | PIGMENT INK | NONE | △ | ○ | ◎ | NONE | △ | ○ | NONE |

Fig. 37

PRINT WITH PIGMENT INK → EJECT PENETRANT LIQUID FROM SECOND NOZZLE → PRINT WITH DISPERSE INK

| PROCEDURE | | | | | | | RESULT | | | | | | | |
|---|---|---|---|---|---|---|---|---|---|---|---|---|---|---|
| PRINTING A | | | EJECTION OF PENETRANT LIQUID DURING PRINTING | PRINTING B | | | PRINTING A | | | EJECTION OF PENETRANT LIQUID DURING PRINTING | PRINTING B | | | |
| SET FABRIC | EJECT PENETRANT LIQUID FROM FIRST NOZZLE | EJECT TEXTILE PRINTING COLORED LIQUID FROM SECOND NOZZLE | EJECT PENETRANT LIQUID FROM SECOND NOZZLE | SET FABRIC | EJECT PENETRANT LIQUID FROM FIRST NOZZLE | EJECT TEXTILE PRINTING COLORED LIQUID FROM SECOND NOZZLE | CLOGGING OF SECOND NOZZLE | DENSITY DIFFERENCE | BLEEDING | CLEANING OF SECOND NOZZLE | CLOGGING OF SECOND NOZZLE | DENSITY DIFFERENCE | BLEEDING | INK COLOR MIXING |
| FABRIC | PENETRANT LIQUID | TEXTILE PRINTING COLORED LIQUID | PENETRANT LIQUID | FABRIC | PENETRANT LIQUID | TEXTILE PRINTING COLORED LIQUID | | | | | | | | |
| FABRIC 4 | P7 | PIGMENT INK | P1 | FABRIC 3 | P5 | DISPERSE INK | NONE | △ | ◎ | △ | NONE | ○ | ◎ | NONE |
| FABRIC 4 | P7 | PIGMENT INK | P7 | FABRIC 3 | P5 | DISPERSE INK | NONE | △ | ◎ | ○ | NONE | ○ | ◎ | NONE |
| FABRIC 4 | P8 | PIGMENT INK | P1 | FABRIC 3 | P5 | DISPERSE INK | NONE | △ | ○ | △ | NONE | ○ | ◎ | NONE |
| FABRIC 4 | P8 | PIGMENT INK | P8 | FABRIC 3 | P5 | DISPERSE INK | NONE | △ | ○ | ◎ | NONE | ○ | ◎ | NONE |
| FABRIC 4 | P7 | PIGMENT INK | P2 | FABRIC 3 | P6 | DISPERSE INK | NONE | △ | ◎ | △ | NONE | ○ | ○ | NONE |
| FABRIC 4 | P7 | PIGMENT INK | P7 | FABRIC 3 | P6 | DISPERSE INK | NONE | △ | ◎ | ○ | NONE | ○ | ○ | NONE |
| FABRIC 4 | P8 | PIGMENT INK | P2 | FABRIC 3 | P6 | DISPERSE INK | NONE | △ | ○ | △ | NONE | ○ | ○ | NONE |
| FABRIC 4 | P8 | PIGMENT INK | P8 | FABRIC 3 | P6 | DISPERSE INK | NONE | △ | ○ | ◎ | NONE | ○ | ○ | NONE |
| FABRIC 4 | P7 | PIGMENT INK | P3 | FABRIC 3 | P7 | DISPERSE INK | NONE | △ | ◎ | △ | NONE | △ | ○ | NONE |
| FABRIC 4 | P7 | PIGMENT INK | P7 | FABRIC 3 | P7 | DISPERSE INK | NONE | △ | ◎ | ○ | NONE | △ | ○ | NONE |
| FABRIC 4 | P8 | PIGMENT INK | P3 | FABRIC 3 | P7 | DISPERSE INK | NONE | △ | ○ | △ | NONE | △ | ○ | NONE |
| FABRIC 4 | P8 | PIGMENT INK | P8 | FABRIC 3 | P7 | DISPERSE INK | NONE | △ | ○ | ◎ | NONE | △ | ○ | NONE |
| FABRIC 4 | P7 | PIGMENT INK | P4 | FABRIC 3 | P8 | DISPERSE INK | NONE | △ | ◎ | △ | NONE | △ | ○ | NONE |
| FABRIC 4 | P7 | PIGMENT INK | P7 | FABRIC 3 | P8 | DISPERSE INK | NONE | △ | ◎ | ○ | NONE | △ | ○ | NONE |
| FABRIC 4 | P8 | PIGMENT INK | P4 | FABRIC 3 | P8 | DISPERSE INK | NONE | △ | ○ | △ | NONE | △ | ○ | NONE |
| FABRIC 4 | P8 | PIGMENT INK | P8 | FABRIC 3 | P8 | DISPERSE INK | NONE | △ | ○ | ◎ | NONE | △ | ○ | NONE |

Fig. 38

INKJET TEXTILE PRINTING METHOD AND INKJET TEXTILE PRINTING APPARATUS

CROSS-REFERENCE TO RELATED APPLICATIONS

This application claims priority to Japanese Patent Application No. 2011-139399 filed on Jun. 23, 2011. The entire disclosure of Japanese Patent Application No. 2011-139399 is hereby incorporated herein by reference.

BACKGROUND

1. Technical Field

The present invention relates to an inkjet textile printing method and an inkjet textile printing apparatus.

2. Related Art

A known inkjet printer forms an image on a recording medium by ejecting ink from a nozzle toward the recording medium. There is also a known technology (hereinafter called "inkjet textile printing") for using a fabric as the recording medium and using an inkjet printer to print on the fabric by ejecting ink onto the fabric. Inkjet textile printing is advantageous over such other textile printing methods as screen printing, roller printing, roller screen printing, and transfer printing because inkjet printing does not require fabrication of a printing plate like those other methods do and, thus, more easily accommodates high-mix low-volume production. Inkjet textile printing is also advantageous in that it incurs a smaller amount of waste liquid.

In inkjet textile printing, there are known technologies for improving image quality by using transparent inks in addition to inks containing coloring materials. Japanese Laid-Open Patent Publication No. 06-10278 discloses a technology related to an inkjet printing method for printing on a sheet-like item, wherein at least one of a plurality of inkjet nozzles is a dedicated nozzle for a colorless ink that contains a medium that can disperse or dissolve a coloring matter and does not contain a coloring matter and the method serves to apply an ink containing a coloring matter and a version of the colorless ink having compatibility with the coloring matter-containing ink to a portion of a printing area of the item where a light color or color leveling is necessary. Japanese Laid-Open Patent Publication No. 2010-65209 discloses technology for a textile printing inkjet ink set and an inkjet textile printing method, wherein the textile printing inkjet ink set comprises a recording ink containing a reactive dye, a water-soluble organic solvent, and water and a transparent ink containing a water-soluble macromolecular material and an inorganic base. The textile printing inkjet ink set and the inkjet textile printing method enable inkjet printing onto fabric that has not been pre-treated so as to produce high color densities while suppressing bleeding and mixing of ink. Japanese Laid-Open Patent Publication No. 2006-181804 discloses a technology for removing foreign matter and froth from inside an inkjet head. In order to reliably discharge foreign matter inside the inkjet head and reduce work performed by hand, a rotating part of a stationary table supporting the inkjet head is rotated and cleaning is executed in a manner suitable to the direction of the head. Japanese Laid-Open Patent Publication No. 06-320743 discloses a technology related to an inkjet textile printing apparatus configured to wipe an ink ejecting surface of a head using a so-called wiper ring treatment in order to prevent ink that has adhered to the ink discharge surface from adhering to a print medium and to prevent discharge variation of the ink discharged a plurality of nozzles. The technology serves to shorten the execution time of the wiper rink treatment.

SUMMARY

In inkjet textile printing, the type of ink used sometimes differs depending on the type of fabric used as the recording medium and the pattern being printed. If the type of ink used in a printer is fixed, then it will be necessary to use multiple printers to accommodate the combinations of fabric and pattern. Therefore, it is more efficient in terms of space and other factors to use a single printer and change the type of ink used in that printer. When the type of ink used is changed (when the ink discharged from a particular nozzle is changed), there is a possibility that color mixing of the ink used prior to the change and the ink used after the change will occur such that it is not possible to print with the proper tone of color. Also, there is a possibility that the ink used prior to the change and the ink used after the change will undergo a chemical change that causes the ink to become more viscous or solidify and clog the nozzle. An inkjet textile printing apparatus is larger and more complex than the inkjet printers typically intended for home use and it is desirable to avoid further increasing the size and complexity of the apparatus in order to resolve the aforementioned problems. Also, when, for example, a handkerchief or scarf is fabricated using inkjet textile printing, it is sometimes preferable to suppress a difference of image density between the printing surface and the surface on the opposite side (hereinafter called the "non-printing surface"). Such printing can be accomplished by using an inkjet apparatus to discharge ink onto a printing surface such that the print density of the printing when viewed from the non-printing surface is similar to the print density when viewed from the printing surface. In this way, by executing inkjet printing onto the printing surface, print that is visible from both the printing surface and the non-printing surface can be accomplished. Additionally, while an inkjet textile printing apparatus is generally large, it is desirable to reduce the size as much as possible.

The invention disclosed in Japanese Laid-Open Patent Publication No. 06-10278 is intended to resolve issues regarding the appearance of moray patterns and color leveling by aggressively promoting bleed-through of the ink (paragraph 0012). The invention disclosed in Japanese Laid-Open Patent Publication No. 2010-65209 has the object of providing a textile printing inkjet ink set and an inkjet textile printing method that enable inkjet printing onto fabric that has not been pre-treated so as to produce high color densities while suppressing bleeding and mixing of ink (paragraph 0012). The invention disclosed in Japanese Laid-Open Patent Publication No. 2006-181804 has the object of reliably discharging foreign matter inside the inkjet head and reducing work performed by hand (paragraph 0008). The invention disclosed in Japanese Laid-Open Patent Publication No. 06-320743 has the object of providing an inkjet printing apparatus and method that can accomplish wiping of an inkjet head in a short amount of time (paragraph 0006). While engaging in technical development of textile printing, the inventors have discovered that from the standpoint of making inkjet textile printing practical, it is important to enable inkjet printing onto the printing surface to be accomplished such that the printing is visible from both the printing surface and the non-printing surface and it is important to prevent the apparatus from becoming larger and more complex to the greatest extent possible. Although the inventors have attempted to solve the problem addressed by the present invention, the cited documents neither disclose nor suggest the problem addressed by the present invention. Even if the inventions cited above are considered in combination, the problem addressed by the present invention can be neither detected nor solved.

The present invention is intended to solve the aforementioned problem and its object is to enable inkjet textile printing onto a printing surface to be accomplished such that the print is visible from both the printing surface and a non-printing surface while preventing the apparatus from becoming larger and more complex and decreasing a difference of image density between the printing surface and the non-printing surface.

In order to achieve at least a portion of the object, the present invention can be realized with any of the aspects or application examples explained below.

An inkjet textile printing method according to one aspect of the present invention includes: printing onto a first fabric using a first textile printing colored liquid by executing a penetrant liquid ejecting step in which a first penetrant liquid that facilitates penetration of the first textile printing colored liquid into a first fabric is ejected from a first nozzle toward a first surface of the first fabric, and a textile printing colored liquid ejecting step in which the first textile printing colored liquid is ejected from a second nozzle toward a portion of the first surface of the first fabric where the first penetrant liquid was discharged; printing onto a second fabric with a second textile printing colored liquid by executing a penetrant liquid ejecting step in which a second penetrant liquid that facilitates penetration of the second textile printing colored liquid into the second fabric is ejected from the first nozzle toward a first surface of the second fabric and a textile printing colored liquid ejecting step in which the second textile printing colored liquid is ejected from the second nozzle toward a portion of the first surface of the second fabric where the second penetrant liquid was discharged; and discharging at least one of the first penetrant liquid and the second penetrant liquid from the second nozzle between the printing with the first textile printing colored liquid and the printing with the second textile printing colored liquid.

In this inkjet printing method, printings of first and second textile printing colored liquids onto first and second fabrics are accomplished using a penetrant liquid ejecting procedure in which a penetrant liquid that facilitates penetration of the textile printing colored liquid into the fabric is ejected from the first nozzle toward the first surface of the fabric and a textile printing colored liquid ejecting procedure in which the textile printing colored liquid is ejected from the second nozzle toward the portion of the first surface of the fabric where the penetrant liquid was discharged. As a result, a difference of image density between the printing surface and the non-printing surface can be decreased and inkjet printing onto the printing surface can be accomplished such that the printing is visible from both the printing surface and the non-printing surface. Also, this ink jet printing method has a procedure in which at least one of the first penetrant liquid and the second penetrant liquid is ejected from the second nozzle between printing with the first textile printing colored liquid and printing with the second textile printing colored liquid. Since the second nozzle is cleaned by this step, the apparatus used to accomplish the inkjet textile printing can be made less complex and more compact than an apparatus in which a dedicated penetrant liquid and a dedicated cleaning liquid are separately prepared.

In the inkjet textile printing method according to the above described aspect, the printing accomplished with the first textile printing colored liquid is preferably visible from both surfaces of the first fabric, and the printing accomplished with the second textile printing colored liquid is preferably visible from both surfaces of the second fabric.

With this inkjet printing method, print that is visible from both the printing surface and the non-printing surface can be accomplished by executing inkjet textile printing onto the printing surface during printing with the first textile printing colored liquid and printing with the second textile printing colored liquid.

The inkjet textile printing method according to the above described aspect preferably further includes ejecting the first penetrant liquid from the second nozzle after the printing with the first textile printing colored liquid and before the printing with the second textile printing colored liquid With this inkjet printing method, the first penetrant liquid is ejected from the second nozzle after printing with the first textile printing colored liquid and before printing with the second textile printing colored liquid. As a result, the first textile printing colored liquid in the second nozzle can be cleaned thoroughly.

In the inkjet textile printing method according to the above described aspect, the first textile printing colored liquid and the second textile printing colored liquid are preferably different inks from among an acidic ink, a reactive ink, a dispersion ink, and a pigment ink, and different penetrant liquids are preferably used for the first penetrant liquid and the second penetrant liquid.

With this inkjet printing method, since different penetrant liquids are used for the first penetrant liquid and the second penetrant liquid when the first textile printing colored liquid and the second textile printing colored liquid are different inks from among acidic ink, reactive ink, dispersion ink, and pigment ink, the first and second penetrant liquids used are suited to the corresponding textile printing colored liquids. As a result, the difference of image density between the printing surface and the non-printing surface can be decreased further and a cleaning effect can be obtained with respect to the second nozzle.

In the inkjet textile printing method according to the above described aspect, one of the first textile printing colored liquid and the second textile printing colored liquid is preferably an acidic ink and the other is a reactive ink, and the same penetrant liquid is preferably used as the first penetrant liquid and the second penetrant liquid.

With this inkjet printing method, the same penetrant liquid is used for both the first penetrant liquid and the second penetrant liquid when one of the first textile printing colored liquid and the second textile printing colored liquid is an acidic ink and the other is a reactive ink. As a result, the effect of decreasing the image density difference between the printing surface and the non-printing surface and the ability to clean the second nozzle can be ensured to some degree while reducing the number of types of penetrant liquid used.

In the inkjet textile printing method according to the above described aspect, one of the first textile printing colored liquid and the second textile printing colored liquid is preferably a dispersion ink and the other is a pigment ink, and the same penetrant liquid is preferably used as the first penetrant liquid and the second penetrant liquid.

With this inkjet printing method, the same penetrant liquid is used for both the first penetrant liquid and the second penetrant liquid when one of the first textile printing colored liquid and the second textile printing colored liquid is dispersion ink and the other is a pigment ink. As a result, the effect of decreasing the image density difference between the printing surface and the non-printing surface and the ability to clean the second nozzle can be ensured to some degree while reducing the number of types of penetrant liquid used.

In the inkjet textile printing method according to the above described aspect, both the first textile printing colored liquid and the second textile printing colored liquid are preferably acidic inks, reactive inks, dispersion inks, or pigment inks, and the same penetrant liquid is preferably used as the first penetrant liquid and the second penetrant liquid.

With this inkjet printing method, the same penetrant liquid is used for both the first penetrant liquid and the second penetrant liquid when both the first textile printing colored liquid and the second textile printing colored liquid are acidic inks, reactive inks, dispersion inks, or pigment inks. As a result, the effect of decreasing the image density difference between the printing surface and the non-printing surface and the ability to clean the second nozzle can be ensured while reducing the number of types of penetrant liquid used.

In the inkjet textile printing method according to the above described aspect, the first penetrant liquid is preferably a liquid whose main ingredients are ingredients of the first textile printing coloring liquid with the coloring material removed and the second penetrant liquid is a liquid whose main ingredients are ingredients of the second textile printing coloring liquid with the coloring material removed.

With this inkjet printing method, since the first penetrant liquid is a liquid whose main ingredients are ingredients of the first textile printing colored liquid with the coloring material removed and the second penetrant liquid is a liquid whose main ingredients are ingredients of the second textile printing colored liquid with the coloring material removed, the penetrant liquid can be prepared easily and an image density difference of the printing between the printing surface and the non-printing surface can be satisfactorily decreased while suppressing bleeding of the image. Additionally, the second nozzle can be cleaned satisfactorily with the penetrant liquid.

In the inkjet textile printing method according to the above described aspect, a plurality of different textile printing colored liquids are preferably used as the first and second textile printing colored liquids, and in the textile printing colored liquid ejecting steps executed in order to print with the first textile printing colored liquid and to print with the second textile printing colored liquid, the different textile printing colored liquids are preferably ejected from different second nozzles.

With this inkjet printing method, a wide variety of patterns can be printed on textiles by ejecting the different textile printing colored liquids from different second nozzles during the textile printing colored liquid ejecting steps executed in order to print with the first textile printing colored liquid and print with the second textile printing colored liquid.

In the inkjet textile printing method according to the above described aspect, the penetrant liquid preferably has as a main ingredient a solvent common to the different textile printing colored liquids.

With this inkjet printing method, since the penetrant liquid has a solvent common to the different textile printing colored liquids as its main ingredient, an image density difference between the printing surface and the non-printing surface can be satisfactorily decreased with respect to the printings made using the different textile printing colored liquids while suppressing bleeding of the image. Additionally, the second nozzles can be cleaned satisfactorily with the penetrant liquid and the apparatus can be prevented from becoming more complex or increasing in size.

In the inkjet textile printing method according to the above described aspect, the different textile printing colored liquids are preferably of one type from among an acidic ink, a reactive ink, a dispersion ink, and a pigment ink and each of the different textile printing colored liquids has a different color.

With this inkjet printing method, since the penetrant liquid has a solvent common to the different textile printing colored liquids (which have different colors from one another and are of one type selected from among acidic ink, reactive ink, dispersion ink, and pigment ink) as its main ingredient, an image density difference between the printing surface and the non-printing surface can be satisfactorily decreased with respect to the printings made using the different-colored textile printing colored liquids while suppressing bleeding of the image. Additionally, the second nozzles can be cleaned satisfactorily with the penetrant liquid and the apparatus can be prevented from becoming more complex or increasing in size.

An inkjet textile printing apparatus according to another aspect of the present invention includes a first nozzle, a second nozzle, a first printing part, a second printing part and a discharging part. The first printing part is configured and arranged to print on a first fabric with a first textile printing colored liquid. The first printing part has a penetrant liquid ejecting section and a textile printing colored liquid ejecting section. The penetrant liquid ejecting section is configured and arranged to eject a first penetrant liquid that facilitates penetration of the first textile printing colored liquid into the first fabric from the first nozzle toward a first surface of the first fabric. The textile printing colored liquid ejecting section is configured and arranged to eject the first textile printing colored liquid from the second nozzle toward a portion of the first surface of the first fabric where the first penetrant liquid was discharged. The second printing part is configured and arranged to print on a second fabric with a second textile printing colored liquid. The second printing part has a penetrant liquid ejecting section and a textile printing colored liquid ejecting section. The penetrant liquid ejecting section is configured and arranged to eject a second penetrant liquid that facilitates penetration of the second textile printing colored liquid into the second fabric from the first nozzle toward a first surface of the second fabric. The textile printing colored liquid ejecting section is configured and arranged to eject the second textile printing colored liquid from the second nozzle toward a portion of the first surface of the second fabric where the second penetrant liquid was discharged. The discharging part is configured and arranged to discharge at least one of the first penetrant liquid and the second penetrant liquid from the second nozzle between the printing with the first textile printing colored liquid and the printing with the second textile printing colored liquid.

This inkjet textile printing apparatus exhibits the same operational effects as explained regarding the above described aspects. Also, each of the inkjet textile printing methods presented in the above described aspects exhibits the same operational effects as explained previously when reconfigured as an inkjet textile printing apparatus.

An inkjet textile printing apparatus includes a penetrant liquid storage tank, a textile printing colored liquid storage tank, a first flow passage, a second flow passage, and a third flow passage. The penetrant liquid storage tank is configured and arranged to store a penetrant liquid that facilitates penetration of a textile printing colored liquid into a fabric. The textile printing colored liquid storage tank is configured and arranged to store the textile printing colored liquid. The first flow passage connects the penetrant liquid storage tank and a first nozzle together. The second flow passage connects the textile printing colored liquid storage tank and a second nozzle together. The third flow passage connects the first flow passage and the second flow passage together and forms a flow passage for supplying the penetrant liquid to the second nozzle.

With this inkjet printing apparatus, the penetrant liquid is supplied from the penetrant liquid storage tank to the first nozzle through the first passage and discharged, and the textile printing colored liquid is supplied from the textile printing colored liquid storage tank to the second nozzle through the second flow passage and discharged. In this way, an image density difference between the printing surface and the non-printing surface can be decreased and inkjet printing onto the printing surface can be accomplished such that the printing is visible from both the printing surface and the non-printing surface. Additionally, with this inkjet printing apparatus, since the third flow passage forms a flow passage that connects the first flow passage and the second flow passage together and supplies the penetrant liquid to the second nozzle, the second nozzle can be cleaned by supplying the penetrant liquid from the penetrant liquid storage tank to the nozzle 2 through the third flow passage and the inkjet textile printing apparatus can be made less complex and more compact than an apparatus in which a dedicated penetrant liquid and a dedicated cleaning liquid are separately prepared.

The present invention can be realized in various forms. For example, the invention can be realized as an inkjet textile printing method, an inkjet textile printing apparatus, a printing system having an inkjet textile printing apparatus, a control method for a printing system having an inkjet textile printing apparatus, a computer program for realizing the functions of such a method, apparatus, or system, a recording medium on which such a computer program is stored, or a data signal that includes such a computer program and has been generated inside a carrier wave.

BRIEF DESCRIPTION OF THE DRAWINGS

Referring now to the attached drawings which form a part of this original disclosure:

FIG. 12 illustrates an example of a composition of a textile printing liquid used in an evaluation test.

FIG. 13 illustrates an example of a composition of a textile printing liquid used in an evaluation test.

FIG. 14 illustrates an example of a composition of a textile printing liquid used in an evaluation test.

FIG. 15 illustrates an example of a composition of a textile printing liquid used in an evaluation test.

FIG. 16 illustrates an example of a composition of a textile printing liquid used in an evaluation test.

FIG. 17 shows evaluation test results.

FIG. 23 presents variations of a printing A, a printing B, and a discharge of a penetration liquid between the printings.

FIG. 24 presents variations of a printing A, a printing B, and a discharge of a penetration liquid between the printings.

FIG. 25 presents variations of a printing A, a printing B, and a discharge of a penetration liquid between the printings.

FIG. 26 presents variations of a printing A, a printing B, and a discharge of a penetration liquid between the printings.

FIG. 27 presents variations of a printing A, a printing B, and a discharge of a penetration liquid between the printings.

FIG. 28 presents variations of a printing A, a printing B, and a discharge of a penetration liquid between the printings.

FIG. 29 presents variations of a printing A, a printing B, and a discharge of a penetration liquid between the printings.

FIG. 30 presents variations of a printing A, a printing B, and a discharge of a penetration liquid between the printings.

FIG. 31 presents variations of a printing A, a printing B, and a discharge of a penetration liquid between the printings.

FIG. 32 presents variations of a printing A, a printing B, and a discharge of a penetration liquid between the printings.

FIG. 33 presents variations of a printing A, a printing B, and a discharge of a penetration liquid between the printings.

FIG. 34 presents variations of a printing A, a printing B, and a discharge of a penetration liquid between the printings.

FIG. 35 presents variations of a printing A, a printing B, and a discharge of a penetration liquid between the printings.

FIG. 36 presents variations of a printing A, a printing B, and a discharge of a penetration liquid between the printings.

FIG. 37 presents variations of a printing A, a printing B, and a discharge of a penetration liquid between the printings.

FIG. 38 presents variations of a printing A, a printing B, and a discharge of a penetration liquid between the printings.

DETAILED DESCRIPTION OF EXEMPLARY EMBODIMENTS

Embodiments of the present invention will now be explained in the order presented below: A. First Embodiment; A-1. Apparatus Constituent Features; A-2. Composition of Textile Printing Liquids; A-2-1. Composition of Ink; A-2-2. Composition of Penetrant liquid; A-3. Printing Process; A-4.

Ink Change Process; A-5. Evaluation Test; B. Second Embodiment; C. Third Embodiment; and D. Variations.

A. First Embodiment

A-1. Apparatus Constituent Features

Figure 1:
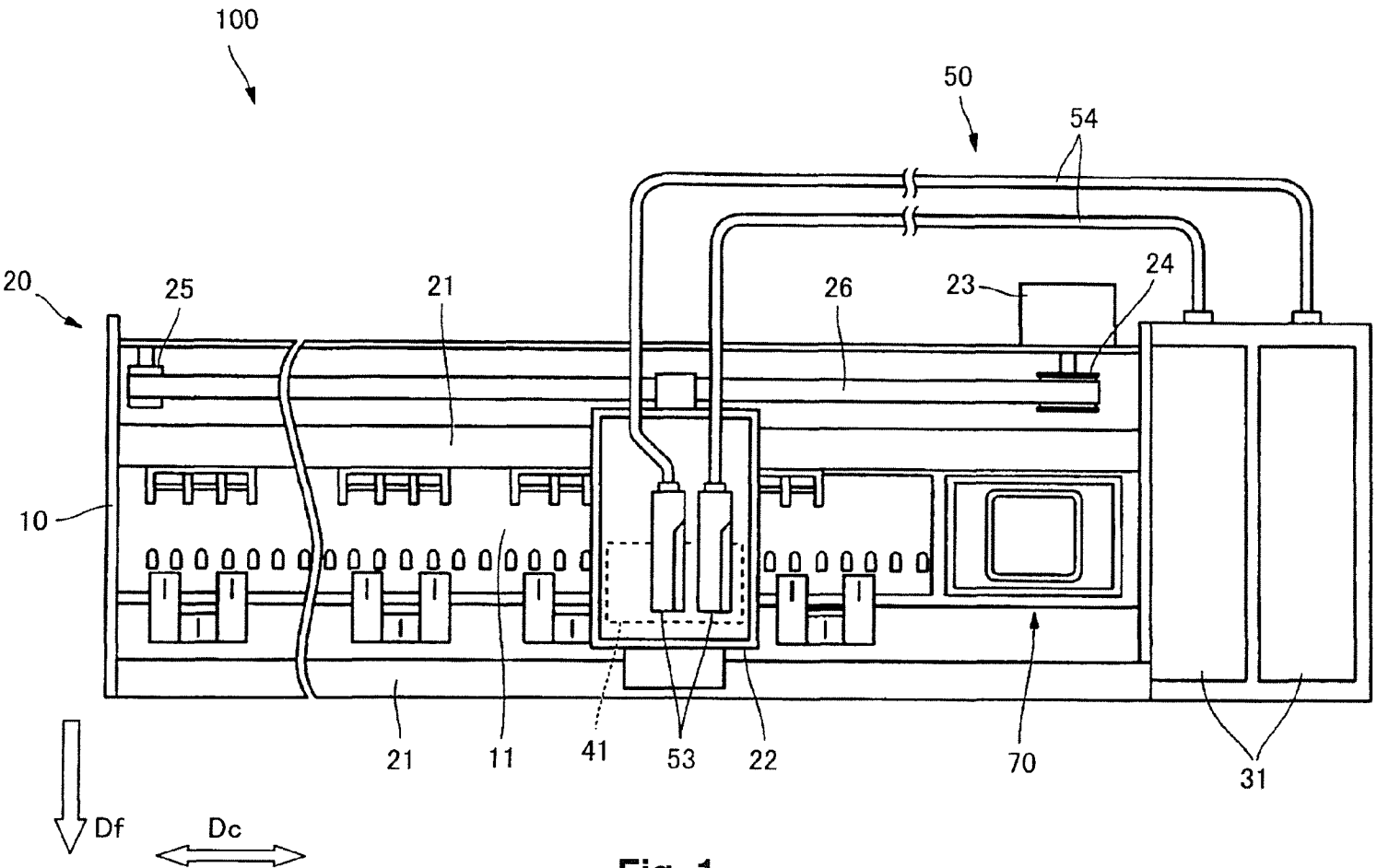
FIG. 1 schematically illustrates constituent features of an inkjet printer 100 according to a first embodiment of the present invention.

FIG. 1 schematically illustrates constituent features of an inkjet printer 100 according to a first embodiment of the present invention. In FIG. 1, a portion of the constituent parts are omitted and the dimensions of some parts are changed as appropriate in order make the constituent features of the inkjet printer 100 easier to understand.

The inkjet printer 100 of this embodiment is a printing apparatus that can execute inkjet textile printing so as to record an image by ejecting ink toward a surface (printing surface) of a fabric serving as a recording medium PM. As will be explained later, the inkjet printer 100 of this embodiment discharges a penetrant liquid toward the printing surface of the fabric in order to decrease a difference of image density between a printing surface and an opposite-side surface (non-printing surface) while suppressing ink bleeding. In this embodiment, the term "image" includes letters, shapes, symbols, patterns, and the like. The ink used in this embodiment corresponds to the textile printing colored liquid mentioned in the claims. The ink and the penetrant liquid are referred to collectively as "textile printing liquids."

The fabric used as the recording medium PM is, for example, a woven, knitted, or non-woven cloth made of polyamide fibers, silk, or wool. The ink is an acidic dye ink (hereinafter called simply "acidic ink"), a reactive dye ink (hereinafter called "reactive ink"), a disperse dye ink (hereinafter called "disperse ink"), or a pigment ink and is selected based on the type of fabric that will be used and the type of image that will be formed. In this embodiment, the penetrant liquid used is a liquid that exhibits an action of dissolving the coloring material of ink adhered to the fabric and accelerating penetration of the ink into the fabric and also exhibits a cleaning action with respect to the ink. The composition and action of the ink and the penetrant liquid will be explained in more detail later.

Figure 2:
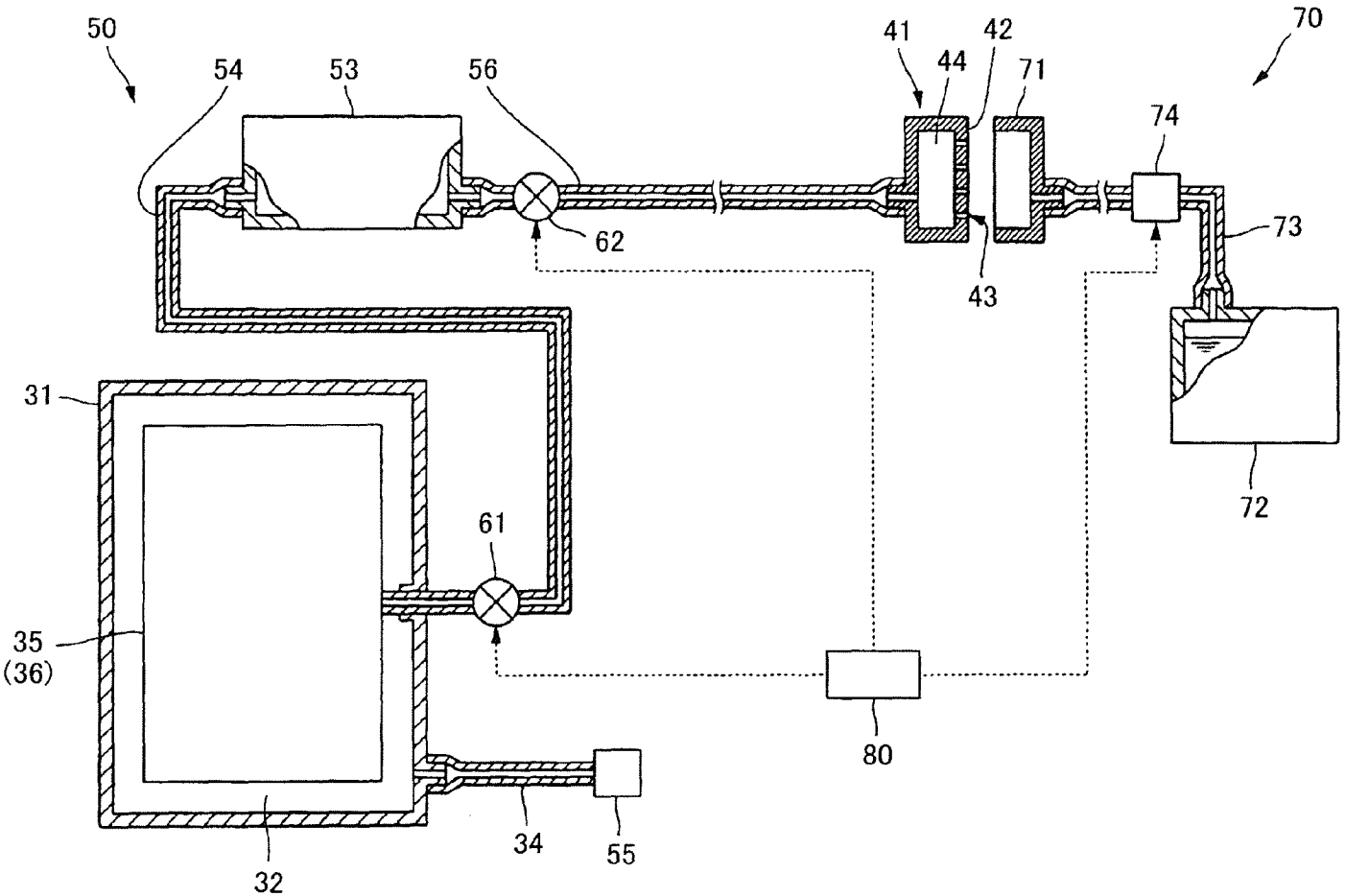
FIG. 2 schematically illustrates a portion of elements making up the inkjet printer 100 centering on a liquid supply system 50.

As shown in FIG. 1, the ink jet printer 100 has a printer main body 10, a platen 11, a carriage drive system 20, a liquid supply system 50, a capping unit 70, and a control section 80 (FIG. 2). The printer main body 10 serves as a base member of the inkjet printer 100 and holds the carriage drive system 20 and other parts.

The carriage drive system 20 is a mechanism for moving a carriage 22 back and forth along a main scanning direction Dc (left and right directions in FIG. 1) and includes a guide 21, the carriage 22, a carriage motor 23, a drive pulley 24, an idler pulley 25, and a drive belt 26. The guide 21 is a pair of members installed on the printer main body 10 that extend along the main scan direction Dc. The carrier 22 is a member for carrying an ejection head (explained in detail later) and is supported on the pair of guides 21 such that it can move along the main scanning direction Dc. In this embodiment, sub tanks 53 (explained in detail later) are also mounted to the carriage 22.

The carriage motor 23 is an electric motor for moving the carriage 22 back and forth and is installed on the printer main body 10. The drive pulley 24 is a pulley connected to a rotary shaft of the carriage motor 23, and the idler pulley 25 is a pulley mounted to the printer main body 10. The drive belt 26 is arranged across the drive pulley 24 and the idler pulley 25 and fixedly connected to the carriage 22 at a prescribed location. When the carriage motor 23 is driven such that it rotates, the drive pulley 24 rotates and the drive belt 26 arranged across the drive pulley 24 and the idler pulley 25 moves in a circulatory manner. Since the carriage 22 is connected to the drive belt 26, it moves along the main scanning direction Dc. In this way, a movement (called a "main scan") of the carriage 22 along the main scanning direction Dc is accomplished.

The platen 11 is a support member for supporting a fabric serving as the recording medium PM in a flat state. A transport mechanism not shown in the drawings is provided in the printer main body 10, and the recording medium PM is transported over the platen 11 by the transport mechanism along a subordinate scanning direction Df that is substantially perpendicular to the main scanning direction Dc. In this way, a relative movement (called a "subordinate scan") of the recording medium PM along the subordinate scanning direction Df can be accomplished with respect to the ejection head 41 carried on the carriage 22.

The liquid supply system 50 is a mechanism for storing, transporting, and ejecting the textile printing liquids (ink and penetrant liquid). FIG. 2 schematically illustrates a portion of the elements making up the inkjet printer 100 centering on the liquid supply system 50. In FIG. 2, chiefly the liquid supply system 50, the capping unit 70, and the control section 80 are shown in a schematic fashion. As shown in FIG. 2, the liquid supply system 50 has a main tank 31, a sub tank 53, an ejection head 41, and piping connecting these components together.

The ejection head 41 has a liquid reservoir 44 that collects the textile printing liquids and a plurality of nozzles 43 that are formed in a nozzle face 42. The ejection head 41 has a piezoelectric element (not shown), and the textile printing liquid collected in the liquid reservoir 44 is ejected from the nozzles 43 when the piezoelectric element is driven. The ejection head 41 is mounted on the carriage 22 (FIG. 1) at such an orientation that the nozzle face 42 faces opposite the platen 11.

The liquid supply system 50 has a plurality of main tanks 31 that serve as storage chambers for storing the textile printing liquids (ink and penetrant liquid) that will be supplied to the ejection head 41. The main tanks 31 are provided on the printer main body 10. A liquid pack comprising a pliable bag containing a textile printing liquid (an ink pack 35 containing ink or a penetrant liquid pack 36 containing a penetrant liquid) is removably installed in an internal space 32 of each of the main tanks 31. The sub tanks 53 are storage chambers installed on the carriage 22 in the same number as the main tanks 31. The sub tanks 53 serve to store a prescribed amount of a textile printing liquid in order to maintain a stable supply of the textile printing liquid to the ejection head 41. In this embodiment, the amount of textile printing liquid remaining inside the main tanks 31 is detected by detecting a pressure of the sub tanks 53. The capacity of the main tanks 31 is preferably 10 to 30 times the capacity of the sub tanks 53. However, it is not mandatory for the relationship between the capacity of the main tanks 31 and the capacity of the sub tanks 53 to be in this range.

Each of the ink packs 35 and penetrant liquid packs 36 stored in the main tanks 31 and each of the corresponding sub tanks 53 are connected together through a separate first supply pipe 54. In this embodiment, the first supply pipes 54 are made of a pliable material (e.g., polyethylene) because the sub tanks 53 are carried on the carriage 22. A first valve 61 is provided along each of the first supply pipes 54 and serves to open and close the first supply pipe 54. The first valves 61 are in an open state during normal operation (during textile printing).

Each of the sub tanks 53 is connected to the ejection head 41 through a corresponding separate second supply pipe 56. A second valve 62 is provided along each of the second supply pipes 56 and serves to open and close the second supply pipe 56. The second valves 62 are in an open state during normal operation. Although not shown in FIG. 2, a pressure regulating valve 68 (see FIG. 4) is provided where each of the second supply pipes 56 connects to the ejection head 41. The pressure regulating valves 68 serve to regulate (reduce) the pressure when the textile printing liquids are drawn into the ejection head 41.

The liquid supply system 50 also has a supply pump 55. The supply pump 55 pumps air into the internal space 32 of each of the main tanks through air supply pipes 34. Pumping air with the supply pump 55 raises the air pressure inside the internal space 32 of each of the main tanks 31 and causes the ink pack 35 or penetrant liquid pack 36 installed in the internal space 32 to contract. As a result, the textile printing liquid (ink or penetrant liquid) contained inside the pack is supplied to the corresponding sub tank 53 through the corresponding first supply pipe 54 and, furthermore, supplied to the liquid collecting tank 44 of the ejection head 41 through the second supply pipe 56.

The capping unit 70 is a mechanism that removes textile printing liquid from inside the liquid supply system 50 by applying suction to the nozzles 43 of the ejection head 41 and is provided at a home position of the carriage 22 in the printer main body 10 (see FIG. 1). The home position is set to a position within a movement range of the carriage 22 and outside a region where the recording medium PM is supported on the platen 11.

As shown in FIG. 2, the capping unit 70, has a cap 71, a waste liquid tank 72, a discharge pipe 73, and a suction pump 74. The cap 71 is a member serving to form a sealed space between itself and the nozzle face 42 of the ejection head 41 when the ejection head 41 (mounted on the carriage 22) has moved to a position of the capping unit 70. An elastic material is provided around a periphery of an open end of the cap 71 to increase an airtight sealing performance with respect to the nozzle face 42.

The waste liquid tank 72 is a tank for collecting textile printing liquids discharged from the nozzles 43 of the ejection head 41 when, for example, clogging of the nozzles 43 is cleaned or when the nozzles 43 and the supply pipes 54 and 56 are cleaned during a changeover of the type of ink used. The cap 71 and the waste liquid tank 72 are connected together by the discharge pipe 73. The suction pump 74 is provided along the discharge pipe 73 and applies suction to the sealed space when a sealed space is formed between the cap 71 and the nozzle face 42 of the ejection head 41.

The control section 80 comprises a computer having a memory and a CPU (not shown) and serves to control the operations of the various parts of the inkjet printer 100. For example, as shown in FIG. 2, the control section 80 controls open and close operations of the first valves 61 and the second valves 62 and suction operations of the suction pump 74. The control section 80 also controls operations of the carrier motor 23 (FIG. 1), the transport mechanism for the recording medium PM, and the ejection head 41.

Figure 3:
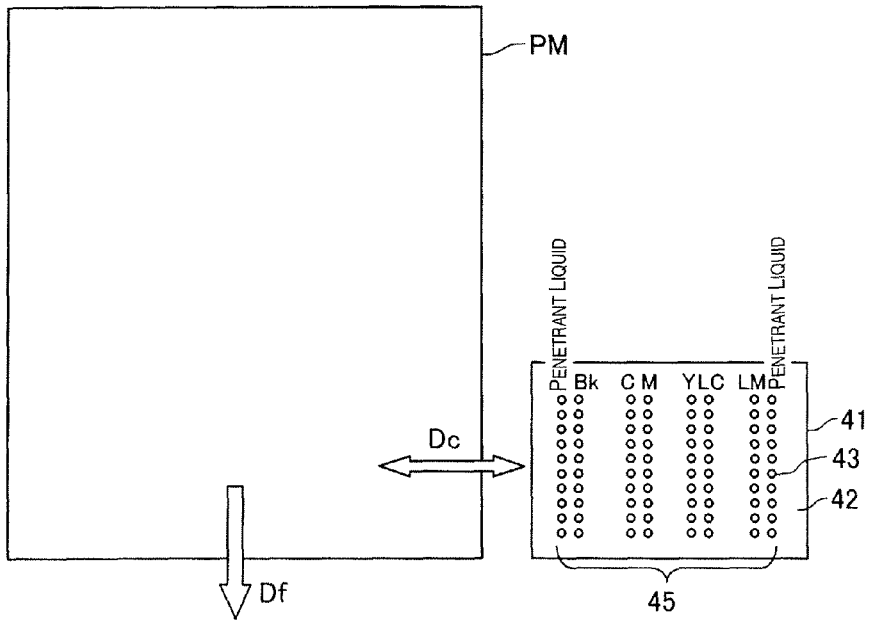
FIG. 3 illustrates constituent features of an ejection head 41.

FIG. 3 illustrates constituent features of an ejection head 41. The inkjet printer 100 of this embodiment executes textile printing using six colors of ink. Nozzle lines 45 for the six colors of ink are arranged side-by-side along the main scanning direction Dc are formed in the nozzle face 42 of the ejection head 41. Each of the nozzle lines 45 comprises a plurality of nozzles 43 (see FIG. 2) arranged along the subordinate scanning direction Df. In this embodiment, the six colors are black (Bk), cyan (C), magenta (M), yellow (Y), light cyan (LC), and light magenta (LM). Each of the nozzles 43 making up the nozzle lines 45 for each of the ink colors corresponds to the second nozzle mentioned in the claims.

The inkjet printer 100 of this embodiment also ejects a penetrant liquid during printing. Consequently, nozzle lines 45 for the penetrant liquid are also formed in the nozzle face 42 of the ejection head 41. Similarly to the nozzle lines 45 for the inks, the nozzle lines 45 for the penetrant liquid are made up of pluralities of nozzles 43 arranged along the subordinate scanning direction Df. In this embodiment, the nozzle lines 45 for the penetrant liquid are arranged one each on opposite outsides of the nozzle lines 45 for the six colors of ink so as to be separated from each other along the main scanning direction Dc. Thus, there are two nozzle lines 45 for the penetrant liquid arranged with the nozzle lines 45 for the six colors disposed in-between. Each of the nozzles 43 making up the nozzle lines 45 for the penetrant liquid corresponds to the first nozzle mentioned in the claims.

Figure 4:
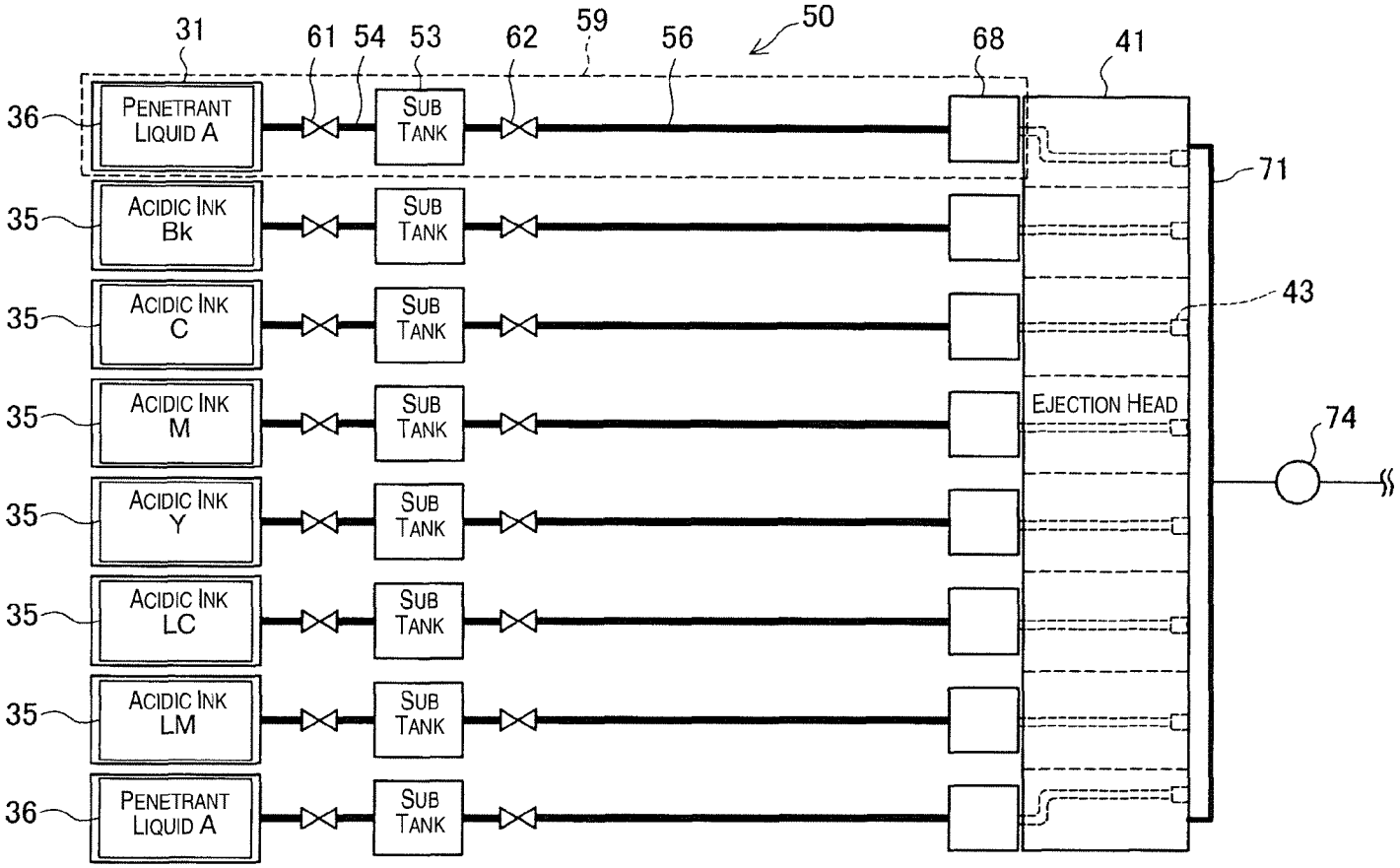
FIG. 4 illustrates specific constituent features the liquid supply system 50.

FIG. 4 illustrates specific constituent features the liquid supply system 50. FIG. 4 shows a portion of specific constituent features of the liquid supply system 50 and a portion of specific constituent features of the capping unit 70. As shown in FIG. 4, the liquid supply system 50 includes eight subordinate liquid supply systems 59 corresponding to the eight nozzle lines 45 (FIG. 3). More specifically, the liquid supply system 50 includes six subordinate liquid supply systems 59 corresponding to the nozzle lines 45 for the six colors of ink and two subordinate liquid supply systems 59 corresponding to the two nozzle lines for the penetrant liquid. Each of the subordinate liquid supply systems 59 includes a main tank 31, a first supply pipe 54, a first valve 61, a sub tank 53, a second supply pipe 56, a second valve 62, and a pressure regulating valve 68. A corresponding liquid pack (ink pack 35 or penetrant liquid pack 36) is installed in the main tank 31 of each of the subordinate liquid supply systems 59. In the situation shown in FIG. 4, ink packs 35 containing acidic inks of the respective colors are installed in the main tanks 31 of the subordinate liquid supply systems 59 for the inks and penetrant liquid packs 36 containing a penetrant liquid A corresponding to the acidic inks are installed in the main tanks 31 of the subordinate liquid supply systems 59 for the penetrant liquid. Each of the subordinate liquid supply systems 59 constitutes a flow passage for supplying the textile printing liquid contained in the liquid pack installed in the main tank 31 to the nozzles 43 of the ejection head 41. The flow passages constituted by the subordinate liquid supply systems 59 for the inks correspond to the second flow passage mentioned in the claims, and the flow passages constituted by the subordinate liquid supply systems 59 for the penetrant liquid correspond to the first flow passage mentioned in the claims.

A-2. Composition of Textile Printing Liquids

A-2-1. Composition of Ink

The inks (textile printing colored liquids) used in the inkjet printer 100 of this embodiment are, for example, acidic inks, reactive inks, disperse inks, and pigment inks.

Acidic inks contain an acidic dye as a coloring material. The amount of the acidic dye contained is determined as appropriate, but it is preferable for the amount to be approximately 0.1 to 15 percent by mass with respect to the total mass of the ink and still more preferable for the amount to be approximately 1.0 to 10 percent by mass.

There are no particular limitations on the acidic dye used in the acid ink so long as it has such a property that it can be chemically bonded to the fabric and fixed by thermal vapor deposition. Examples of acidic dyes include azo dyes, anthraquinone dyes, carbonium dyes, nitro dyes, and metal complex dyes. More specifically, such colors as the following might be used as the four base colors for printing or as colors close to the four base colors: C.I. acid yellows 1, 3, 7, 11, 17, 19, 23, 25, 29, 36, 38, 40, 42, 44, 49, 59, 61, 70, 72, 75, 76, 78, 79, 98, 99, 110, 111, 112, 114, 116, 118, 119, 127, 128, 131, 135, 141, 142, 161, 162, 163, 164, 165, 169, 207, 219, and 246; C.I. acid reds 1, 6, 8, 9, 13, 14, 18, 19, 24, 26, 27, 28, 32, 35, 37, 42, 51, 52, 57, 62, 75, 77, 80, 82, 83, 85, 87, 88, 89, 92, 94, 95, 97, 106, 111, 114, 115, 117, 118, 119, 129, 130, 131, 133, 134, 138, 143, 145, 149, 154, 155, 158, 168, 180, 183, 184, 186, 194, 198, 199, 209, 211, 215, 216, 217, 219, 249, 252, 254, 256, 257, 260, 262, 265, 266, 274, 276, 282, 283, 303, 317, 318, 320, 321, 322, and 361; C.I. acid blues 1, 7, 9, 15, 22, 23, 25, 27, 29, 40, 41, 43, 45, 49, 54, 59, 60, 62, 72, 74, 78, 80, 82, 83, 90, 92, 93, 100, 102, 103, 104, 112, 113, 117, 120, 126, 127, 129, 130, 131, 133, 138, 140, 142, 143, 151, 154, 158, 161, 166, 167, 168, 170, 171, 175, 182, 183, 184, 185, 187, 192, 199, 203, 204, 205, 225, 229, 234, 236, and 300; and C.I. acid blacks 1, 2, 7, 24, 26, 29, 31, 44, 48, 50, 51, 52, 58, 60, 62, 63, 64, 67, 72, 76, 77, 94, 107, 108, 109, 110, 112, 115, 118, 119, 121, 122, 131, 132, 139, 140, 155, 156, 157, 158, 159, 172, 191, and 234.

It is also possible to use acidic dyes having colors other than the four base colors, e.g., orange, violet, green, and brown, as appropriate in order to broaden the range of colors that can be expressed in the printed image or to curtail a particular color. Specific examples of such dyes include: C.I. acid oranges 1, 7, 8, 10, 19, 20, 24, 28, 33, 41, 43, 45, 51, 56, 63, 64, 65, 67, 74, 80, 82, 85, 86, 87, 88, 95, 122, 123, 124; C.I. acid violet 7, 11, 15, 31, 34, 35, 41, 43, 47, 48, 49, 51, 54, 66, 68, 75, 78, 97, and 106; C.I. acid greens 3, 7, 9, 12, 16, 19, 20, 25, 27, 28, 35, 36, 40, 41, 43, 44, 48, 56, 57, 60, 61, 65, 73, 75, 76, 78, and 79; and C.I. acid browns 2, 4, 13, 14, 19, 20, 27, 28, 30, 31, 39, 44, 45, 46, 48, 53, 100, 101, 103, 104, 106, 160, 161, 165, 188, 224, 225, 226, 231, 232, 236, 247,256, 257, 266, 268, 276, 277, 282, 289, 294, 295, 296, 297, 299, 300, 301, and 302. Furthermore, these dyes can be mixed and used as necessary to obtain a desired color. In particular, it is preferable to add a complementary color to print an excellent black color.

Reactive inks contain a reactive dye as a coloring material. In this embodiment, "reactive dye" refers to a chemical compound classified as a reactive dye in a color index. The amount of the reactive dye contained is determined as appropriate, but it is preferable for the amount to be approximately 1.0 to 15 percent by mass with respect to the total mass of the ink and still more preferable for the amount to be approximately 6.0 to 12 percent by mass. A sufficient print density can be obtained when the content of the reactive dye is equal to or larger than 1.0 percent by mass, and an ejection stability required for an ink used inkjet printing can be maintained, in particular, poor ejection performance under high-temperature conditions can be prevented, when the content of the reactive dye is smaller than or equal to 15 percent by mass.

There are no particular limitations on the reactive dye used in the acid ink so long as it has such a property that it can be chemically bonded to the fabric and fixed by thermal vapor deposition. Examples of reactive dyes include dyes having such reactive groups as a monochlorotriazinyl group, a dichlorotriazinyl group, a chloropyrimidyl group, a vinyl sulfone group, or an alkyl sulfate group. A dye is selected from among these dyes based on the particular objective. For example, a vinyl sulfone based reactive dye is preferable when a black color having a high density is particularly desired. Meanwhile, when a textile printing inkjet ink that can be stored for a long period of time is necessary, it is preferable to use a dye having a monochlorotriazinyl structure, i.e., a monochloro-substituted 1,3,5-triazine 2-yl. Since reactive dyes having a monochlorotriazinyl structure have comparatively excellent thermal stability, they are particularly well suited for use as dyes for inkjet inks requiring long-term storage stability. Specific examples of reactive dyes contained in textile printing inkjet inks include the following: C.I. reactive yellows 3, 6, 12, 18, and 86; C.I. reactive reds 3, 4, 7, 12, 13, 15, 16, 24, 29, 31, 32, 33, 43, 45, 46, 58, 59; reactive blues 2, 3, 5, 7, 13, 14, 15, 25, 26, 39, 40, 41, 46, 49, and 176; C.I. reactive blacks 1, 2, 3, 8, 10, 12, and 13.

It is also possible to use dyes having colors other than the four base colors, e.g., orange, violet, green, and brown, as appropriate in order to broaden the range of colors that can be expressed in the printed image or to curtail a particular color. Specific examples of such dyes include: C.I. reactive oranges 2, 5, 12, 13, and 20; C.I. reactive violets 1 and 2; C.I. reactive greens 5 and 8; C.I. reactive browns 1, 2, 7, 8, 9, 11, and 14. Furthermore, these dyes can be mixed and used as necessary to obtain a desired color. In particular, it is preferable to add a complementary color to print an excellent black color. When it is particularly desirable to obtain printing with good tone performance, the tone of print ranging from medium densities to low densities can be improved by adding a light colored ink to the ink explained above at an amount of 6.0 percent by mass or less.

Disperse inks contain a disperse dye as a coloring material. The amount of the disperse dye contained is determined as appropriate, but it is preferable for the amount to be approximately 0.1 to 15 percent by mass with respect to the total mass of the ink and still more preferable for the amount to be approximately 3 to 10 percent by mass.

The disperse dye used in a disperse ink can be an azo-based disperse dye, a quinone-based disperse dye, an anthraquinone-based disperse dye, or a quinophthalone-based disperse dye. Although the present invention is not limited to these, specific examples of chemical compounds that can be used include the following: C.I. disperse blues 3, 7, 9, 14, 16, 19, 20, 26, 27, 35, 43, 44, 54, 55, 56, 58, 60, 62, 64, 71, 72, 73, 75, 79, 81, 82, 83, 87, 91, 93, 94, 95, 96, 102, 106, 108, 112, 113, 115, 118, 120, 122, 125, 128, 130, 139, 141, 142, 143, 146, 148, 149, 153, 154, 158, 165, 167, 171, 173, 174, 176, 181, 183, 185, 186, 187, 189, 197, 198, 200, 201, 205, 207, 211, 214, 224, 225, 257, 259, 267, 268, 270, 284, 285, 287, 288, 291, 293, 295, 297, 301, 315, 330, 333; C.I. disperse reds 1, 4, 5, 7, 11, 12, 13, 15, 17, 27, 43, 44, 50, 52, 53, 54, 55, 56, 58, 59, 60, 65, 72, 73, 74, 75, 76, 78, 81, 82, 86, 88, 90, 91, 92, 93, 96, 103, 105, 106, 107, 108, 110, 111, 113, 117, 118, 121, 122, 126, 127, 128, 131, 132, 134, 135, 137, 143, 145, 146, 151, 152, 153, 154, 157, 159, 164, 167, 169, 177, 179, 181, 183, 184, 185, 188, 189, 190, 191, 192, 200, 201, 202, 203, 205, 206, 207, 210, 221, 224, 225, 227, 229, 239, 240, 257, 258, 277, 278, 279, 281, 288, 298, 302, 303, 310, 311, 312, 320, 324, 328; C.I. disperse yellows 3, 4, 5, 7, 9, 13, 23, 24, 30, 33, 34, 42, 44, 49, 50, 51, 54, 56, 58, 60, 63, 64, 66, 71, 74, 76, 79, 82, 83, 85, 86, 88, 90, 91, 93, 98, 99, 100, 104, 108, 114, 116, 118, 119, 122, 124, 126, 135, 140, 141, 149, 160, 162, 163, 164, 165, 179, 180, 182, 183, 184, 186, 192, 198, 199, 202, 204, 210, 211, 215, 216, 218, 224, 227, 231, 232; C.I. disperse black 1, 3, 10, 24.

Pigment inks contain a pigment as a coloring material. The amount of the pigment contained is determined as appropriate, but it is preferable for the amount to be approximately 0.5 to 30 percent by mass with respect to the total mass of the ink and still more preferable for the amount to be approximately 1.0 to 15 percent by mass. If the content amount is any smaller, then it will be impossible to ensure a sufficient print density. Meanwhile, if the content amount is any larger, then the viscosity of the ink will increase or a structural viscosity will occur and the ejection stability with which the ink is ejected from the ejection head 41 will degrade.

Pigments that can be used in black pigment inks include such particularly preferred carbon black (C.I. pigment black 7) materials as furnace black, lamp black, acetylene black, and channel black. Other black pigments that can be used include such metallic pigments as copper oxides, iron oxides (C.I. pigment black 11), and titanium oxides and such organic pigments as aniline black (C.I. pigment black 1). Pigments that can be used for color inks include C.I. pigment yellows 1 (fast yellow G), 3, 12 (disazo yellow AAA), 13, 14, 17, 24, 34, 35, 37, 42 (yellow iron oxide), 53, 55, 74, 81, 83 (disazo yellow HR), 93, 94, 95, 97, 98, 100, 101, 104, 108, 109, 110, 117, 120, 128, 138, 153, 155, 180, and 185; C.I. pigment reds 1, 2, 3, 5, 17, 22 (brilliant fast scarlet), 23, 31, 38, 48:2 (permanent red 2B (Ba)), 48:2 (permanent red 2B (Ca)), 48:3 (permanent red 2B (Sr)), 48:4 (permanent red 2B (Mn)), 49:1, 52:2, 53:1, 57:7 (brilliant carmine 6B), 60:1, 63:1, 63:2, 64:1, 81 (rhodamine 6G lake), 83, 88, 101 (rouge), 104, 105, 106, 108 (cadmium red), 112, 114, 122 (quinacridone magenta), 123, 146, 149, 166, 168, 170, 172, 177, 178, 179, 185, 190, 193, 202, 206, 209, and 219; C.I. pigment blues 1, 2, 15 (phthalocyanine blue R), 15:1, 15:2, 15:3 (phthalocyanine blue G), 15:4, 15:6 (phthalocyanine blue E), 16, 17:1, 56, 60, and 63.

It is preferable for the ink to contain a humectant from the perspective of improving the ejection stability of the ink ejected from the nozzles 43 of the ejection head 41 of the inkjet printer 100. The amount of humectant contained should be set as appropriate, but the amount is preferably 4.0 to 40 percent by mass with respect to total mass of the ink. Examples of humectants that can be used include the following chemical compounds that are typically used as humectants in inks for inkjet textile printing: such polyols as glycerin, ethylene glycol, diethylene glycol, triethylene glycol, tetraethylene glycol, polyethylene glycol, propylene glycol, dipropylene glycol, polypropylene glycol, 1,3-propanediol, 1,4-butandiol, 1,2-hexanediol, 1,5-pentanediol, 1,6-hexanediol, 1,2,6-hexanediol, or pentaerythritol or an ether or ester derivative of any of these; such lactams as 2-pyrrolidone, N-methyl-2-pyrrolidone, or ϵ-caprolactam; such ureas as urea, thiourea, ethylene urea, or a 1,3-dimethyl imidazolidinone; and such saccharides as maltitol, sorbitol, gluconolactone, or maltose. It is also possible to use one or two or more selected from among these.

It is preferable for the ink to contain a penetrant liquid (or a substance that imparts a penetrating quality to the ink) from the standpoint of increasing the wettability of the ink with respect to the fabric and increasing the ability of the ink to penetrate. The amount of penetrant liquid contained should be set as appropriate, but the amount is preferably 2.0 to 15 percent by mass with respect to total mass of the ink. Examples of penetrating organic solvents that can be used include the following chemical compounds that are typically used as penetrating organic solvents in inks for inkjet textile printing: such lower alcohols as ethanol or propanol; such cellosolves as ethylene glycol monomethyl ether, ethylene glycol monoethyl ether, or ethylene glycol mono-n-butyl ether; such carbitols as diethylene glycol monomethyl ether, diethylene glycol monoethyl ether, or diethylene glycol-n-butyl ether; and such glycol ethers as triethylene glycol-n-methyl ether or triethylene glycol-n-butyl ether. It is also possible to use one or two or more selected from among these.

Additionally, from the same standpoint, it is preferable to add a penetrating surfactant to the ink as a penetrant liquid in addition to the penetrating organic solvent. The amount of penetrating surfactant added should be set as appropriate, but the amount is preferably 0.2 to 2.0 percent by mass with respect to total mass of the ink. Examples of penetrating surfactants that can be used include the following chemical compounds that are typically used as penetrating surfactants in inks for inkjet textile printing: fatty acid salts; such anionic surfactants as alkyl sulfate ester salts; such non-ionic surfactants as polyoxyethylene alkyl phenyl ether; such acetylene glycol based surfactants as 2,4,7,9-tetramethyl-5-decyne 4,7-diol, 3,6-dimethyl-4-octyne-3,6-diol, 3,5 dimethyl-1-hexyn-3-ol, 2,4-dimethyl-5-hexyn-3-ol; cationic surfactants; ambiionic surfactants; and polyorganosiloxane-based surfactants. It is also possible to use one or two or more selected from among these. It is also feasible to use a commercially available surfactant, e.g., such acetylene glycol based surfactants as Surfynol 61, 82, 104, 440, 465, and 485 (which are trade names of products made by Air Products and Chemicals, Inc.) and Olfine E1010, Olfine STG, and Olfine Y (which are trade names of products made by Nissin Chemical Industry Co., Ltd.).

The ink also contains water in addition to the aforementioned components. The water used is preferably a purified water or ultrapure water obtained by ion exchange, ultrafiltration, reverse osmosis, or distillation. It is also preferable for these waters to be sterilized by being irradiated with ultraviolet light or treated with a hydrogen peroxide additive to prevent mold and bacteria from growing over a long period of time. One or two or more of the following additives that are typically used in inks for inkjet textile printing can also be included as necessary: anti-mold agents, preservatives (e.g., Proxel XL-2), antioxidants, ultraviolet absorbers, chelating agents, oxygen absorbers, pH control agents (e.g., triethanolamine or other tertiary alkanolamine), and solubilizers.

A-2-2. Composition of Penetrant liquid

The penetrant liquid used in the inkjet printer 100 of this embodiment contains a penetrant liquid. The amount of penetrant liquid contained is set as appropriate, but the amount is preferably 10 to 30 percent by pass with respect to the total mass of the penetrant liquid. Examples of penetrant liquids include: such polyalcohols as ethylene glycol, diethylene glycol, triethylene glycol, polyethylene glycol, polypropylene glycol, proplylene glycol, butylene glycol, 1,2,6-hexantriol, thioglycol, hexylene glycol, glycerin, trimethylolethane, and trimethylolpropane; such alkyl ethers of polyalcohols as ethylene glycol monoethyl ether, ethylene glycol monobutyl ether, diethylene glycol monomethyl ether, diethylene glycol monoethyl ether, diethylene glycol monobutyl ether, diethylene glycol mono-isobutyl ether, diethylene glycol monohexyl ether, triethylene glycol monomethyl ether, triethylene glycol monoethyl ether, triethylene glycol monobutyl ether, hexaethylene glycol mono(ethylhexyl)ether (Newcol 1006 made by Nippon Nyukazai Co., Ltd.) and tetraethylene glycol mono(ethylhexyl) ether (Newcol 1006 made by Nippon Nyukazai Co., Ltd.); urea; 2-pyrrolidone; N-methyl-2-pyrrolidone; 1,3-dimethyl-2-imidazolidinone. It is also acceptable to use one or a combination of two or more of the following alkyl ethers of polyalcohols: triethylene glycol monobutyl ether, diethylene glycol monobutyl ether, diethylene glycol mono-isobutyl ether, triethylene glycol monomethyl ether, diethylene glycol mono-isobutyl ether, diethylene glycol monohexyl ether, hexaethylene glycol mono(ethylhexyl)ether, and tetraethylene glycol mono(ethylhexyl)ether.

At least a portion of these also functions as a humectant serving to improve the injection stability of the ink when it is ejected from the nozzles 43 of the ejection head 41 of the inkjet printer 100.

The penetrant liquid preferably contains a surfactant. The amount of surfactant contained should be set as appropriate, but the amount is preferably 0.1 to 3.0 percent by mass with respect to total mass of the penetrant liquid. Examples of surfactants that can be used include fatty acid salts; such anionic surfactants as alkyl sulfate ester salts; such non-ionic surfactants as polyoxyethylene alkyl phenyl ether; such acetylene glycol based surfactants as Surfynol 61, 82, 104, 440, 465, and 485 (which are trade names of products made by Air Products and Chemicals, Inc.) and Olfine E1010, Olfine STG, and Olfine Y (which are trade names of products made by Nissin Chemical Industry Co., Ltd; cationic surfactants; ambi-ionic surfactants; and such organopolysiloxane based surfactants as KF-353A, KF6017, X-22-6551, AW-3 (which are trade names of products made by Shin Etsu Chemical Co., Ltd.)

It is also acceptable if the penetrant liquid contains an organic amine to increase wettability of the fabric and improve penetration of the ink and to adjust the pH of the penetrant liquid with respect to the ink. It is preferable to use a tertiary amine as the organic amine, e.g., triethanolamine or other alkanolamine.

It is preferable for the penetrant liquid to contain a humectant from the perspective of improving the ejection stability of the ink ejected from the nozzles 43 of the ejection head 41 of the inkjet printer 100. The amount of humectant contained should be set as appropriate, but the amount is preferably 1.0 to 10 percent by mass with respect to total mass of the penetrant liquid. Examples of humectants that can be used include the following chemical compounds that are typically used as humectants in inkjet textile printing: such polyols as triethylene glycol, dipropylene glycol, 1,3-propanediol, 1,4-butandiol, 1,2-hexanediol, 1,5-pentanediol, 1,6-hexanediol, or pentaerythritol or an ether or ester derivative of any of these; such lactams as ϵ-caprolactam; such ureas as thiourea or ethylene urea; and such saccharides as maltitol, sorbitol, gluconolactone, or maltose. It is also possible to use one or two or more selected from among these.

The penetrant liquid also contains water in addition to the aforementioned components. The water used is preferably a purified water or ultrapure water obtained by ion exchange, ultrafiltration, reverse osmosis, or distillation. It is also preferable for these waters to be sterilized by being irradiated with ultraviolet light or treated with a hydrogen peroxide additive to prevent mold and bacteria from growing over a long period of time. One or two or more of the following additives that are typically used in penetrant liquids for inkjet textile printing can also be included as necessary: anti-mold agents, preservatives (e.g., Proxel XL-2), antioxidants, ultraviolet absorbers, chelating agents, and oxygen absorbers.

In this embodiment, the penetrant liquid functions to facilitate penetration of ink that has adhered to the fabric and is used to reduce a difference of image density between the printing surface and the non-printing surface on the opposite side. The effect of facilitating penetration of the ink is accomplished chiefly by the penetrant liquids and surfactants contained in the penetrant liquid. More specifically, due to the action of the penetrant liquids and the surfactants, the penetrant liquid functions to dissolve the coloring material of the ink adhered to the fabric and move the coloring material in a thickness direction of the fabric. That is, the penetrant liquid functions to dissolve the coloring material contained in the ink.

Meanwhile, when the ink used for printing in the inkjet printer 100 will be changed to a different type of ink, the ejection head 41 and the rest of the liquid supply system 50 is cleaned. As explained previously, the penetrant liquid used in the inkjet printer 100 of this embodiment has the function of dissolving the coloring material in the ink. Therefore, it can be used as a cleaning liquid for dissolving and cleaning ink coloring material that has adhered to the inside of the liquid supply system 50.

A-3. Printing Process

Figure 5:
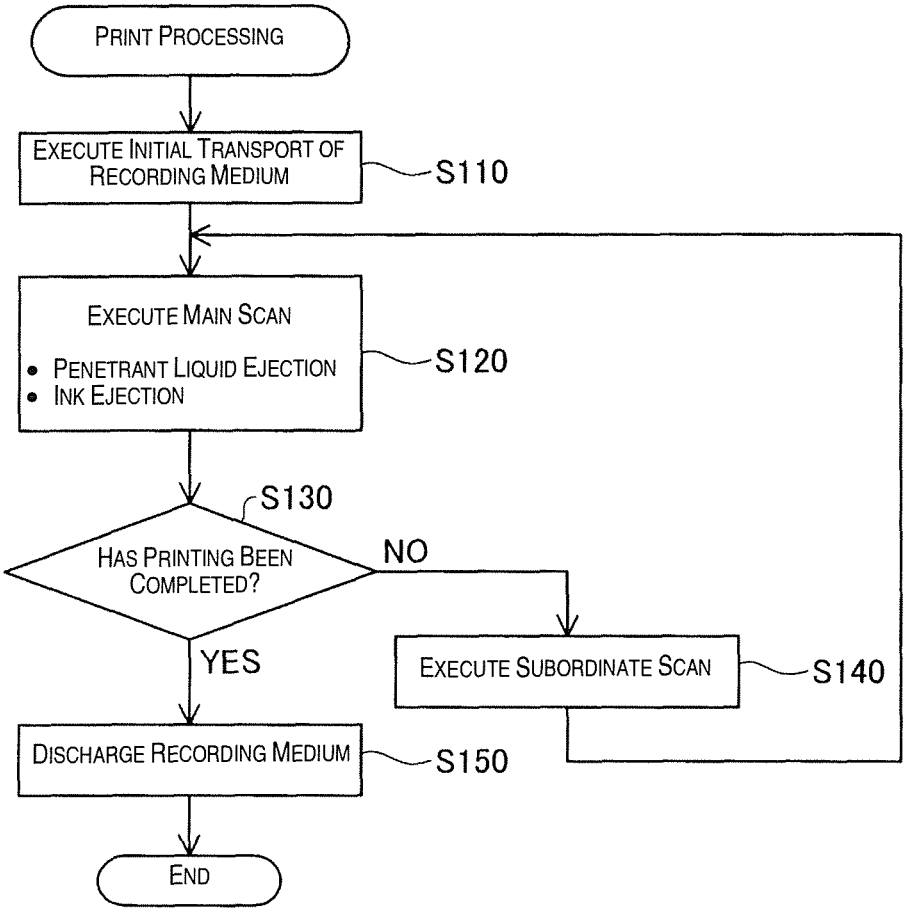
FIG. 5 is a flowchart showing steps of a printing process executed by the inkjet printer 100 according to the embodiment.

FIG. 5 is a flowchart showing steps of a printing process executed by the inkjet printer 100 according to the embodiment. The printing process is a process of using inkjet textile printing to record an image on a front surface (printing surface) of a fabric serving as a recording medium PM. In this embodiment, the control section 80 has image data expressing an image to be recorded and generates print data indicating an ink dot formation condition of each pixel to be printed based on the image data. The control section 80 executes the print process by controlling the parts of the inkjet printer 100 based on the print data.

First, the control section 80 controls the transport mechanism to execute an initial transport transporting the fabric serving as the recording medium PM to a recording start position (step S110). The control section 80 then controls the carriage drive system 20 and the liquid supply system 50 so as to move the carriage 22 along the main scanning direction Dc and while executing a main scan in which a textile printing liquid is ejected from the nozzle lines 45 of the ejection head 41 (step S120).

In the printing process of this embodiment, the penetrant liquid is ejected onto a printing surface of the fabric serving as the recording medium PM and, afterwards, the ink is ejected onto the same printing surface. Thus, during the main scan, the penetrant liquid is ejected using the one nozzle line 45 that is the closer to the recording medium PM of the two penetrant liquid nozzle lines 45 provided in the ejection head 41 (see FIG. 3) at the start of the main scan and the color inks are ejected from the nozzle lines 45 corresponding to the six colors of ink. The penetrant liquid is ejected onto a region of the fabric where the ink will be ejected. The penetrant liquid ejected is of a type that corresponds to the type of ink used (e.g., acidic ink or reactive ink). The penetrant liquid corresponding to the type of ink is a type of penetrant liquid that is established in advance as a penetrant liquid that can be used favorably with the type of ink used.

The printing process executed in this embodiment is bidirectional printing in which a main scan is executed in one direction along the main scan direction Dc of the carriage 22 and a main scan is executed along the opposite direction with textile printing liquids being ejected during the main scans along both directions. Since the two nozzle lines 45 for the penetrant liquid are arranged one each on opposite outsides of the nozzle lines 45 for the six colors of ink such that the nozzle lines 45 for the six colors are disposed in-between, ink can be ejected after the penetrant liquid is ejected regardless of which direction of main scan is being executed.

After the main scan, the control section 80 determines if the printing process has been completed (step S 130). If not, then the control section 80 executes a subordinate scan in which the recording medium PM is transported by a prescribed movement amount (step S140) and then executes a main scan. Afterwards, the control section 80 repeatedly executes subordinate scans and main scans until the printing process is completed. When the printing has been completed, the control section 80 discharges the recording medium PM (step S150) and ends the printing process.

With the printing process executed by the inkjet printer 100 of this embodiment, a penetrant liquid is ejected onto a printing surface of the fabric serving as the recording medium PM and ink is injected onto the same printing surface. Consequently, due to the action of the penetrant liquid adhered to the fabric, the coloring material of the ink adhered to the fabric is dissolved and penetration of the coloring material in a thickness direction of the fabric is facilitated such that a difference of image density between the printing surface and the non-printing surface on the opposite side. Thus, by executing inkjet printing onto the printing surface, print that is visible from both the printing surface and the non-printing surface can be accomplished.

More particularly, since the ejection head 41 of the inkjet printer 100 according to this embodiment is configured such that the nozzle lines 45 for the penetrant liquid are arranged closely adjacent to the nozzle lines 45 for the six colors of ink along the main scanning direction Dc, the ink can be ejected immediately after the penetrant liquid is ejected while the penetration effect is large. Thus, penetration of the adhered ink in the thickness direction of the fabric can be better facilitated and the difference of image density between the printing surface and the non-printing surface on the opposite side can be further reduced. Also, since ejection head 41 of the inkjet printer 100 according to this embodiment is configured such that the two nozzle lines 45 for the penetrant liquid are arranged one each on opposite outsides of the nozzle lines 45 for the six colors of ink such that the nozzle lines 45 for the six colors are disposed in-between, ink can be ejected immediately after the penetrant liquid is ejected and onto the same region of the fabric where the penetrant liquid was ejected regardless of which direction of main scan is being executed. Thus, the difference of image density between the printing surface and the non-printing surface on the opposite side can be further reduced while suppressing an increase of the time required for printing.

The fabric used as the recording medium PM for the printing process is preferably selected according to the type of ink that will be used. For example, when an acidic ink will be used for the printing process, the fabric used is made of, for example, an animal fiber or an amide based fiber or a mixed-spun fabric that contains at least one of these types of fiber. The fabric is preferably made of an amide based fiber, favorable examples including wool, silk, and nylon fibers.

Meanwhile, when a reactive ink will be used for the printing process, the fabric used is made of, for example, a vegetable fiber and preferably a cellulose based fiber. Preferred fabrics include fabrics made of cotton, hemp, rayon (viscose rayon or cuprammonium rayon), or polynosic fibers.

When a reactive ink will be used for the printing process, the fabric used is made of, for example, a fabric made of a synthetic fiber and or a mixed-spun fabric that includes a synthetic fiber. Preferably, a fabric made of polyester, acetate, or a mixture of these is used.

When a pigment ink will be used for the printing process, there are no particular limitations on the fabric used and it is acceptable to use fabrics made of, for example, animal fibers, amide fibers, vegetable fibers, cellulose based fibers, or synthetic fibers. Preferred fabrics include fabrics made of cotton, hemp, silk, polyester, or a mixture of these.

It is also acceptable to apply a pre-treatment to the fabric used as the recording medium PM in advance before executing the aforementioned printing process. The pre-treatment can serve to improve a dye affinity or suppress bleeding. The pre-treatment of the fabric can be accomplished using a publically known pre-treatment.

When acidic ink is used for the printing process, the pre-treatment typically includes application of a sizing agent, a hydrotropic agent, and a pH control agent. Silica can also be included depending on the situation. Examples of sizing agents that can be used include such natural gums as guar and locust bean; starches; sodium alginate; such seaweeds as sodium alginate and funori; such plant skin materials as pectic acid; such cellulose derivatives as methyl cellulose, ethyl cellulose, hydroxyethyl cellulose, and carboxymethyl cellulose; such modified starches as roasted starch, alpha starch, carboxymethyl starch, carboxyethyl starch, and hydroxyethyl starch; such modified natural gums as shiratsu gum and roast bean gum; algin derivatives; synthetic glues and emulsions of such materials as polyvinyl alcohol and polyacrylic acid ester. Such ammonium dihydrate salts as ammonium sulfate and ammonium tartrate are preferred examples of pH control agents Additionally, hydrotropic agents that can be used include such alkyl ureas as urea, dimethylurea, thiourea, monomethyl thiourea, and dimethyl thiourea. Typically, coating and padding are preferred methods of applying the pre-treatment to the fabric. For example, when padding is used, the pickup rate is determined as appropriate based on the thickness of the fabric and the side of the fibers, but the pickup rate is preferably 50% or higher and more preferably 65% or higher.

When reactive ink is used for the printing process, the pre-treatment typically includes application of a sizing agent, a hydrotropic agent, and an alkaline agent. Silica can also be included depending on the situation. Examples of sizing agents that can be used include such natural gums as guar and locust bean; starches; sodium alginate; such seaweeds as sodium alginate and funori; such plant skin materials as pectic acid; such cellulose derivatives as methyl cellulose, ethyl cellulose, hydroxyethyl cellulose, and carboxymethyl cellulose; such modified starches as roasted starch, alpha starch, carboxymethyl starch, carboxyethyl starch, and hydroxyethyl starch; such modified natural gums as shiratsu gum and roast bean gum; algin derivatives; synthetic glues and emulsions of such materials as polyvinyl alcohol and polyacrylic acid ester. Preferred examples of alkaline agents that can be used include sodium ash, sodium hydroxide, tertiary sodium phosphate, and sodium acetate, and a particularly preferred example is sodium bicarbonate. Additionally, hydrotropic agents that can be used include such alkyl ureas as urea, dimethylurea, thiourea, monomethyl thiourea, and dimethyl thiourea.

When disperse ink is used for the printing process, the pre-treatment typically includes application of a sizing agent, an acidifying agent, and a hydrotropic agent. A leveling agent or silica can also be included depending on the situation. Examples of sizing agents that can be used include such natural gums as guar and locust bean; starches; sodium alginate; such seaweeds as sodium alginate and funori; such plant skin materials as pectic acid; such cellulose derivatives as methyl cellulose, ethyl cellulose, hydroxyethyl cellulose, and carboxymethyl cellulose; such modified starches as roasted starch, alpha starch, carboxymethyl starch, carboxyethyl starch, and hydroxyethyl starch; such modified natural gums as shiratsu gum and roast bean gum; algin derivatives; synthetic glues and emulsions of such materials as polyvinyl alcohol and polyacrylic acid ester. Additionally, hydrotropic agents that can be used include such alkyl ureas as urea, dimethylurea, thiourea, monomethyl thiourea, and dimethyl thiourea. Examples of acidifying agents that can be used include citric acid, tartaric acid, and lactic acid.

After executing the printing process, it is preferable to execute a dye fixing process in which the fabric is heated and, if necessary, cleaned. The dye fixing process enables fixing of the dye to be improved and excess dye and pre-treatment agents to be removed.

When an acidic ink is used in the printing process, the dye fixing process can be accomplished by, for example, using a known steamer (e.g., steamer model DHe made by Mathis AG). More particularly, for example, steaming might be executed for 30 minutes at a temperature of 102° C. under a high humidity condition and afterwards a cleaning operation might be executed. More specifically, after rub-washing the fabric with tap water, the fabric is soaked in warm water having a temperature of approximately 50° C. and containing a nonionic soaping agent for approximately fifteen minutes while agitating occasionally. The bath ratio (printed fabric mass/bath mass) is preferably 1/50. Additionally, the fabric is rub-washed by hand as the tap water is put into the cleaning liquid. After the fabric has been washed thoroughly with water, the fabric is dried and ironed and a printed fabric is obtained.

When a reactive ink is used in the printing process, the dye fixing process can be accomplished by, for example, using a known steamer (e.g., steamer model DHe made by Mathis AG). More particularly, for example, steaming might be executed for ten minutes at a temperature of 102° C. under a high humidity condition and afterwards a cleaning operation might be executed. More specifically, after rub-washing the fabric with tap water, the fabric is soaked in warm water having a temperature of approximately 95° C. and containing a nonionic soaping agent for approximately fifteen minutes while agitating occasionally. The bath ratio (printed fabric mass/bath mass) is preferably 1/50. Additionally, the fabric is rub-washed by hand as the tap water is put into the cleaning liquid. After the fabric has been washed thoroughly with water, the fabric is dried and ironed and a printed fabric is obtained.

When a disperse ink is used in the printing process, the dye fixing process can be accomplished by, for example, using a known steamer (e.g., steamer model DHe made by Mathis AG). More particularly, for example, steaming might be executed for eight minutes at a temperature of 170° C. under a high humidity condition and afterwards a cleaning operation might be executed. More specifically, after rub-washing the fabric with tap water, the fabric is soaked in warm water having a temperature of approximately 85° C. and containing a nonionic soaping agent, sodium hydroxide, and sodium hydrosulfite for approximately ten minutes while agitating occasionally. The bath ratio (printed fabric mass/bath mass) is preferably 1/50. Additionally, the fabric is rub-washed by hand as the tap water is put into the cleaning liquid. After the fabric has been washed thoroughly with water, the fabric is dried and ironed and a printed fabric is obtained.

When a pigment ink is used in the printing process, the dye fixing process can be accomplished by, for example, using a known steamer (e.g., steamer model DHe made by Mathis AG). More particularly, for example, a heat treatment might be executed for five minutes at a temperature of 160° C.

A-4. Ink Change Process

FIGS. 6 to 11 schematically illustrate an ink changing process executed at the inkjet printer 100 of this embodiment. The ink changing process is a process for changing the ink used for printing to a different type of ink and is executed under the control of the control section 80. The ink changing process is executed when, for example, the recording medium PM is changed or when the image to be recorded is changed. An ink changing process executed when printing process will be executed using reactive ink (FIG. 11) after printing process is executed using acidic ink (see FIG. 4) will now be explained. The ink processing explained previously is executed using the reactive ink after the ink changing process is executed.

Figures 6A, 6B, 6C, 6D, 6E, 6F:
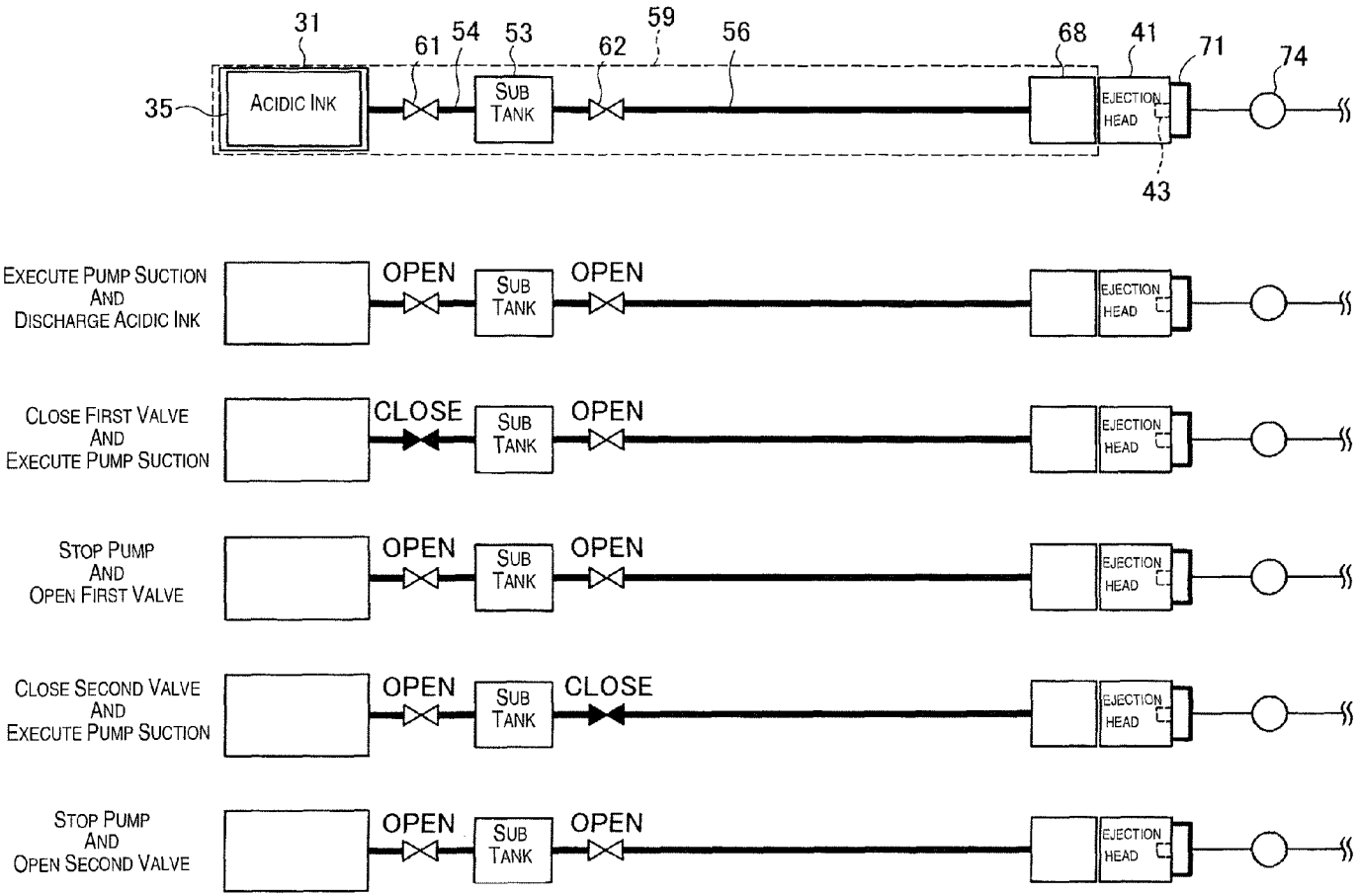
FIGS. 6A to 6F schematically illustrate an ink changing process executed at the inkjet printer 100 according to the embodiment.

FIG. 6A shows a state of a subordinate liquid supply system 59 corresponding to one ink color before the ink changing process. Before the ink changing process, an ink tank 35 containing the acidic ink is installed in the main tank 31 and both the first valve 61 and the second valve 62 are open. While the explanation that follows will focus on the ink changing process at the subordinate liquid supply system 59 corresponding to one color of ink, the process is the same for the other colors of ink.

First, as shown in FIG. 6A, the control section 80 moves the carriage 22 (FIG. 1) to the position of the capping unit 70 such that the cap 71 (FIG. 2) of the capping unit 70 touches against the nozzle face 42 of the ejection head 41 mounted on the carriage 22 and a sealed space is formed between the cap 71 and the nozzle 42.

Next, the control section 80 executes a process with respect to the subordinate liquid supply systems 59 (which is used for ejecting ink) such that the acidic ink inside the subordinate liquid supply system 59 is replaced with air. As shown in FIG. 6B, the control section 80 urges a user to remove the ink pack 35 from the main tank 31. When the ink pack 35 is removed, the first valve 61 remains open. However, if there is a possibility that ink will leak out from the first supply pipe 54, then it is acceptable to close the first valve 61 while the ink pack 35 is being removed and return the first valve 61 to an open state after the ink pack 35 has been removed.

After the ink pack 35 is removed, the control section 80 operates the suction pump 74 for a prescribed amount of time. The suction action of the suction pump causes a suction in the sealed space between the cap 71 and the nozzle face 42 of the ejection head 41 and in the nozzles 43 (FIG. 2), which communicate with the sealed space. This suction causes the acidic ink inside the subordinate liquid system 59 to be discharged. The discharged acidic ink is collected in the waste tank 72 via the discharge pipe 73 (see FIG. 2). Generally, however, it is difficult for this suction to completely discharge all of the acidic ink inside the subordinate liquid supply system 59, particularly the ink inside the sub tank 53 and the first supply pipe 54.

After the operation of the suction pump 74 is completed, the control section closes the first valve 61 and operates the suction pump 74 again, as shown in FIG. 6C. The suction operation of the suction pump 74 causes a negative pressure in a portion of the subordinate liquid supply system 59 on the ejection head 41 side of the first valve 61.

As shown in FIG. 6D, the control section 80 then stops operation of the suction pump 74 and opens the first valve 61. When the first valve 61 is opened, the pressure difference between atmospheric pressure and the negative pressure inside the subordinate liquid supply system 59 causes air to rush into the first supply pipe 54 from the main tank 31 and this flow of air causes acidic ink remaining in the first supply pipe 54, the sub tank 53, and the second supply pipe 56 to be discharged through the cap 71 to the discharge pipe 73. It is also acceptable for the opening of the first valve 61 to be performed before stopping the operation of the suction pump 74.

Next, as shown in FIG. 6E, the control section 80 closes the second valve 62 and operates the suction pump 74 again. The suction operation of the suction pump 74 causes a negative pressure in a portion of the subordinate liquid supply system 59 on the ejection head 41 side of the second valve 62.

Next, as shown in FIG. 6F, the control section 80 stops operation of the suction pump 74 and opens the second valve 62. When the second valve 62 is opened, the pressure difference between atmospheric pressure and the negative pressure inside the subordinate liquid supply system 59 causes air to rush into the first supply pipe 54 from the main tank 31 and this flow of air causes acidic ink remaining in the first supply pipe 54, the sub tank 53, and the second supply pipe 56 to be discharged through the cap 71 to the discharge pipe 73. It is also acceptable for the opening of the second valve 62 to be performed before stopping the operation of the suction pump 74.

With the process just explained, the acidic ink inside the subordinate liquid supply system 59 (which is used for ejecting ink) is replaced with air.

Figures 7A, 7B, 7C, 7D, 7E:
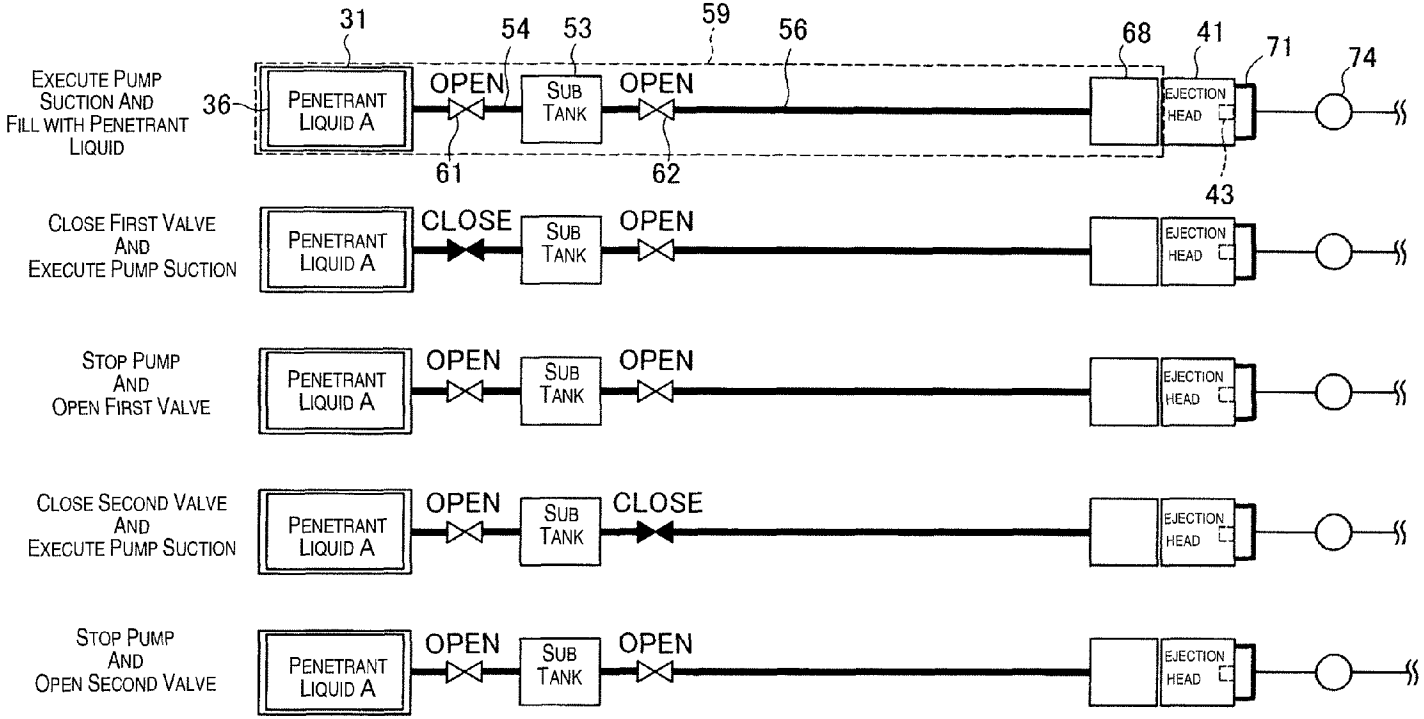
FIGS. 7A to 7E schematically illustrate an ink changing process executed at the inkjet printer 100 according to the embodiment.

Next, the control section 80 executes a process with respect to the subordinate liquid supply system 59 (which is used for ejecting ink) such that the air inside the subordinate liquid supply system 59 is replaced with a penetrant liquid. First, as shown in FIG. 7A, the control section 80 urges a user to install a penetrant liquid pack 36 containing the penetrant liquid into the main tank 31. The penetrant liquid pack 36 installed here is the same as the penetrant liquid packs 36 installed in the subordinate liquid supply systems 59 that are for ejecting penetrant liquid (see FIG. 4). In this embodiment, a penetrant liquid pack 36 containing the penetrant liquid A corresponding to the acidic inks is installed. As explained previously, the penetrant liquid used in this embodiment is a textile printing liquid that exhibits an action of dissolving the coloring material of ink adhered to the fabric and facilitating penetration of the ink and also exhibits a cleaning action with respect to the ink.

After the penetrant liquid pack 36 is installed, the control section 80 operates the suction pump 74 for a prescribed amount of time. The suction action of the suction pump causes a suction in the sealed space between the cap 71 and the nozzle face 42 of the ejection head 41 and in the nozzles 43 (FIG. 2), which communicate with the sealed space. At the same time, it is also acceptable to operate the supply pump 55. The suction will draw air out from the inside of the subordinate liquid supply system 59 and cause the penetrant liquid contained in the penetrant liquid pack 36 to flow into the subordinate liquid supply system 59. The penetrant liquid contained in the penetrant liquid pack 36 cleans the inside of the subordinate liquid supply system 59 as it flows through because the penetrant liquid has an ability to dissolve and clean the coloring material of the ink. Generally, however, it is difficult for this suction to completely discharge all of the air inside the subordinate liquid supply system 59, particularly the air inside the sub tank 53 and the second supply pipe 56, and air bubbles remain in the penetrant liquid.

After the operation of the suction pump 74 is completed, the control section closes the first valve 61 and operates the suction pump 74 again, as shown in FIG. 7B. The suction operation of the suction pump 74 causes a negative pressure in a portion of the subordinate liquid supply system 59 on the ejection head 41 side of the first valve 61.

As shown in FIG. 7C, the control section then stops operation of the suction pump 74 and opens the first valve 61. When the first valve 61 is opened, the pressure difference between atmospheric pressure and the negative pressure inside the subordinate liquid supply system 59 causes the penetrant liquid to rush into the first supply pipe 54 from the penetrant liquid tank 36 installed in the main tank 31, and this flow of penetrant liquid causes air remaining in the first supply pipe 54, the sub tank 53, and the second supply pipe 56 to be discharged. Also, the influx of penetrant liquid heightens the effect of cleaning the inside of the subordinate liquid supply system 59. It is also acceptable for the opening of the first valve 61 to be performed before stopping the operation of the suction pump 74.

Next, as shown in FIG. 7D, the control section 80 closes the second valve 62 and operates the suction pump 74 again. The suction operation of the suction pump 74 causes a negative pressure in a portion of the subordinate liquid supply system 59 on the ejection head 41 side of the second valve 62.

Next, as shown in FIG. 7E, the control section 80 stops operation of the suction pump 74 and opens the second valve 62. When the second valve 62 is opened, the pressure difference between atmospheric pressure and the negative pressure inside the subordinate liquid supply system 59 causes the penetrant liquid to rush into the first supply pipe 54 from the penetrant liquid tank 36 installed in the main tank 31, and this flow of penetrant liquid causes air remaining in the first supply pipe 54, the sub tank 53, and the second supply pipe 56 to be discharged. Also, the influx of penetrant liquid further heightens the effect of cleaning the inside of the subordinate liquid supply system 59.

Figure 8:
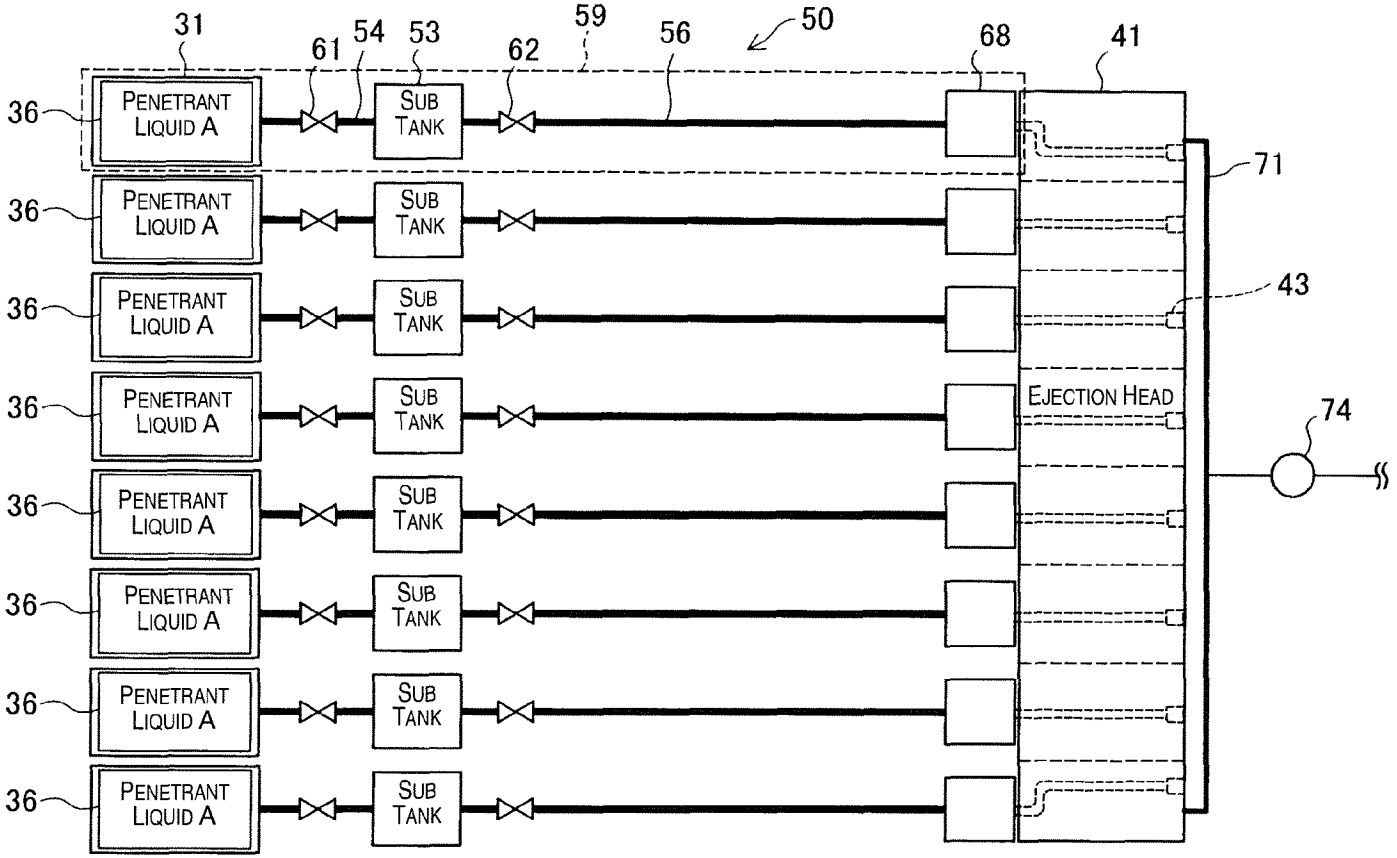
FIG. 8 schematically illustrates an ink changing process executed at the inkjet printer 100 according to the embodiment.

With the process just explained, the air inside the subordinate liquid supply system 59 (which is for ink ejection) is replaced with the penetrant liquid. As shown in FIG. 8, penetrant liquid packs 36 containing the penetrant liquid (penetrant liquid A) corresponding to the acidic ink are installed in all of the main tanks 31 of the liquid supply system 50 and all of the subordinate liquid supply systems 59 are filled with the penetrant liquid.

Figures 9A, 9B, 9C, 9D, 9E:
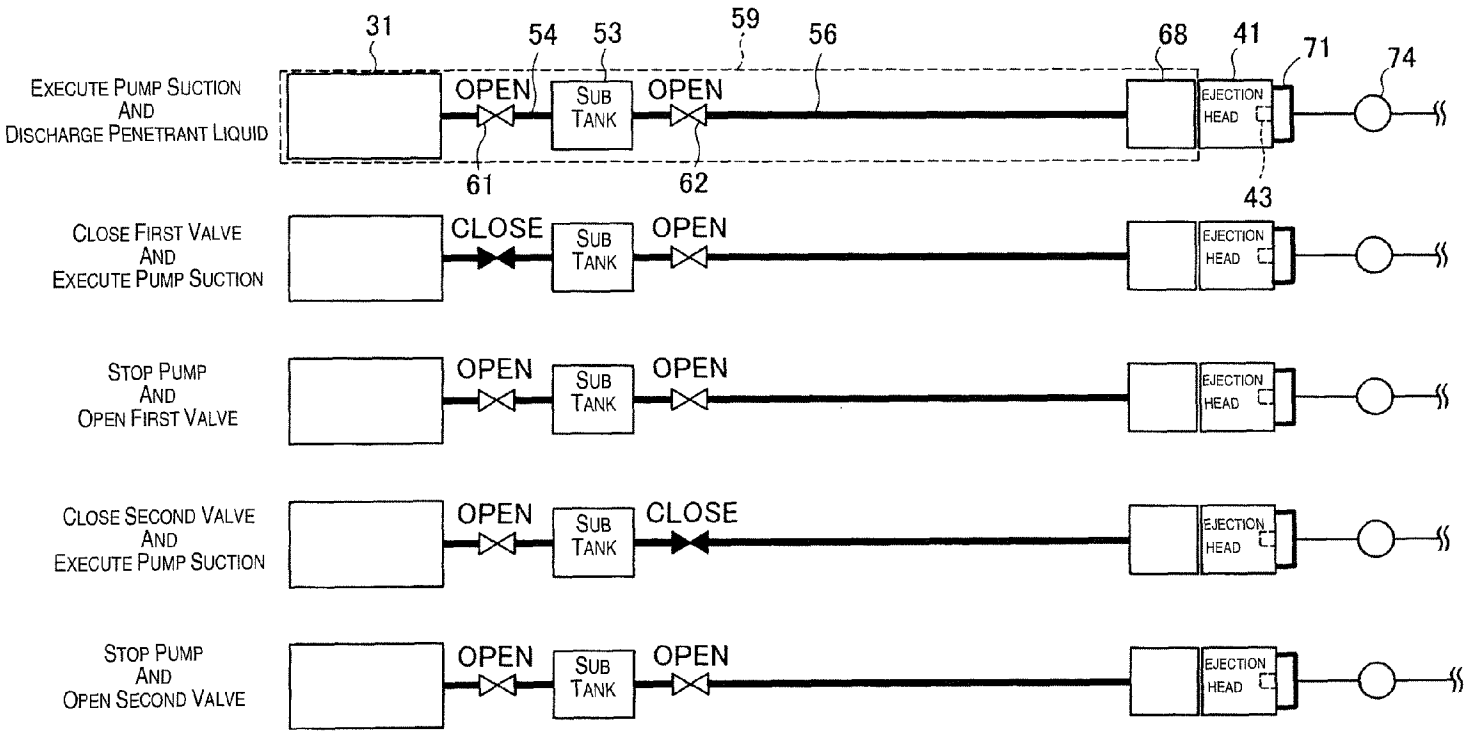
FIGS. 9A to 9E schematically illustrate an ink changing process executed at the inkjet printer 100 according to the embodiment.

Next, the control section 80 executes a process with respect to the subordinate liquid supply systems 59 that are used for ejecting ink and the subordinate liquid supply systems 59 that are used for ejecting the penetrant liquid such that the penetrant liquid inside the subordinate liquid supply system 59 is replaced with air. As shown in FIG. 9A, the control section 80 urges a user to remove the penetrant liquid pack 36 from each of the main tanks 31. When the penetrant liquid pack 36 is removed, the first valve 61 remains open. However, if there is a possibility that penetrant liquid will leak out from the first supply pipe 54, then it is acceptable to close the first valve 61 while the penetrant liquid pack 36 is being removed and return the first valve 61 to an open state after the penetrant liquid pack 36 has been removed.

After the penetrant liquid pack 36 is removed, the control section 80 operates the suction pump 74 for a prescribed amount of time. The suction action of the suction pump causes a suction in the sealed space between the cap 71 and the nozzle face 42 of the ejection head 41 and in the nozzles 43 (FIG. 2), which communicate with the sealed space. This suction causes the penetrant liquid inside the subordinate liquid system 59 to be discharged. The discharged penetrant liquid is collected in the waste tank 72 via the discharge pipe 73 (see FIG. 2). Generally, however, it is difficult for this suction to completely discharge all of the penetrant liquid inside the subordinate liquid supply system 59, particularly the penetrant liquid inside the sub tank 53 and the first supply pipe 54.

After the operation of the suction pump 74 is completed, the control section closes the first valve 61 and operates the suction pump 74 again, as shown in FIG. 9B. The suction operation of the suction pump 74 causes a negative pressure in a portion of the subordinate liquid supply system 59 on the ejection head 41 side of the first valve 61.

As shown in FIG. 9C, the control section then stops operation of the suction pump 74 and opens the first valve 61. When the first valve 61 is opened, the pressure difference between atmospheric pressure and the negative pressure inside the subordinate liquid supply system 59 causes air to rush into the first supply pipe 54 from the main tank 31 and this flow of air causes penetrant liquid remaining in the first supply pipe 54, the sub tank 53, and the second supply pipe 56 to be discharged through the cap 71 to the discharge pipe 73. It is also acceptable for the opening of the first valve 61 to be performed before stopping the operation of the suction pump 74.

Next, as shown in FIG. 9D, the control section 80 closes the second valve 62 and operates the suction pump 74 again. The suction operation of the suction pump 74 causes a negative pressure in a portion of the subordinate liquid supply system 59 on the ejection head 41 side of the second valve 62.

Next, as shown in FIG. 9E, the control section 80 stops operation of the suction pump 74 and opens the second valve 62. When the second valve 62 is opened, the pressure difference between atmospheric pressure and the negative pressure inside the subordinate liquid supply system 59 causes air to rush into the first supply pipe 54 from the main tank 31 and this flow of air causes penetrant liquid remaining in the first supply pipe 54, the sub tank 53, and the second supply pipe 56 to be discharged through the cap 71 to the discharge pipe 73. It is also acceptable for the opening of the second valve 62 to be performed before stopping the operation of the suction pump 74.

With the process just explained, the air inside the subordinate liquid supply systems 59 for ink ejection and the subordinate liquid supply systems 59 for penetrant liquid ejection is replaced with the penetrant liquid.

Figures 10A, 10B, 10C:
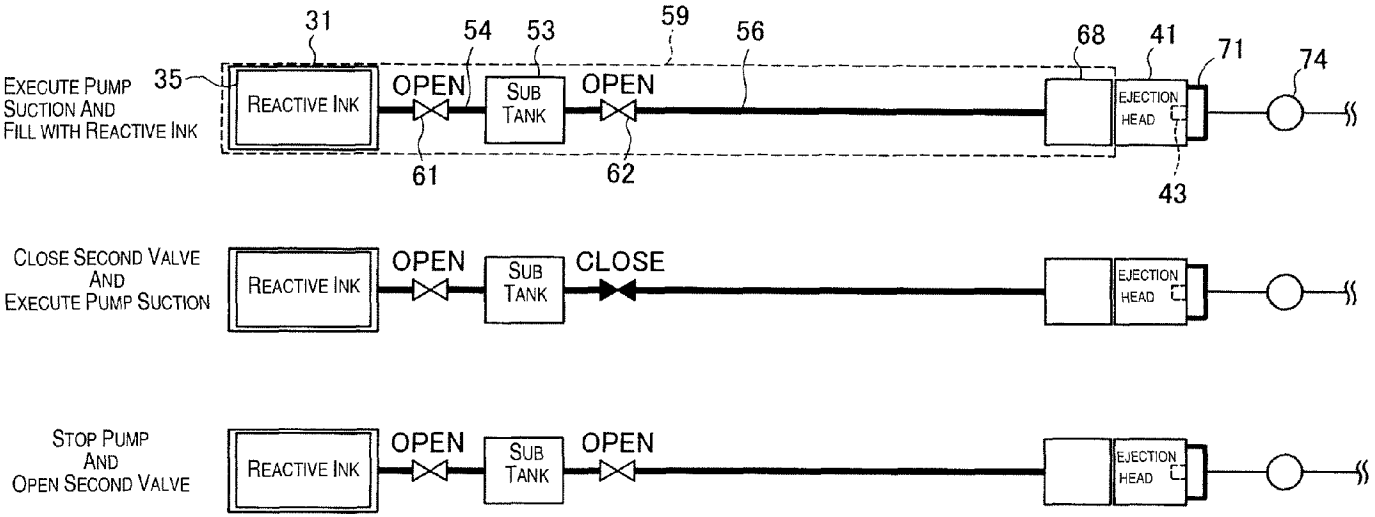
FIGS. 10A to 10C schematically illustrate an ink changing process executed at the inkjet printer 100 according to the embodiment.

Next, regarding the subordinate liquid supply systems 59 for ejecting ink, the control section 80 executes processing for replacing the air inside the subordinate liquid supply systems 59 with the reactive ink. Meanwhile, regarding the subordinate liquid supply systems 59 for ejecting penetrant liquid, the control section 80 executes processing for replacing the air inside the subordinate liquid supply systems 59 with the penetrant liquid. First, as shown in FIG. 10A, the control section 80 urges a user to install a ink pack 35 containing the reactive ink into the main tank 31 of each of the subordinate liquid supply systems 59 for ejecting ink. Similarly, although not shown in the drawings, the control section 80 urges the user to install a penetrant liquid pack 36 containing a penetrant liquid (penetrant liquid B) corresponding to the reactive ink into the main tank 31 of each of the subordinate liquid supply systems 59 for ejecting ink. A process executed to replace the air inside the subordinate liquid supply systems 59 for ejecting ink with the reactive ink will now be explained. The process executed to replace the air inside the subordinate liquid supply systems 59 for ejecting penetrant liquid with the penetrant liquid is similar.

After the ink pack 35 is installed, the control section 80 operates the suction pump 74 for a prescribed amount of time. The suction action of the suction pump causes a suction in the sealed space between the cap 71 and the nozzle face 42 of the ejection head 41 and in the nozzles 43 (FIG. 2), which communicate with the sealed space. At the same time, it is also acceptable to operate the supply pump 55. The suction will draw air out from the inside of the subordinate liquid supply system 59 and cause the reactive ink contained in the ink pack 35 to flow into the subordinate liquid supply system 59. Generally, however, it is difficult for this suction to completely discharge all of the air inside the subordinate liquid supply system 59, particularly the air inside the sub tank 53 and the second supply pipe 56, and air bubbles remain in the penetrant liquid.

After the operation of the suction pump 74 is completed, the control section closes the second valve 62 and operates the suction pump 74 again, as shown in FIG. 10B. The suction operation of the suction pump 74 causes a negative pressure in a portion of the subordinate liquid supply system 59 on the ejection head 41 side of the second valve 62.

As shown in FIG. 10C, the control section then stops operation of the suction pump 74 and opens the second valve 62. When the second valve 62 is opened, the pressure difference between atmospheric pressure and the negative pressure inside the subordinate liquid supply system 59 causes the reactive ink to rush into the first supply pipe 54 from the ink tank 35 installed in the main tank 31, and this flow of reactive ink causes air remaining in the first supply pipe 54, the sub tank 53, and the second supply pipe 56 to be discharged.

Figure 11:
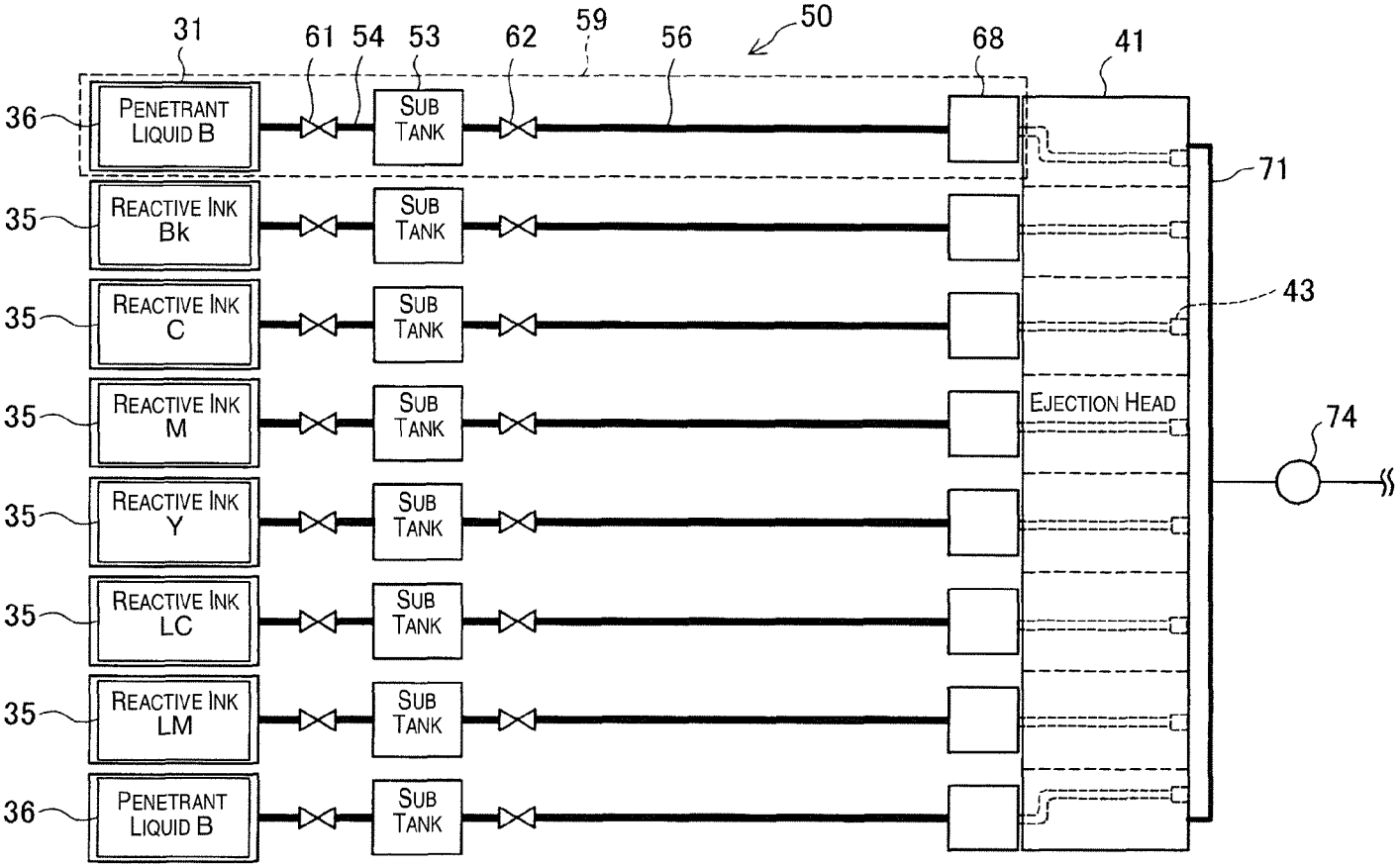
FIG. 11 schematically illustrates an ink changing process executed at the inkjet printer 100 according to the embodiment.

With the process just explained, the air inside the subordinate liquid supply systems 59 for ink ejection is replaced with the reactive ink. Similarly, the air inside the subordinate liquid supply systems 59 for penetrant liquid ejection is replaced with the penetrant liquid. In this way, as shown in FIG. 11, ink packs 35 containing the reactive inks of the different colors are installed into the main tanks 31 of the liquid supply system 50 that are for holding ink, and penetrant liquid packs 36 containing the penetrant liquid (penetrant liquid B) corresponding to the reactive inks are installed into the main tanks 31 that are for holding penetrant liquid.

With the previously explained ink changing process executed by the inkjet printer 100 of this embodiment, since the reactive ink and the penetrant liquid are made to rush into the subordinate liquid supply systems 59 when the air inside the subordinate liquid supply systems 59 is replaced with the reactive ink or the penetrant liquid, the air inside the subordinate liquid supply systems 59 can be discharged rapidly and effectively and the ink changeover can be accomplished rapidly and effectively. Also, when the air is replaced with the penetrant liquid to wash the insides of the subordinate liquid supply systems 59, since the penetrant liquid is made to rush into the subordinate liquid supply systems 59, the effect of cleaning the insides of the subordinate liquid supply systems 59 can be heightened and the cleaning efficiency can be improved.

With the inkjet printer 100 of this embodiment, since the penetrant liquid ejected onto the recording medium PM during inkjet textile printing can also be used to wash the inside of the subordinate liquid supply systems 59, the apparatus can be made less complex and more compact than an apparatus in which a penetrant liquid and a cleaning liquid are prepared separately. Also, the number of types of textile printing liquids required can be reduced.

A-5. Evaluation Test

In the inkjet printer 100 of this embodiment, inkjet textile printing tests and tests of cleaning the liquid supply system 50 were conducted and evaluated using each of the inks and penetrant liquids. FIGS. 12 to 16 illustrate example compositions of textile printing liquids (inks and penetrant liquids) used in evaluation tests.

FIG. 12 shows compositions (in units of percent by mass) of the different colors of acidic ink. As shown in FIG. 12, each color of acidic ink substantially comprises the corresponding color of acidic dye; glycerin, diethylene glycol, triethylene glycol monobutyl ether, and 2-pyrrolidone functioning as humectants and/or penetrant liquids; Olfine E1010 functioning as a surfactant; triethanol amine functioning as a pH control agent; Proxel XL-2 functioning as a preservative; and ultrapure water.

FIG. 13 shows compositions (in units of percent by mass) of the different colors of reactive ink. As shown in FIG. 13, each color of reactive ink substantially comprises the corresponding color of acidic dye; propylene glycol, 1,2 hexanediol, urea, and 2-pyrrolidone functioning as humectants and/or penetrant liquids; Olfine E1010 functioning as a surfactant; triethanol amine functioning as a pH control agent; Proxel XL-2 functioning as a preservative; and ultrapure water.

FIG. 14 shows compositions (in units of percent by mass) of the different colors of disperse ink. As shown in FIG. 14, each color of acidic ink substantially comprises the corresponding color of acidic dye; glycerin, triethylene glycol, and triethylene glycol monomethyl ether functioning as humectants and/or penetrant liquids; Olfine E1010 functioning as a surfactant; triethanol amine functioning as a pH control agent; Proxel XL-2 functioning as a preservative; and ultrapure water.

FIG. 15 shows compositions (in units of percent by mass) of the different colors of pigment ink. As shown in FIG. 15, each color of acidic ink substantially comprises the corresponding color of acidic dye; glycerin, triethylene glycol, and triethylene glycol monobutyl ether functioning as humectants and/or penetrant liquids; Olfine E1010 functioning as a surfactant; triethanol amine functioning as a pH control agent; Proxel XL-2 functioning as a preservative; and ultrapure water.

FIG. 16 shows compositions (in units of percent by mass) of eight penetrant liquids P1 to P8. The penetrant liquids P1 and P2 both substantially comprise glycerin, diethylene glycol, triethylene glycol monobutyl ether, and 2-pyrrodoline functioning as penetrant liquids (or as penetrant liquids and humectants); Olfine E1010 functioning as a surfactant; and ultrapure water. The ingredients contained in the penetrant liquids P1 and P2 are substantially the same except that the content amounts of 2-pyrrodoline and ultrapure water are different. The main ingredients of the penetrant liquids P1 and P2 are the same as the ingredients in the compositions of the acidic inks shown in FIG. 12 except without the acidic dyes. It can also be said the penetrant liquids P1 and P2 have as main ingredients solvents that are common to all of the colors of acidic ink shown in FIG. 12.

The penetrant liquids P3 and P4 both substantially comprise propylene glycol, 1,2, hexanediol, urea, and 2-pyrrodoline functioning as penetrant liquids (or as penetrant liquids and humectants); Olfine E1010 functioning as a surfactant; and ultrapure water. The ingredients contained in the penetrant liquids P3 and P4 are substantially the same except that the content amounts of 2-pyrrodoline and ultrapure water are different. The main ingredients of the penetrant liquids P3 and P4 are the same as the ingredients in the compositions of the reactive inks shown in FIG. 13 except without the reactive dyes. It can also be said the penetrant liquids P3 and P4 have as main ingredients solvents that are common to all of the colors of acidic ink shown in FIG. 13.

The penetrant liquids P5 and P6 both substantially comprise glycerin, triethylene glycol, and triethylene glycol monomethyl ether functioning as penetrant liquids (or as penetrant liquids and humectants); Olfine E1010 functioning as a surfactant; and ultrapure water. The ingredients contained in the penetrant liquids P5 and P6 are substantially the same except that the content amounts of triethylene glycol and ultrapure water are different. The main ingredients of the penetrant liquids P5 and P6 are the same as in the compositions of the disperse inks shown in FIG. 14 except for the disperse dyes. It can also be said the penetrant liquids P5 and P6 have as main ingredients solvents that are common to all of the colors of acidic ink shown in FIG. 14.

The penetrant liquids P7 and P8 both substantially comprise glycerin, triethylene glycol, and triethylene glycol monobutyl ether functioning as penetrant liquids (or as penetrant liquids and humectants); Olfine E1010 functioning as a surfactant; and ultrapure water. The ingredients contained in the penetrant liquids P7 and P8 are substantially the same except that the content amounts of triethylene glycol and ultrapure water are different. The main ingredients of the penetrant liquids P7 and P8 are the same as the ingredients in the compositions of the acidic inks shown in FIG. 15 except for the pigment dyes. It can also be said the penetrant liquids P7 and P8 have as main ingredients solvents that are common to all of the colors of acidic ink shown in FIG. 15.

FIG. 17 shows evaluation test results. The evaluation test involves executing inkjet textile printing using each combination of the inks and the penetrant liquids and evaluating the print in terms of three categories: front-back density difference, bleeding, and cleaning performance. The test conditions will now be explained.

Regarding the acidic inks, the fabric used was a silk fabric that had a mass per unit area of 53 g/m$^2$ and had been subjected to a padding treatment as a pretreatment using a pretreatment agent comprising 2.0 percent by mass of guar gum (Meypro Gum NP made by Sansho Co., Ltd.), 10.0 percent by mass of urea, 4.0 percent by mass of ammonium sulfate, and 84.0 percent by mass of water. The padding treatment was conducted in a padder (horizontal/vertical padder HVF350 made by Mathys) with a squeeze rate of 80%. An inkjet printer (PX-G930 made by Seiko Epson Corp.) was used to print onto the silk using black, yellow, magenta, and cyan acidic inks and a penetrant liquid P1. This printer can print with up to eight colors using 180 nozzles per color at a resolution of 5760 dpi (in head movement direction)×1440 dpi (in arrangement direction of the 180 nozzles per color). However, the test printing was conducted using 180 nozzles each for the colors cyan, magenta, yellow, and black and for the penetrant liquid P1 (the nozzles corresponding to five of the eight colors were used and the nozzles corresponding to the remaining three colors were not used) at a resolution of 720 dpi (in head movement direction)×1440 dpi (in arrangement direction of the 180 nozzles per color). Characters and outline characters (formed by printing an entire region excluding where the character is to be with the respective color of ink to create blank space having the shape of the character) were printed at 720 dpi (in head movement direction)×1440 dpi (arrangement direction of 180 nozzles for each color). Simultaneously, the penetrant liquid P1 is printed over the entire surface (with a coating amount per unit surface area of the fabric of 20 mg/inch$^2$) at the same resolution of 1440×720 dpi such that the penetrant liquid overlies the characters and outline characters. Similar printing was conducted using the penetrant liquids P2 to P8 (i.e., the penetrant liquids P2 to P8 were used instead of the penetrant liquid P1). Regarding the reactive inks, the fabric used was a cotton fabric that had a mass per unit area of 122 g/m$^2$ and had been subjected to a padding treatment using a pretreatment agent comprising 2.0 percent by mass of guar gum, 10.0 percent by mass of urea, 5.0 percent by mass of sodium bicarbonate, 1.0 percent by mass of silica, and 82.0 percent by mass of water. Printing was conducted using each of the penetrant liquids P1 to P8 in the same manner as for the acidic inks already explained. Regarding the disperse inks, the fabric used was polyester fabric that had a mass per unit area of 120 g/m$^2$ and had been subjected to a padding treatment using a pretreatment agent comprising 2.0 percent by mass of guar gum, 10.0 percent by mass of urea, 2.0 percent by mass of citric acid, and 86.0 percent by mass of water. Printing was conducted using each of the penetrant liquids P1 to P8 in the same manner as for the acidic inks already explained.

Regarding the pigment inks, the fabric used was cotton having a mass per unit area of 122 g/m$^2$, and printing was conducted using each of the penetrant liquids P1 to P8 in the same manner as for the acidic inks already explained Test pieces of the fabric printed with the acidic inks and each of the penetrant liquids were prepared by steaming the fabric in a steamer (Steamer DHe made by Mathys) at 102° C. for thirty minutes to fix the print. The fabric was then washed for ten minutes at 55° C. using an aqueous solution containing 0.2% of Laccol STA (made by Meisei Chemical Works, Ltd.) and dried. Test pieces of the fabric printed with the reactive inks and each of the penetrant liquids were prepared by steaming the fabric in a steamer (Steamer DHe made by Mathys) at 102° C. for ten minutes to fix the print. The fabric was then washed for ten minutes at 95° C. using an aqueous solution containing 0.2% of Laccol STA (made by Meisei Chemical Works, Ltd.) and dried. Test pieces of the fabric printed with the disperse inks and each of the penetrant liquids were prepared by steaming the fabric in a steamer (Steamer DHe made by Mathys) at 170° C. for eight minutes to fix the print. The fabric was then washed for ten minutes at 85° C. using sodium an aqueous solution containing Laccol STA (made by Meisei Chemical Works, Ltd.) at 0.2%, sodium hydroxide at 0.2%, and sodium hydrosulfite at 0.2%, and dried. Test pieces of the fabric printed with the pigment inks and each of the penetrant liquids were prepared by heat-treating the fabric in a steamer (Steamer DHe made by Mathys) at 160° C. for five minutes to fix the print.

The evaluation of the density difference between front and back is determined by visually observing the difference in density between a front surface (printing surface) and a back surface (non-printing surface) of a fabric (test piece) on which an image has been printed by inkjet textile printing. The evaluation standards were as follows:

○ (circle): No density difference observed between front and back surfaces

Δ (triangle): Slight density difference observed between front and back surfaces × (cross mark): Large density difference observed between front and back surfaces The evaluation of bleeding was conducted by visually inspecting an edge portion of a printed region of a fabric (test piece) that has been printed by inkjet textile printing. The evaluation standards were as follows:

◎ (double circle): No bleeding was observed

○ (circle): Trace of bleeding was observed

Δ (triangle): Some bleeding was observed

× (cross mark): Sever bleeding

The evaluation of cleaning performance was conducted by using each of the penetrant liquids to clean the nozzles of the ejection head and the ink supply passages from states in which they are filled with each of the ink sets. If the ejection head was cleaned effectively, an evaluation was conducted to determine if nozzle clogging occurred during printing after the ink changing process was executed. The evaluation was made in terms of the standards shown below based on whether there was no nozzle clogging at all or how many cleaning operations were required until ejection from all of the nozzles was possible to indicate whether the nozzle clogging recovery performance was good.

◎ (double circle): No nozzle clogging at all

○ (circle): Recovered from nozzle clogging with one cleaning

Δ (triangle): Recovered from nozzle clogging with two to five cleaning

× (cross mark): Six or more cleanings required to recover from nozzle clogging

As shown in FIG. 17, high scores were obtained for all evaluation categories when the penetrant liquids P1 and P2 were used with the acidic inks. As explained previously, the penetrant liquids P1 and P2 have as main ingredients the same ingredients as the acidic inks but with the acidic dyes removed or have as main ingredients solvents that are common to all of the colors of acidic ink. By using penetrant liquids having as main ingredients the same ingredients as the acidic inks but with the acidic dyes removed or having as main ingredients solvents that are common to all of the colors of acidic ink, the difference of image density between the printing surface and the non-printing surface after inkjet printing can be reduced satisfactorily while suppressing bleeding of the image. Additionally, the ejection head 41 and the rest of the liquid supply system 50 can be cleaned satisfactorily with the penetrant liquid and the apparatus can be prevented from becoming larger and more complex. Also, by using such a penetrant liquid, sufficient penetration can be achieved with a smaller amount of penetrant liquid and sufficient cleaning can be achieved with a smaller amount of penetrant liquid. Consequently, the main tanks 31 and the waste tanks 72 can be made smaller and the apparatus can be made smaller. High scores were also obtained for all evaluation categories when the penetrant liquids P3 and P4 were used with the acidic inks. Although the effect of reducing the difference of image density between the printing surface and the non-printing surface is somewhat degraded, image bleeding can be suppressed and the ejection head 41 and the rest of the liquid supply system 50 can be cleaned satisfactorily with the penetrant liquid.

Meanwhile, high scores were obtained for all evaluation categories when the penetrant liquids P3 and P4 were used with the reactive inks. As explained previously, the penetrant liquids P3 and P4 have as main ingredients the same ingredients as the reactive inks but with the reactive dyes removed or have as main ingredients solvents common to all of the colors of reactive ink. By using penetrant liquids having as main ingredients the same ingredients as the reactive inks but with the reactive dyes removed or having as main ingredients solvents that are common to all of the colors of reactive ink, the difference of image density between the printing surface and the non-printing surface after inkjet printing can be reduced satisfactorily while suppressing bleeding of the image. Additionally, the ejection head 41 and the rest of the liquid supply system 50 can be cleaned satisfactorily with the penetrant liquid and the apparatus can be prevented from becoming larger and more complex. Also, by using such a penetrant liquid, sufficient penetration can be achieved with a smaller amount of penetrant liquid and sufficient cleaning can be achieved with a smaller amount of penetrant liquid. Consequently, the main tanks 31 and the waste tanks 72 can be made smaller and the apparatus can be made smaller. High scores were also obtained for all evaluation categories when the penetrant liquids P1 and P2 were used with the acidic inks. Although the effect of reducing the difference of image density between the printing surface and the non-printing surface is somewhat degraded, image bleeding can be suppressed and the ejection head 41 and the rest of the liquid supply system 50 can be cleaned satisfactorily with the penetrant liquid.

Meanwhile, high scores were obtained for all evaluation categories when the penetrant liquids P5 and P6 were used with the disperse inks. As explained previously, the penetrant liquids P5 and P6 have as main ingredients the same ingredients as the disperse inks but with the disperse dyes removed or have as main ingredients solvents common to all of the colors of disperse ink. By using penetrant liquids having as main ingredients the same ingredients as the disperse inks but with the disperse dyes removed or having as main ingredients solvents that are common to all of the colors of disperse ink, the difference of image density between the printing surface and the non-printing surface after inkjet printing can be reduced satisfactorily while suppressing bleeding of the image. Additionally, the ejection head 41 and the rest of the liquid supply system 50 can be cleaned satisfactorily with the penetrant liquid and the apparatus can be prevented from becoming larger and more complex. Also, by using such a penetrant liquid, sufficient penetration can be achieved with a smaller amount of penetrant liquid and sufficient cleaning can be achieved with a smaller amount of penetrant liquid. Consequently, the main tanks 31 and the waste tanks 72 can be made smaller and the apparatus can be made smaller. High scores were also obtained for all evaluation categories when the penetrant liquids P7 and P8 were used with the disperse inks. Although the effect of reducing the difference of image density between the printing surface and the non-printing surface is somewhat degraded, image bleeding can be suppressed and the ejection head 41 and the rest of the liquid supply system 50 can be cleaned satisfactorily with the penetrant liquid.

Relatively high scores were obtained for all evaluation categories when the penetrant liquids P7 and P8 were used with the pigment inks, although the effect of decreasing the image density difference between the printing surface and the non-printing surface is somewhat low. As explained previously, the penetrant liquids P7 and P8 have as main ingredients the same ingredients as the pigment inks but with the pigment dyes removed or have as main ingredients solvents common to all of the colors of pigment ink. By using penetrant liquids having as main ingredients the same ingredients as the pigment inks but with the pigment dyes removed or having as main ingredients solvents that are common to all of the colors of pigment ink, the difference of image density between the printing surface and the non-printing surface after inkjet printing can be reduced satisfactorily while suppressing bleeding of the image. Additionally, the ejection head 41 and the rest of the liquid supply system 50 can be cleaned satisfactorily with the penetrant liquid and the apparatus can be prevented from becoming larger and more complex. Also, by using such a penetrant liquid, sufficient penetration can be achieved with a smaller amount of penetrant liquid and sufficient cleaning can be achieved with a smaller amount of penetrant liquid. Consequently, the main tanks 31 and the waste tanks 72 can be made smaller and the apparatus can be made smaller.

B. Second Embodiment

Figure 18:
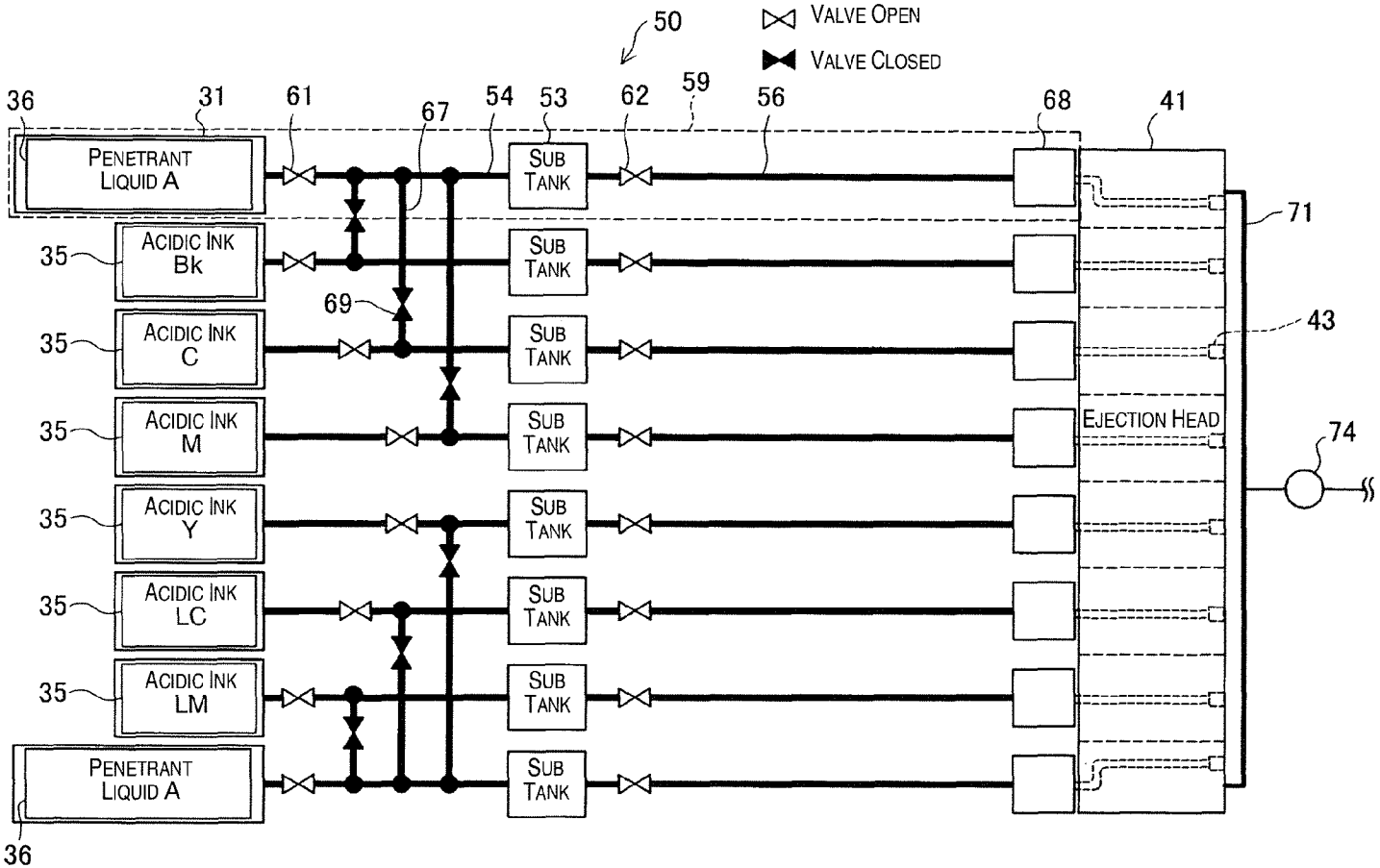
FIG. 18 schematically illustrates constituent features of a liquid supply system 50 according to a second embodiment.

FIG. 18 schematically illustrates constituent features of a liquid supply system 50 according to a second embodiment. The liquid supply system 50 of the second embodiment has bypass pipes 67 connecting from positions between the first valve 61 and the sub tank 53 of the first supply pipes 54 of the subordinate liquid supply systems 59 for penetrant liquid to positions between the first valve 61 and the sub tank 53 of the first supply pipes 54 of the subordinate liquid supply systems 59 for the different colors of ink. In the example shown in FIG. 18, the first supply pipes 54 for the black (Bk), cyan (C), and magenta (M) inks are connected with bypass pipes 67 to one of the first supply pipes 54 for the penetrant liquid, and the first supply pipes 54 for the yellow (Y), the light cyan (LC), and the light magenta (LM) inks are connected with bypass pipes 67 to the other first supply pipe 54 for the penetrant liquid. Each of the bypass pipes 67 is equipped with a third valve 69 that opens and closes the bypass pipe 67. The third valves 69 are closed during normal operation (during textile printing). Also, the volume of the penetrant liquid packs 36 is larger than the volume of the ink packs 35. Otherwise, the constituent features of the liquid supply system 50 are the same as in the first embodiment illustrated in FIG. 4. The flow passages formed by the bypass pipes 67 correspond to the third flow passage mentioned in the claims.

In the situation shown in FIG. 18, ink packs 35 containing acidic inks of the respective colors are installed in the main tanks 31 of the subordinate liquid supply systems 59 for the inks, and penetrant liquid packs 36 containing the penetrant liquid A corresponding to acidic inks are installed in the main tanks 31 of the subordinate liquid supply systems 59 for the penetrant liquid. The first valves 61 and the second valves 62 are all open. Consequently, similarly to the first embodiment, in the second embodiment a printing process can be executed that ejects a penetrant liquid onto a printing surface of a fabric serving as the recording medium PM and then ejects ink onto the same printing surface.

Figure 19:
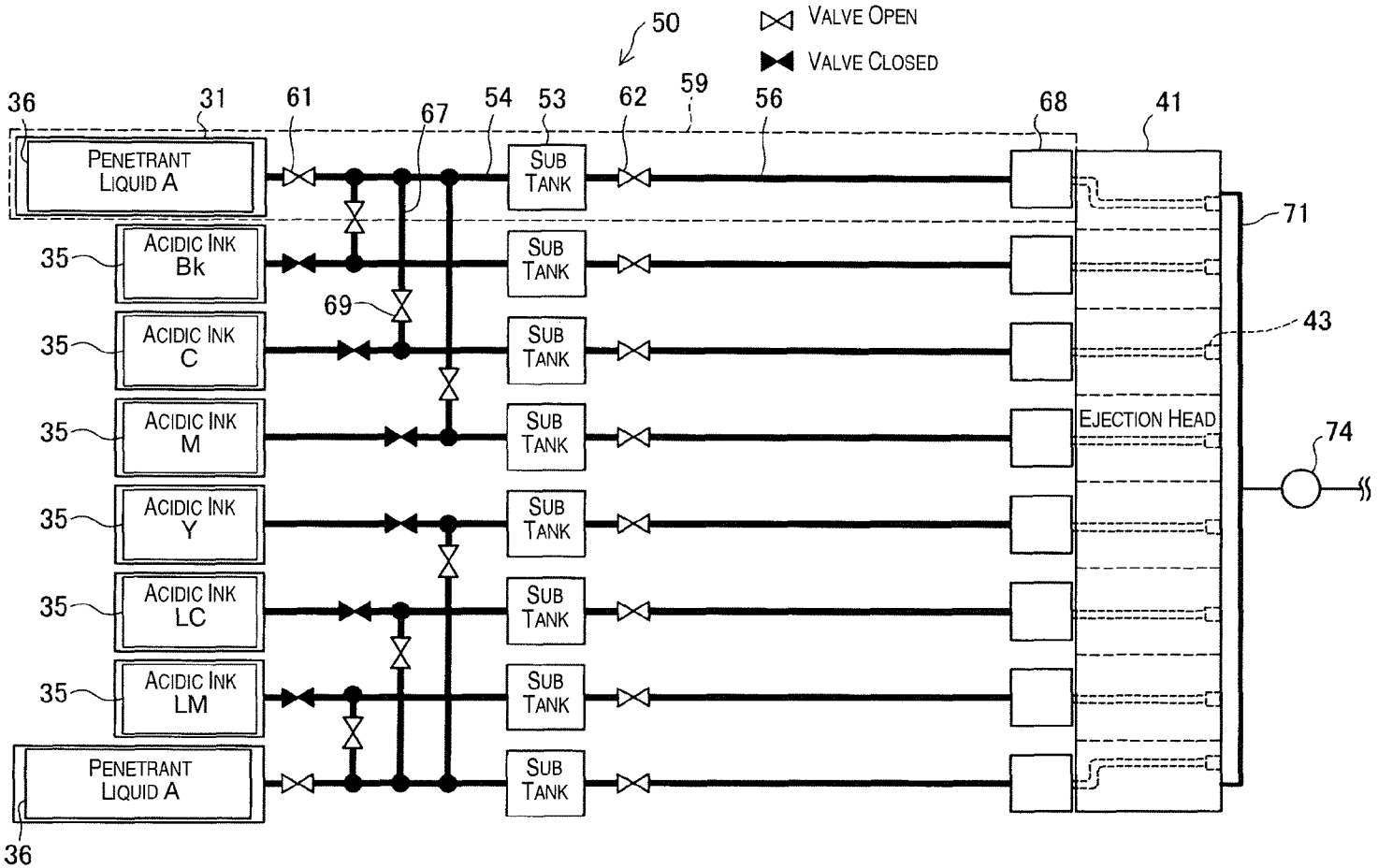
FIG. 19 schematically illustrates an ink changing process executed at the inkjet printer 100 according to the second embodiment.
Figure 20:
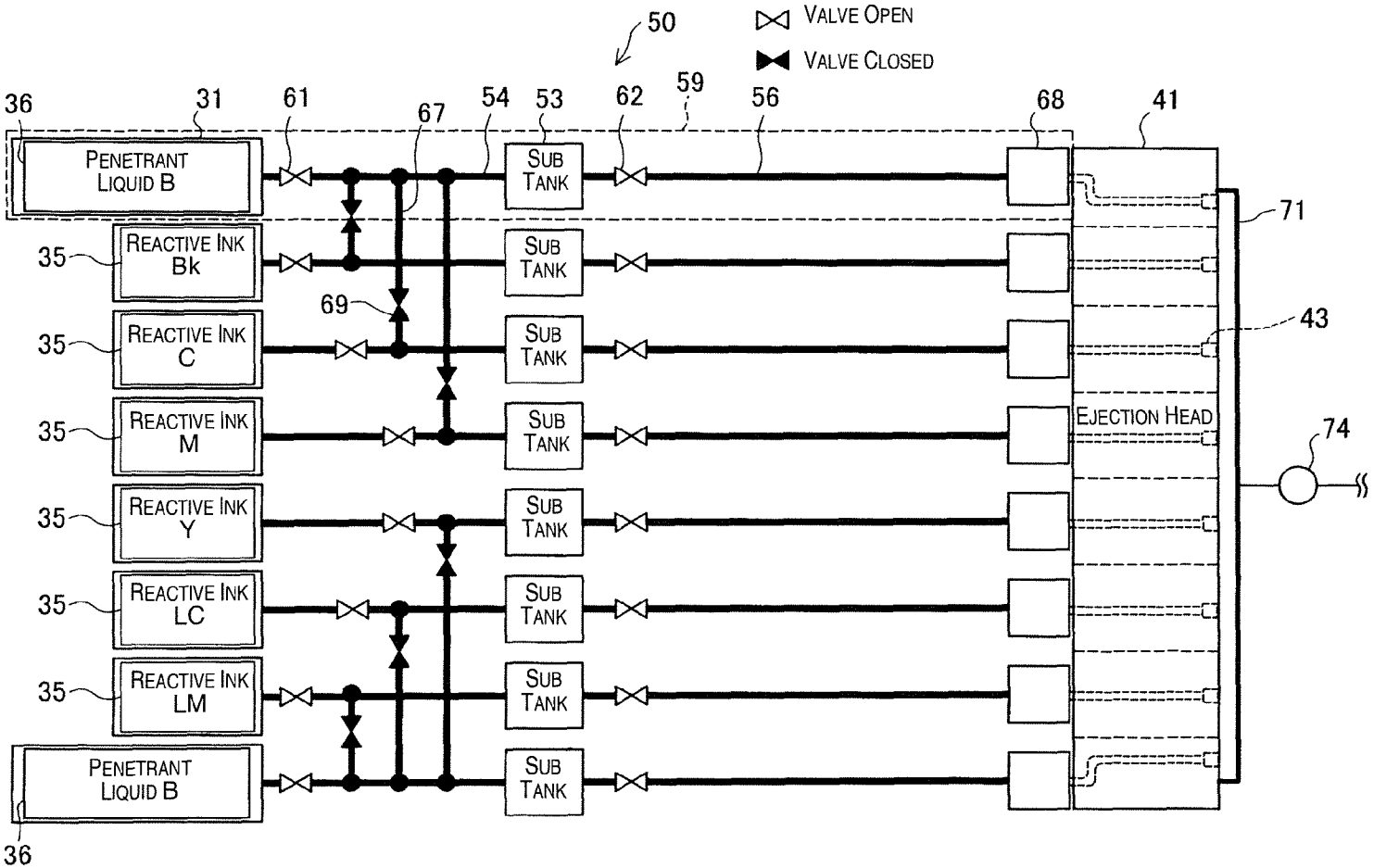
FIG. 20 schematically illustrates an ink changing process executed at the inkjet printer 100 according to the second embodiment.

FIGS. 19 to 20 schematically illustrate an ink changing process executed at the inkjet printer 100 of the second embodiment. The ink changing process is the same in the second embodiment as in the first embodiment. That is, when changing over from acidic ink (FIG. 18) to reactive ink (FIG. 20), first the acidic ink inside the sub liquid supply systems 59 is replaced with air (see FIG. 11).

Next, when the air inside the subordinate liquid supply systems 59 is replaced with the penetrant liquid, in the first embodiment the penetrant liquid comes from penetrant liquid packs 36 installed in the main tanks 31 of the subordinate liquid supply systems 59 for ink ejection while in the second embodiment the penetrant liquid comes from the penetrant liquid packs 36 installed in the main tanks 31 of the subordinate liquid supply systems 59 for ejecting penetrant liquid. That is, as shown in FIG. 19, the first valves 61 of the subordinate liquid supply systems 59 for ejecting inks are closed, the third valves 69 of the bypass pipes 67 are opened, and the suction pump 74 is operated to produce suction. As a result, the penetrant liquid contained in the penetrant liquid packs 36 installed in the main tanks 31 of the subordinate liquid supply systems 59 for ejecting penetrant liquid is supplied to the inside of the subordinate liquid supply systems 59 for ejecting ink and the air inside the subordinate liquid supply systems 59 is replaced with the penetrant liquid. When this is done, similarly to the first embodiment, it is acceptable to close the second valves 62 and the third valves 69 and operate the pump suction to generate a negative pressure inside the subordinate liquid supply systems 59 such that the penetrant liquid rushes into the subordinate liquid supply systems 59.

After the air inside the subordinate liquid supply systems 59 for ejecting ink has been replaced with the penetrant liquid, the third valves 69 provided in the bypass pipes 67 are closed. Then, similar to the first embodiment, the penetrant liquid inside the subordinate liquid supply systems 59 is replaced with air (see FIG. 9). Finally, the air inside the subordinate liquid supply systems 59 for ejecting ink is replaced with reactive ink and the air inside the subordinate liquid supply systems 59 for ejecting penetrant liquid is replaced with the penetrant liquid (see FIG. 10). In this way, as shown in FIG. 20, ink packs 35 containing the reactive inks of the different colors are installed into the main tanks 31 of the liquid supply system 50 that are for holding ink, and penetrant liquid packs 36 containing the penetrant liquid (penetrant liquid B) corresponding to the reactive inks are installed into the main tanks 31 that are for holding penetrant liquid.

With the inkjet printer 100 of the second embodiment, like the first embodiment, a penetrant liquid is ejected onto a printing surface of the fabric serving as the recording medium PM and ink is injected onto the same printing surface. Thus, the action of the penetrant liquid adhered to the fabric facilitates penetration of the ink in the thickness direction of the fabric and enables the difference between the image densities of the printing surface and the non-printing surface to be reduced.

With the inkjet printer 100 of the second embodiment, since the penetrant liquid ejected onto the recording medium PM during inkjet textile printing can also be used to wash the inside of the subordinate liquid supply systems 59, the apparatus can be made less complex and more compact than an apparatus in which a penetrant liquid and a cleaning liquid are prepared separately.

With the inkjet printer 100 of the second embodiment, when the air inside the subordinate liquid supply systems 59 for ejecting ink is replaced with penetrant liquid during the ink changing process, the penetrant liquid is supplied from the penetrant liquid packs 36 installed in the main tanks 31 of the subordinate liquid supply systems 59 for ejecting penetrant liquid. Consequently, it is not necessary to install penetrant liquid packs 36 in the ink tanks 31 of the subordinate liquid supply systems 59 that are for ejecting ink and the process of cleaning the liquid supply system 50 during the ink changing process can be accomplished more easily.

C. Third Embodiment

Figure 21:
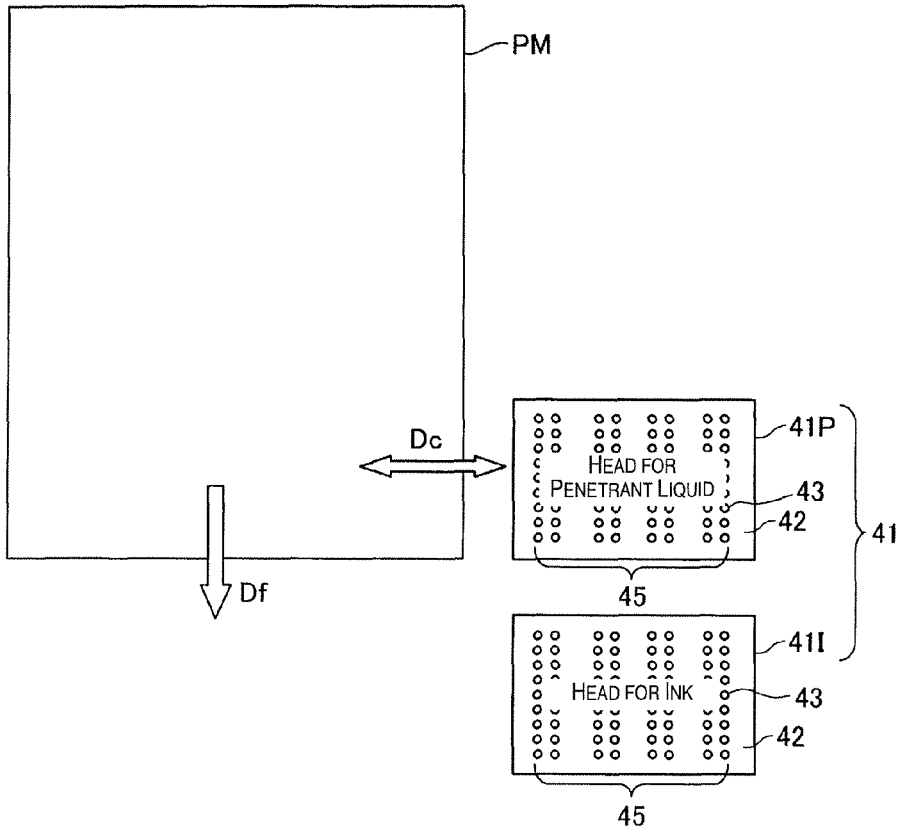
FIG. 21 illustrates constituent features of an ejection head 41 of an inkjet printer 100 according to a third embodiment.

FIG. 21 illustrates constituent features of an ejection head 41 of an inkjet printer 100 according to a third embodiment. In the third embodiment, the ejection head 41 includes an ink head 41I and a penetrant liquid head 41P. Ink nozzle lines 45 are formed in the nozzle face 42 of the ink head 41I, and penetrant liquid nozzle lines 45 are formed in the penetrant liquid head 41P. The penetrant liquid head 41P is positioned upstream of the ink head 41I in the subordinate scanning direction Df.

The printing process is the same in the third embodiment as in the first embodiment (FIG. 5). However, in the third embodiment, the ejections of penetrant liquid and the ejections of ink onto each position of the recording medium PM are separated into preceding and subsequent main scans instead of executed during the same main scan. More specifically, the penetrant liquid is ejected onto each position of the recording medium PM during a main scan and the inks are ejected onto each position in the next main scan or a subsequent main scan. Thus, with the inkjet printer 100 of the third embodiment, like the first embodiment, printing process can be accomplished in which the ink is ejected onto the same printing surface as the penetrant liquid after the penetrant liquid has been ejected onto the printing surface of the fabric serving as the recording medium PM and the image density difference can be reduced between the printing surface and the non-printing surface.

D. Variations

The present invention is not limited to the embodiments explained heretofore and various modifications can be made without departing from the scope of the invention as defined by the claims. For example, the following variations are possible.

D1: Variation 1

The constituent features of the inkjet printers 100 are merely examples and various changes can be made. For example, although in the previously explained embodiments the inkjet printer 100 is a printing device configured to print using six colors, it is acceptable for the inkjet printer 100 to be a printing device configured to print using five or fewer colors or using seven or more colors. Regardless of the number of ink colors used, the inkjet printer 100 has a separate subordinate liquid supply system for each color of ink.

Although in the previously explained embodiments the sub tanks 53 are mounted on the carriage 22, it is acceptable for the sub tanks 53 to be mounted on the printer main body 10 instead of the carriage 22. It is also acceptable to mount both the sub tanks 53 and the main tanks 31 on the carriage 22. It is also acceptable if the liquid supply system 50 does not have any sub tanks 53. It is not necessary for the ink packs and the penetrant liquid packs 36 to be made of pliable bags; any configuration can be used so long as the textile printing liquid contained inside can be pumped out. Although in the embodiments the subordinate scanning is accomplished by transporting the recording medium PM, all that is required of the subordinate scan is that the recording medium PM and the ejection head 41 undergo relative movement along the subordinate scanning direction Df. Thus, it is acceptable for the ejection head 41 to be moved in order to accomplish the subordinate scans.

Although in the previously explained embodiments the inkjet printer 100 is a piezo-type inkjet printer that uses piezo elements (piezoelectric elements) that undergo deformation when a voltage is applied, the present invention be applied to thermal-type inkjet printers in which ink is ejected by heating the inside of the supply pipe and generating bubbles in the ink or a continuance type inkjet printer that ejects ink continuously onto the print medium using a pump.

It is acceptable for an ink repellent treatment to be applied to a surface layer portion of a nozzle plate forming the nozzle face 42 of the ejection head 41. The ink repellent treatment suppresses in-flight curving of the ink and enables the desired image to be printed on the fabric with superior reproducibility. The in-flight curving prevention effect can be markedly improved by adding alkylene glycol monoalkyl ester or 1,2-hexanediol to the previously explained textile printing ink. It is also acceptable to apply an ink repellent treatment to the internal hole surfaces of the nozzles 43 formed in the nozzle face 42. Applying an ink repellent treatment to the internal hole surfaces of the nozzles 43 stabilizes the position of the ink meniscus and improves the ejection stability. Consequently, ink is less likely to arrive at the nozzle plate surface and the ink repelling performance of the nozzle surface can be maintained for a longer period of time.

The opening diameter of the nozzles 43 can be set to any desired opening diameter. The nozzle plate can be made of such materials as metal, ceramic, silicone, glass, or plastic. Preferred examples include such single metals as titanium, chrome, iron, cobalt, nickel, copper, zinc, tin, and gold; such allows as nickel-phosphorous alloys, tin-copper-phosphorous alloys, copper-zinc alloys, and stainless steel; polycarbonate, polysulfone, acrylonitrile-butadiene-styrene copolymers; polystyrene terephthalate; polysulfone; and various types of light sensitive resins. While there are no particular limitations on the treatment method used to make a surface of any of these materials repel ink, a preferred method, for example, is to soak the nozzle plate surface in an electrolyte liquid in which nickel ions and water repellent macromolecular resin particles have been dispersed by applying an electric charge and to agitate the electrolyte liquid while the nozzle plate surface soaks such that a eutectoid plating forms on the nozzle plate surface. Preferred examples of the macromolecular resin materials used for the eutectoid plating include such resins as polytetrafluoroethylene, poly perfluoroalkoxy butadiene, polyfluorovinylidene, and poly perfluoroalkyl fumarate used independently or as a mixture. Metal materials that can be used need not limited to nickel and, for example, copper, silver, or zinc can be selected as appropriate. Preferred materials are materials that increase the surface hardness and have excellent wear resistance, e.g., nickel-cobalt alloys and nickel-boron alloys.

Although in the previously explained third embodiment the penetrant liquid head 41P is positioned upstream of the ink head 41I in the subordinate scanning direction Df, it is acceptable for the penetrant liquid head 41P to be positioned downstream of the ink head 41I in the subordinate scanning direction Df. In such a case, a printing process can be accomplished in which ink is ejected onto a printing surface of the fabric serving as the recording medium PM and, afterwards, a penetrant liquid is ejected onto the same printing surface.

Figure 22A:
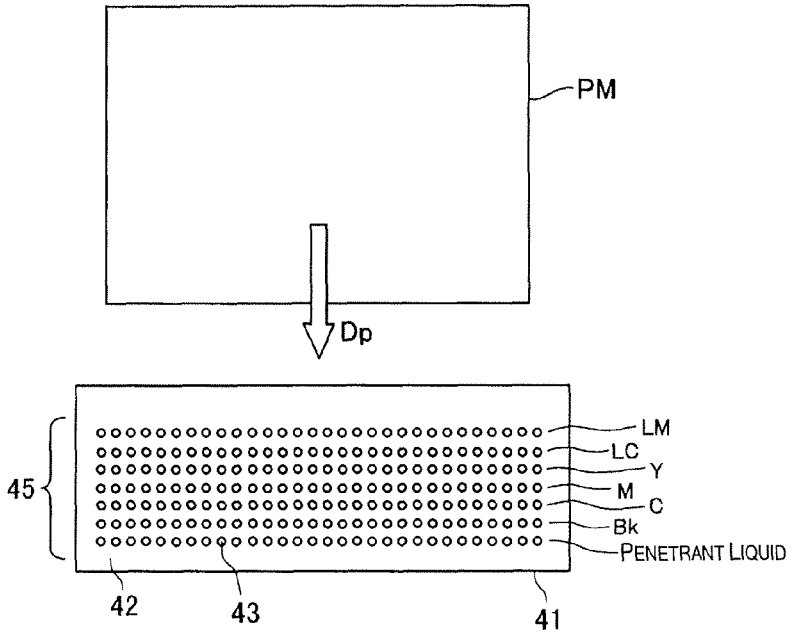
FIGS. 22A and 22B illustrate constituent features of an ejection head 41 according to a variation.
Figure 22B:
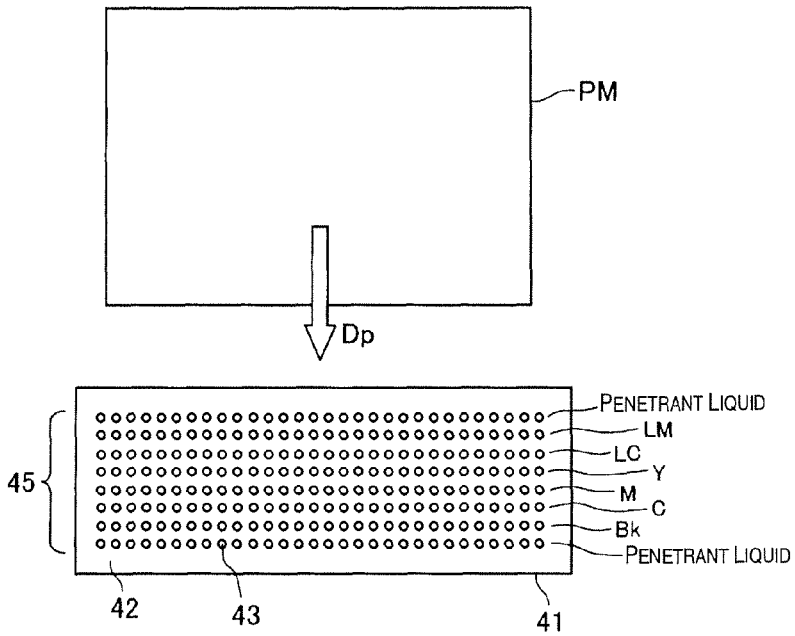

In the previously explained embodiments, the inkjet printer 100 is configured to print while repeatedly executing movements (main scans) of the ejection head 41 in the main scanning direction Dc of the carriage 22 on which the ejection head 41 is mounted and movements (subordinate scans) of the recording medium PM relative to the ejection head 41 along the subordinate scanning direction Df. The present invention can be applied to a line printer that prints with one of the ejection head 41 and the carriage 22 held stationary while the other moves relative to the stationary part. In such a case, the nozzles of the ejection head 41 are arranged along a widthwise direction of the recording medium PM (i.e., a direction that intersects with the direction in which the recording medium moves with respect to the nozzle lines 45). A nozzle line 45 that comprises a plurality of nozzles 43 and ejects light magenta (LM) ink is arranged in a position closest to the recording medium such that it extends in a left-right direction in the plane of the paper. A nozzle line 45 that comprises a plurality of nozzles 43 and ejects light cyan (LC) ink is arranged in the next closest position (and extending in the left-right direction of the paper), and similarly nozzle lines 45 for the ink colors yellow (Y), magenta (M), cyan (C), and black (Bk) and a nozzle line 45 for ejecting the penetrant liquid are arranged to extend in the left-right direction of the paper. FIGS. 22A and 22B illustrate constituent features of an ejection head 41 according to a variation. As shown in FIG. 22A, the nozzle face 42 of the ejection head 41 in this variation has nozzle lines 45 for six colors of ink and a nozzle line 45 for a penetrant liquid arranged to extend along a direction intersecting the movement direction Dp of the recording medium PM. Each of the nozzle lines 45 comprises a plurality of nozzles 43 arranged along a direction that intersects with the movement direction Dp of the recording medium PM. Nozzle lines 45 for penetrant liquid, LM ink, LC ink, Y ink, M ink, C ink, Bk ink, and penetrant liquid are arranged successively and each nozzle line comprises a plurality of nozzles 43 arranged along the left-right direction of the paper. A printer equipped with the ejection head 41 shown in FIG. 22A conducts printing by feeding the recording medium PM in the movement direction Dp while ejecting the inks and the penetrant liquid from the nozzle lines 45. Thus, the nozzle lines (head) do not move. In this way, the difference of image density between the printing surface and the non-printing surface can be decreased and print that is visible from both the printing surface and the non-printing surface can be accomplished by executing inkjet textile printing onto the printing surface.

As shown in FIG. 22B, it is acceptable to configure the nozzle face 42 of the ejection head 41 to have nozzle lines 45 for the penetrant liquid arranged on the upstream side and the downstream side (in the movement direction of the print medium PM) of the nozzle lines 45 for the six colors of ink oriented in a direction intersecting the movement direction of the recording medium PM such that the nozzle lines 45 for the six colors of ink are sandwiched in-between the nozzle lines 45 for the penetrant liquid. With this configuration, it is possible to execute any of the following: a printing process in which the penetrant liquid is ejected, the recording medium PM is moved, and then the ink is ejected onto the portion where the penetrant liquid was ejected; a printing process in which the ink is ejected, the recording medium PM is moved, and then the penetrant liquid is ejected onto the portion where the ink was ejected; and a printing process in which the penetrant liquid is ejected, the recording medium PM is moved, the ink is ejected onto the portion where the penetrant liquid was ejected, the recording medium PM is moved again, and the penetrant liquid is ejected again onto the portion where the ink was ejected. Although in the examples shown in FIGS. 22A and 22B the nozzle lines 45 (head) are stationary and the recording medium PM is moved relative to the nozzle lines 45, it is also acceptable if the recording medium PM is stationary and the nozzle lines 45 (head) are moved relative to the recording medium PM.

Although in the previously explained embodiments the control section 80 has image data that expresses an image to be recorded and the control section 80 executes the printing process to generate print data based on the image data, it is acceptable for the image data to be held in an external computer serving as a control device controlling the inkjet printer 100 and for the external computer to generate the print data based on the image data and supply the print data to the inkjet printer 100.

It is acceptable to replace a portion of components realized with hardware in the previously explained embodiments with software, and, conversely, it is acceptable to replace a portion of components realized with software in the previously explained embodiments with hardware.

If a portion or all of the functions of the present invention will be realized with software, then the software (computer program) can be provided in a form stored on a recording medium that can be read by a computer. In this invention, a "recording medium that can be read by a computer" is not limited to such portable media as a floppy disk or a CD-ROM. Other examples include RAM, ROM, and other internal storage devices installed inside a computer as well as hard disks and other external storage devices fixed to a computer.

D2: Variation 2

Although in the previously explained first embodiment the ink is ejected onto each position of the surface of the fabric after the penetrant liquid has been ejected, conversely it is acceptable to eject the ink first and then eject the penetrant liquid afterwards. In such a case, too, the penetrant liquid can be ejected at a timing occurring immediately after the ink has been ejected and before the coloring material has become fixed to the fabric such that the penetration of the ink adhered to the fabric in the thickness direction is facilitated and the image density difference between the printing surface and the non-printing surface can be decreased. Although the printing process executed in the previously explained first embodiment is accomplished using bidirectional printing, it is acceptable to use unidirectional printing. The nozzle lines 45 for the penetrant liquid are provided in the ejection head 41 in accordance with the sequential relationship in which the penetrant liquid and the ink will be ejected and whether unidirectional printing or bidirectional printing will be conducted. For example, if the printing process will be executed using unidirectional printing, then it is acceptable for the nozzle face 42 of the ejection head 41 to be provided with a nozzle line 45 for the penetrant liquid on only one side of the nozzle lines 45 for the six colors of ink. In such a case, if the ink will be ejected after the penetrant liquid has been ejected, then the nozzle line 45 for the penetrant liquid is provided on the side of nozzle lines 45 for the inks that is closer to the recording medium PM when the main scan starts. Meanwhile, if the penetrant liquid will be ejected after the ink has been ejected, then the nozzle line 45 for the penetrant liquid is provided on the side of nozzle lines 45 for the inks that is farther from the recording medium PM when the main scan starts.

Likewise, although in the previously explained third embodiment the ink is ejected onto each position of the surface of the fabric after the penetrant liquid has been ejected, conversely it is acceptable to eject the ink first and then eject the penetrant liquid afterwards. If the penetrant liquid will be ejected after the ink is ejected, then the penetrant liquid head 41P is arranged downstream of the ink head 41I in the subordinate scanning direction Df. Although the printing process executed in the previously explained third embodiment is accomplished using bidirectional printing, it is acceptable to use unidirectional printing.

Although in the previously explained embodiments the penetrant liquid is ejected onto a region of the fabric where ink will be ejected, it is also acceptable for the penetrant liquid to be ejected onto the entire surface of the fabric regardless of where the ink will be ejected.

D3: Variation 3

The compositions of the textile printing liquids (inks and penetrant liquids) presented in the embodiments and the evaluation test examples are merely examples and various changes are possible.

D4: Variation 4

In the previously explained embodiments, the following processes are executed: (a) a printing process in which the penetrant liquid A corresponding to the acidic ink is ejected from the nozzles 43 (first nozzle) of the nozzle line 45 for the penetrant liquid toward the first surface of the first fabric and the acidic ink is ejected from the nozzles 43 (second nozzle) of the nozzle line 45 for the acidic ink toward the portion of the first surface of the first fabric where the penetrant liquid was ejected; (b) a printing process in which the penetrant liquid B corresponding to the reactive ink is ejected from the nozzles 43 (first nozzle) of the nozzle line 45 for the penetrant liquid toward the first surface of the second fabric and the reactive ink is ejected from the nozzles 43 (second nozzle) of the nozzle line 45 for the reactive ink toward the portion of the first surface of the second fabric where the penetrant liquid was ejected; and (c) a process in which the penetrant liquid A corresponding to the acidic ink is ejected from the nozzles 43 (second nozzle) of the nozzle line 45 for the ink.

However, the present invention is not limited to such embodiments and can be applied to cases in which the following processes are executed: (a) a process (hereinafter called "printing A") in which a first textile printing colored liquid is printed onto a first fabric using a penetrant liquid ejecting procedure in which a first penetrant liquid that facilitates penetration of a first textile printing colored liquid into the first fabric is ejected from a first nozzle toward a first surface of the first fabric and a textile printing colored liquid ejecting procedure in which the first textile printing colored liquid is ejected from a second nozzle toward a portion of the first surface of the first fabric where the penetrant liquid was discharged; (b) a process (hereinafter called "printing B") in which a second textile printing colored liquid is printed onto a second fabric using a penetrant liquid ejecting procedure in which a second penetrant liquid that facilitates penetration of the second textile printing colored liquid into the second fabric is ejected from the first nozzle toward a first surface of the second fabric and a textile printing colored liquid ejecting procedure in which the second textile printing colored liquid is ejected from the second nozzle toward a portion of the first surface of the second fabric where the penetrant liquid was discharged; (c) a process (hereinafter called "inter-printing penetrant liquid ejection") in which at least one of the first penetrant liquid and the second penetrant liquid is ejected from the second nozzle.

It is possible to employ any of various combinations the fabrics, the penetrant liquids, and the textile printing colored liquids used in the printing A and the printing B and the penetrant liquid used in the inter-printing penetrant liquid ejection. FIGS. 23 to 38 present variations of the printing A, the printing B, and the inter-printing penetration liquid ejection. The combinations of fabric, penetrant liquid, and textile printing colored liquids used in each of the procedures (printing A, printing B, and inter-printing penetrant liquid ejection) are shown on the left side of each of the FIGS. 23 to 38. For example, in the combination shown on the first row of FIG. 23, the printing A involves ejecting the penetrant liquid P1 and the acidic ink onto the fabric 1, the inter-printing penetrant liquid ejection involves ejecting the penetrant liquid P1 from the second nozzle, and the printing B involves ejecting the penetrant liquid P1 and the acidic ink onto the fabric 1.

In FIGS. 23 to 38, the fabric 1 used when printing with the acidic inks was a silk fabric that had a mass per unit area of 53 $g/m^2$ and had been subjected to a padding treatment as a pretreatment using a pretreatment agent comprising 2.0 percent by mass of guar gum (Meypro Gum NP made by Sansho Co., Ltd.), 10.0 percent by mass of urea, 4.0 percent by mass of ammonium sulfate, and 84.0 percent by mass of water. The padding treatment was conducted in a padder (horizontal/vertical padder HVF350 made by Mathys) with a squeeze rate of 80%. Meanwhile, the fabric 2 used when printing with the reactive inks was a cotton fabric that had a mass per unit area of 122 $g/m^2$ and had been subjected to a padding treatment as a pretreatment using a pretreatment agent comprising 2.0 percent by mass of guar gum, 10.0 percent by mass of urea, 5.0 percent by mass of sodium bicarbonate, 1.0 percent by mass of silica, and 82.0 percent by mass of water. The fabric 3 used when printing with the disperse inks was a polyester fabric that had a mass per unit area of 120 $g/m^2$ and had been subjected to a padding treatment using a pretreatment agent comprising 2.0 percent by mass of guar gum, 10.0 percent by mass of urea, 2.0 percent by mass of citric acid, and 86.0 percent by mass of water. The fabric 4 used when printing with the pigment inks was a cotton fabric that had a mass per unit area of 122 $g/m^2$ and had not been pretreated. In FIGS. 23 to 38, the penetrant liquids P1 to P8 indicate the penetrant liquids P1 to P8 (FIG. 16) used in the evaluation tests explained previously.

The right side of each of FIGS. 23 to 38 shows the state (evaluation result) of the printing A, the inter-printing penetrant liquid ejection, and the printing B obtained using an inkjet printer (PX-G930 made by Seiko Epson Corp.) in accordance with the combinations shown on the left side in the same manner as the previously explained evaluation tests. The evaluation standards used with respect to the evaluation categories of density difference and bleeding regarding the printings A and B and cleaning of the second nozzle regarding the inter-printing penetrant liquid ejection are the same as in the previously explained evaluation tests. The evaluation categories indicated in FIGS. 23 to 38 also include clogging of the second nozzle during the printing A and the printing B and the presence/absence of color mixing between the ink used for the printing A and the ink used for the printing B. Clogging of the second nozzle did not occur with any of the combinations indicated in FIGS. 23 to 38, nor did color mixing of the inks.

D5: Variation 5

As is clear from FIGS. 23 to 38, it is acceptable if the same penetrant liquid is used as the penetrant liquid corresponding to the acidic inks and the penetrant liquid corresponding to the reactive inks in the previously explained embodiments. For example, it is acceptable to use any of the penetrant liquids P1 to P4 shown in FIG. 17 as a penetrant liquid corresponding to both acidic inks and reactive inks. Also, in the previously explained embodiments, it is acceptable if the same penetrant liquid is used as the penetrant liquid corresponding to disperse inks and the penetrant liquid corresponding to pigment inks in the previously explained embodiments. For example, it is acceptable to use either of the penetrant liquids P7 or P8 shown in FIG. 17 as a penetrant liquid corresponding to both acidic inks and reactive inks.

D6: Variation 6

As is clear from FIGS. 23 to 38, although in the previously explained embodiments, the subordinate liquid supply systems 59 including the nozzles are cleaned during an ink changing process in which the ink used is changed from one type of ink among acidic inks, reactive inks, disperse inks, and pigment inks (e.g., an acidic ink) to another type of ink (e.g., a reactive ink), it is also acceptable to clean the subordinate liquid supply systems 59 including the nozzles during an ink changing process in which the ink used is changed from an ink of one type among acidic inks, reactive inks, disperse inks, and pigment inks (e.g., a particular acidic ink) to another ink of the same type of ink (e.g., a different acidic ink). In such a case, it is acceptable to use the same penetrant liquid both before and after changing the ink or to use different penetrant liquids.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An inkjet textile printing method comprising:

printing onto a first fabric using a first textile printing colored liquid by executing a penetrant liquid ejecting step in which a first penetrant liquid that facilitates penetration of the first textile printing colored liquid into a first fabric is ejected from a first nozzle toward a first surface of the first fabric, and a textile printing colored liquid ejecting step in which the first textile printing colored liquid is ejected from a second nozzle toward a portion of the first surface of the first fabric where the first penetrant liquid was discharged;

printing onto a second fabric with a second textile printing colored liquid by executing a penetrant liquid ejecting step in which a second penetrant liquid that facilitates penetration of the second textile printing colored liquid into the second fabric is ejected from the first nozzle toward a first surface of the second fabric and a textile printing colored liquid ejecting step in which the second textile printing colored liquid is ejected from the second nozzle toward a portion of the first surface of the second fabric where the second penetrant liquid was discharged; and discharging at least one of the first penetrant liquid and the second penetrant liquid from the second nozzle between the printing with the first textile printing colored liquid and the printing with the second textile printing colored liquid.

2. The inkjet textile printing method according to claim 1, wherein the printing accomplished with the first textile printing colored liquid is visible from both surfaces of the first fabric, and the printing accomplished with the second textile printing colored liquid is visible from both surfaces of the second fabric.

3. The inkjet textile printing method according to claim 1, further comprising ejecting the first penetrant liquid from the second nozzle after the printing with the first textile printing colored liquid and before the printing with the second textile printing colored liquid.

4. The inkjet textile printing method according to claim 1, wherein the first textile printing colored liquid and the second textile printing colored liquid are different inks from among an acidic ink, a reactive ink, a dispersion ink, and a pigment ink, and different penetrant liquids are used for the first penetrant liquid and the second penetrant liquid.

5. The inkjet textile printing method according to claim 1, wherein one of the first textile printing colored liquid and the second textile printing colored liquid is an acidic ink and the other is a reactive ink, and the same penetrant liquid is used as the first penetrant liquid and the second penetrant liquid.

6. The inkjet textile printing method according to claim 1, wherein one of the first textile printing colored liquid and the second textile printing colored liquid is a dispersion ink and the other is a pigment ink, and the same penetrant liquid is used as the first penetrant liquid and the second penetrant liquid.

7. The inkjet textile printing method according to claim 1, wherein both the first textile printing colored liquid and the second textile printing colored liquid are acidic inks, reactive inks, dispersion inks, or pigment inks, and the same penetrant liquid is used as the first penetrant liquid and the second penetrant liquid.

8. The inkjet textile printing method according to claim 1, wherein the first penetrant liquid is a liquid whose main ingredients are ingredients of the first textile printing coloring liquid with the coloring material removed and the second penetrant liquid is a liquid whose main ingredients are ingredients of the second textile printing coloring liquid with the coloring material removed.

9. The inkjet textile printing method according to claim 1, wherein a plurality of different textile printing colored liquids are used as the first and second textile printing colored liquids, and in the textile printing colored liquid ejecting steps executed in order to print with the first textile printing colored liquid and to print with the second textile printing colored liquid, the different textile printing colored liquids are ejected from different second nozzles.

10. The inkjet textile printing method according to claim 9, wherein the penetrant liquid has as a main ingredient a solvent common to the different textile printing colored liquids.

11. The inkjet textile printing method according to claim 9, wherein the different textile printing colored liquids are of one type from among an acidic ink, a reactive ink, a dispersion ink, and a pigment ink and each of the different textile printing colored liquids has a different color.

12. An inkjet textile printing apparatus comprising:

a first nozzle;

a second nozzle;

a first printing part configured and arranged to print on a first fabric with a first textile printing colored liquid, the first printing part having a penetrant liquid ejecting section configured and arranged to eject a first penetrant liquid that facilitates penetration of the first textile printing colored liquid into the first fabric from the first nozzle toward a first surface of the first fabric, and a textile printing colored liquid ejecting section configured and arranged to eject the first textile printing colored liquid from the second nozzle toward a portion of the first surface of the first fabric where the first penetrant liquid was discharged;

a second printing part configured and arranged to print on a second fabric with a second textile printing colored liquid, the second printing part having a penetrant liquid ejecting section configured and arranged to eject a second penetrant liquid that facilitates penetration of the second textile printing colored liquid into the second fabric from the first nozzle toward a first surface of the second fabric, and a textile printing colored liquid ejecting section configured and arranged to eject the second textile printing colored liquid from the second nozzle toward a portion of the first surface of the second fabric where the second penetrant liquid was discharged; and a discharging part configured and arranged to discharge at least one of the first penetrant liquid and the second penetrant liquid from the second nozzle between the printing with the first textile printing colored liquid and the printing with the second textile printing colored liquid.

* * * * *